US009132938B2

(12) United States Patent
Tucker et al.

(10) Patent No.: US 9,132,938 B2
(45) Date of Patent: Sep. 15, 2015

(54) BAG WITH REINFORCING FEATURES

(75) Inventors: Edward B. Tucker, Yorkville, IL (US); David J. Hoying, Cincinnati, OH (US); Matthew W. Waldron, Hamilton, OH (US); Kyle R. Wilcoxen, Chicago, IL (US); Ryan J. Coonce, Palatine, IL (US)

(73) Assignee: The Glad Products Company, Oakland, CA (US)

( * ) Notice: Subject to any disclaimer, the term of this patent is extended or adjusted under 35 U.S.C. 154(b) by 440 days.

(21) Appl. No.: 13/292,480

(22) Filed: Nov. 9, 2011

(65) Prior Publication Data

US 2012/0057811 A1 Mar. 8, 2012

Related U.S. Application Data

(63) Continuation-in-part of application No. 13/169,827, filed on Jun. 27, 2011, now abandoned, which is a continuation-in-part of application No. 12/542,391, filed on Aug. 17, 2009, now abandoned.

(60) Provisional application No. 61/091,143, filed on Aug. 22, 2008.

(51) Int. Cl.

| | |
|---|---|
| ***B65D 30/08*** | (2006.01) |
| ***B65D 33/00*** | (2006.01) |
| ***B65D 33/02*** | (2006.01) |

(Continued)

(52) U.S. Cl.

CPC . *B65D 33/00* (2013.01); *B31B 1/00* (2013.01); *B65D 31/04* (2013.01); *B65D 33/02* (2013.01); *B65D 33/1608* (2013.01); *B65D 33/28* (2013.01); *B65F 1/0006* (2013.01); *B31B 2219/23* (2013.01); *B31B 2237/10* (2013.01);

(Continued)

(58) Field of Classification Search

USPC ..... 383/109, 112–114, 116, 119

See application file for complete search history.

(56) References Cited

U.S. PATENT DOCUMENTS 3,321,125 A * 5/1967 Quackenbush et al. ..... 383/35
3,593,622 A 7/1971 Sengewald (Continued)

FOREIGN PATENT DOCUMENTS

WO WO 2006135562 A2 * 12/2006 ..... B65F 1/00

OTHER PUBLICATIONS

International Search Report from counterpart PCT/US 2012/064288, mailing date Jan. 25, 2013, International filing date Nov. 9, 2012.

*Primary Examiner* — Jes F Pascua
*Assistant Examiner* — Nina Attel
(74) *Attorney, Agent, or Firm* — Thomas C. Feix

(57) ABSTRACT

A plastic bag with flexible sidewalls defining an interior volume for holding contents includes a reinforcing feature to resist puncture and/or rupture of the bag. The reinforcing feature may include reinforcing the portion of the bag proximate the bottom edge with additional or thicker thermoplastic material. In various embodiments, the reinforcing feature may be a multilayer strip of plastic material attached along a bottom edge of the bag, either internally or externally, to provide additional material resistant to puncture. The reinforcing feature may be adhesively bonded, heat bonded, or cold bonded to the bag sidewalls. In other embodiments, the sheet material used to produce the bag may be made with varying thicknesses. In addition, methods of manufacturing a bag with such reinforcing features in a high speed automated process are disclosed.

21 Claims, 30 Drawing Sheets

(51) Int. Cl.

| | |
|---|---|
| ***B65D 33/16*** | (2006.01) |
| ***B65D 33/28*** | (2006.01) |
| ***B31B 1/00*** | (2006.01) |
| ***B65F 1/00*** | (2006.01) |

(52) U.S. Cl.
CPC ..... *B31B 2237/40* (2013.01); *B31B 2237/406* (2013.01); *B65F 1/002* (2013.01)

(56) References Cited

U.S. PATENT DOCUMENTS

| | | | | |
|---|---|---|---|---|
| 3,984,047 | A | 10/1976 | Clayton et al. | |
| 4,076,121 | A | 2/1978 | Clayton et al. | |
| 4,087,577 | A | 5/1978 | Hendrickson | |
| 4,793,885 | A * | 12/1988 | Rasmussen | 156/200 |
| 4,813,792 | A | 3/1989 | Belmont et al. | |
| 4,890,936 | A * | 1/1990 | Cooper | 383/109 |
| 4,925,711 | A * | 5/1990 | Akao et al. | 428/35.2 |
| 5,545,419 | A * | 8/1996 | Brady et al. | 426/129 |
| 6,015,235 | A * | 1/2000 | Kraimer et al. | 383/109 |
| 6,565,794 | B1 | 5/2003 | Fraser | |
| 6,874,938 | B2 | 4/2005 | Price et al. | |
| 7,422,105 | B2 * | 9/2008 | Loyd et al. | 206/438 |
| 2002/0191868 | A1 | 12/2002 | Simhaee | |
| 2004/0118735 | A1 * | 6/2004 | Mize et al. | 206/497 |
| 2005/0254731 | A1 | 11/2005 | Berbert et al. | |
| 2005/0286808 | A1 | 12/2005 | Zimmerman et al. | |
| 2011/0052104 | A1 | 3/2011 | Wilcoxen et al. | |
| 2011/0255809 | A1 | 10/2011 | Tucker et al. | |

* cited by examiner

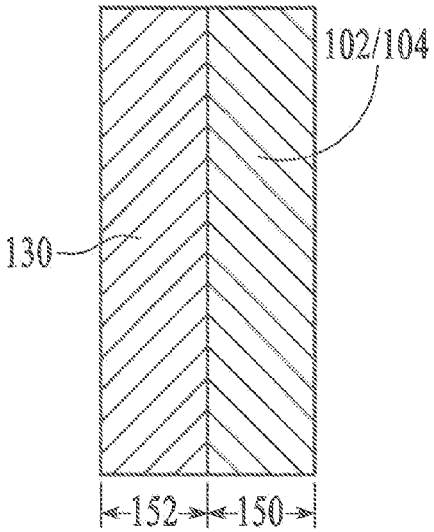
FIG. 3A
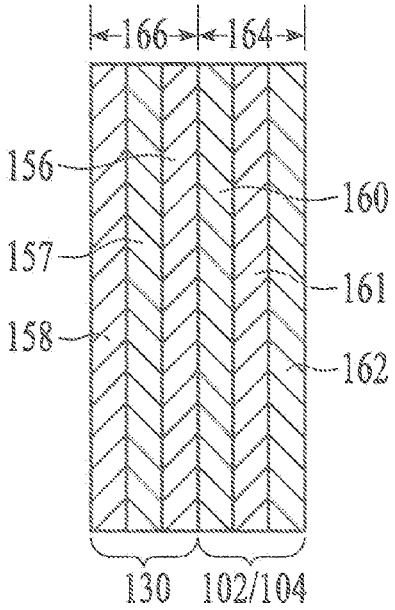
FIG. 3B
FIG. 3C
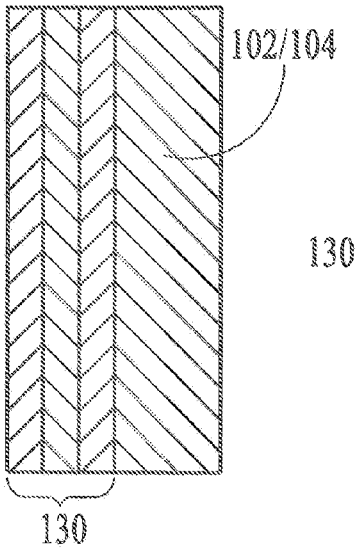
FIG. 3D
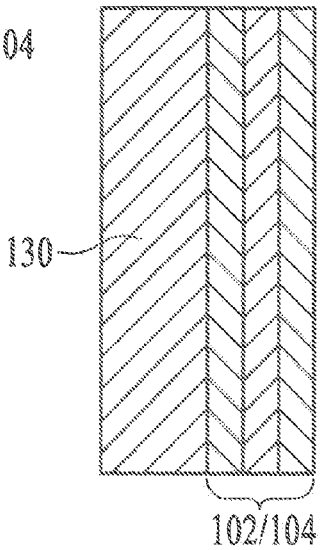
FIG. 3E
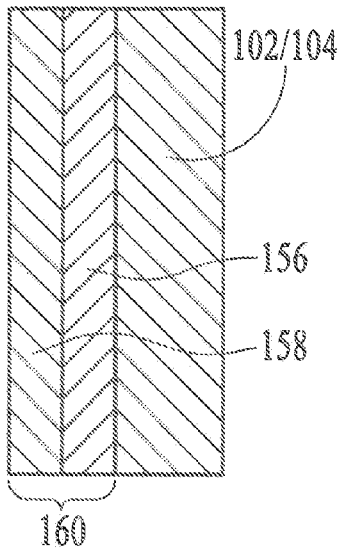

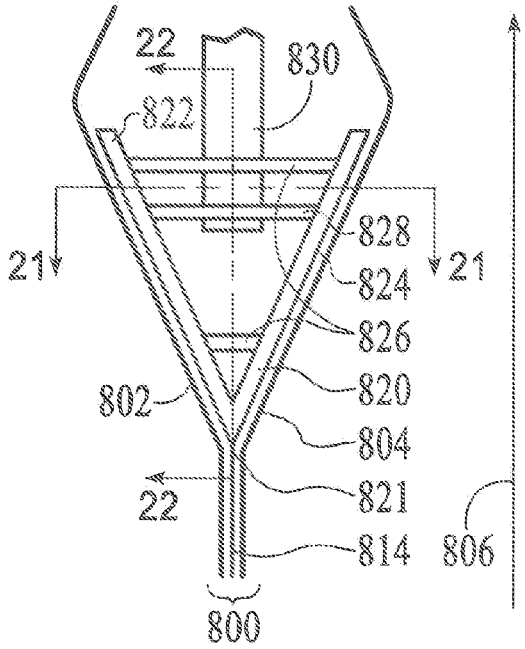
FIG. 20
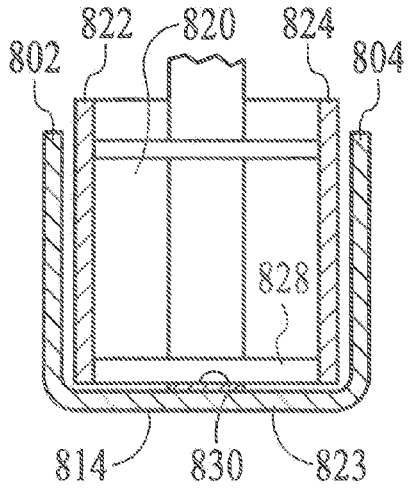
FIG. 21
FIG. 22
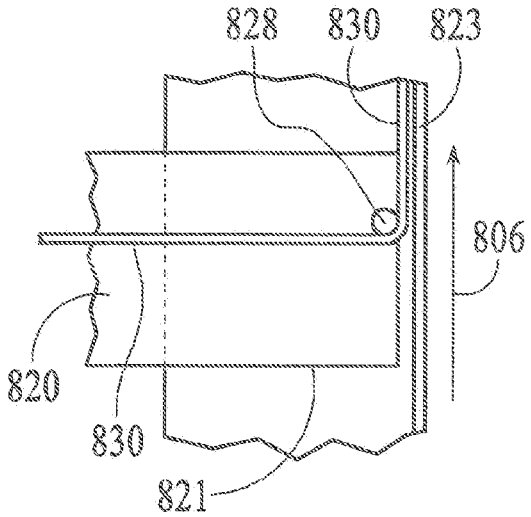

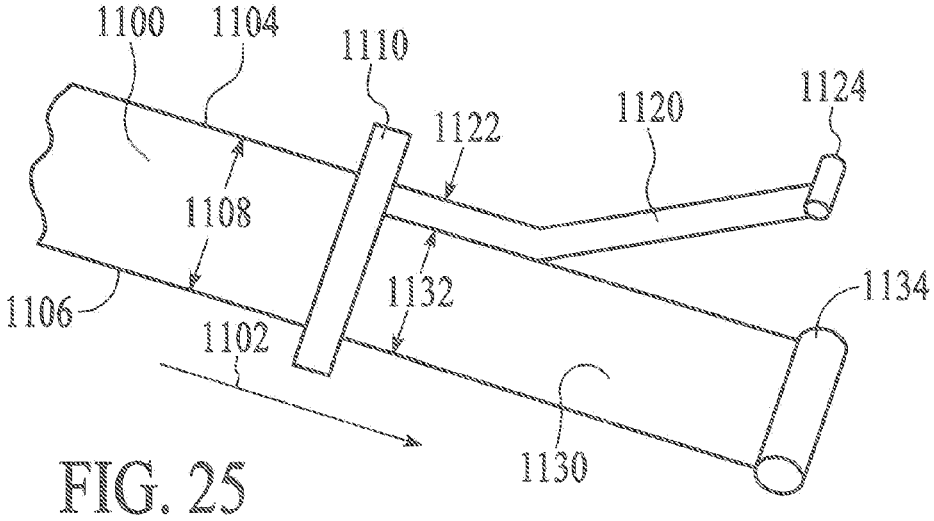
FIG. 25
FIG. 26
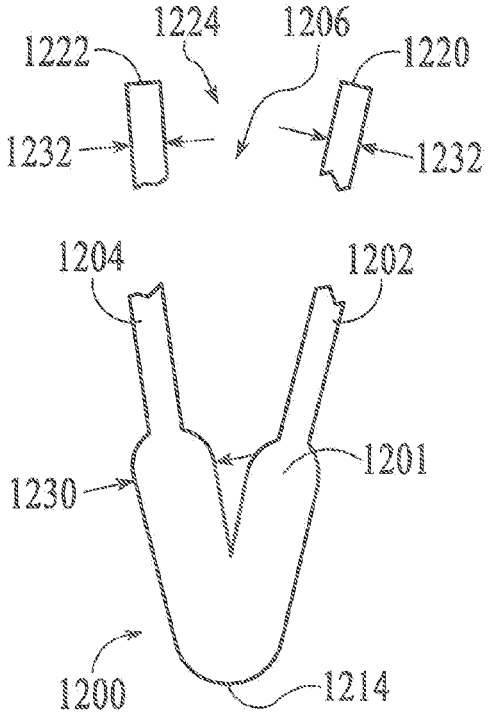
FIG. 27
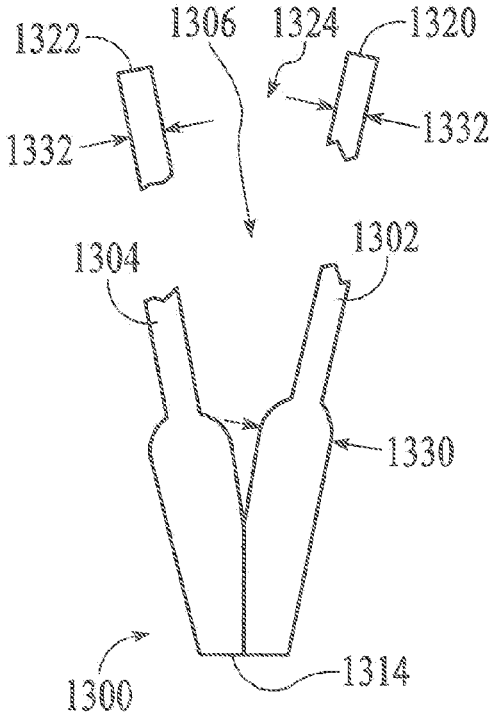

BAG WITH REINFORCING FEATURES

CROSS REFERENCE TO RELATED APPLICATIONS

This application is a Continuation-in-Part and claims the benefit of U.S. application Ser. No. 13/169,827, filed Jul. 27, 2011 now abandoned, which claims the benefit of U.S. application Ser. No. 12/542,391, filed Aug. 17, 2009 now abandoned, which claims the benefit of U.S. Provisional Application No. 61/091,143, filed Aug. 22, 2008, which are hereby incorporated by reference in their entirety.

BRIEF SUMMARY

Among their many applications, it is known to use thermoplastic bags as liners in trash or refuse receptacles. Trash receptacles that employ such liners can be found at many locations from small household kitchen garbage cans to larger, multi-gallon drums located in public places and restaurants. Bags that are intended to be used as liners for such refuse containers are typically made from low-cost, pliable thermoplastic material. When the receptacle is full, the thermoplastic liner actually holding the trash can be removed for further disposal and replaced with a new liner.

It is desirable to reduce the cost of producing the disposable thermoplastic bags as much as possible. Therefore, such bags typically are mass-produced in high speed manufacturing environments. Other cost savings can be realized by reducing the amount or quality of thermoplastic material utilized to make the bag. However, as can be appreciated by those of skill in the art, reducing the amount or quality of thermoplastic material forming the bag limits bag strength and makes the bag susceptible to tearing or rupture. Accordingly, there is a need for a thermoplastic bag designed in a manner that reduces material cost while maintaining strength and facilitating high-speed manufacturing.

A thermoplastic bag may be provided for use as a trash receptacle liner that includes a reinforcing feature to resist rupture or puncture. In an embodiment, the bag may include opposing first and second sidewalls of thermoplastic material overlaid and joined to each other along a bottom edge to provide an interior volume for receiving trash. The sidewalls remain un-joined along a top edge, located opposite the bottom edge, to provide an opening for accessing the interior volume. The reinforcing feature may be a strip of reinforcing material proximate the bottom edge and attached thereto. The reinforcing strip provides an added layer for strengthening the bag in a region that may be prone to rupture or failure. The reinforcing strip may be made of a thinner material, a material of the same thickness, or a thicker material than the first and second sidewalls. The reinforcing strip may be made of a weaker material, a material of the same strength or a stronger material than the first and second sidewalls. In various embodiments, the reinforcing strip may be inserted into the interior of the bag and attached proximate the bottom edge, or the reinforcing strip may be folded about the exterior proximate the bottom edge.

A method for the high-speed production of a bag with reinforcing strips may be provided. The production method utilizes continuous webs and/or strips of thermoplastic material that are advanced through various processing equipment that processes the webs and/or strips into a plurality of individual finished bags. Because the bags are manufactured from continuous webs processed through the processing equipment, a high-speed manufacturing environment is achieved with resulting lowered incremental cost per bag.

A thermoplastic bag may be provided that includes opposing first and second sidewalls overlaid and joined to each other along a closed bottom edge and sealed side edges to provide an interior volume. The sidewalls remain un-joined along a top edge located opposite the bottom edge to provide an opening for accessing the interior volume. To provide the reinforcing feature, the thickness of the first and second sidewalls may be greater proximate the closed bottom edge than the thickness of the sidewalls proximate the open top edge. In various embodiments, the first and second sidewalls may be made from the same web of thermoplastic material or may be made from two separate webs of thermoplastic material that are joined together.

BRIEF DESCRIPTION OF THE DRAWINGS

FIGS. 3A-3E are expanded cross-sectional views of the area indicated in FIGS. 2A-2B by circle 3-3, illustrating embodiments of the thermoplastic bag with the reinforcing strip.

FIG. 20 is a top plan view of another embodiment of a bag processing environment wherein a folded web is partially separated by a V-shaped plate and a reinforcing strip is inserted into the separated web.

FIG. 21 is a cross-sectional view taken along line 21-21 of FIG. 20 illustrating the arrangement of the separated web and reinforcing strip within the bag processing environment.

FIG. 22 is a cross-sectional view taken along line 22-22 of FIG. 20.

FIG. 25 is a schematic view illustrating a processing environment for producing both a thermoplastic web and a reinforcing strip from the same material.

FIG. 26 is a cross-sectional view similar to that of FIG. 2 depicting a thermoplastic bag having a reinforced bottom edge made from a single extruded web.

FIG. 27 is a cross-sectional view similar to that of FIG. 2 depicting a thermoplastic bag having a reinforced bottom edge made from first and second extruded webs joined together.

DESCRIPTION

Figure 1A:
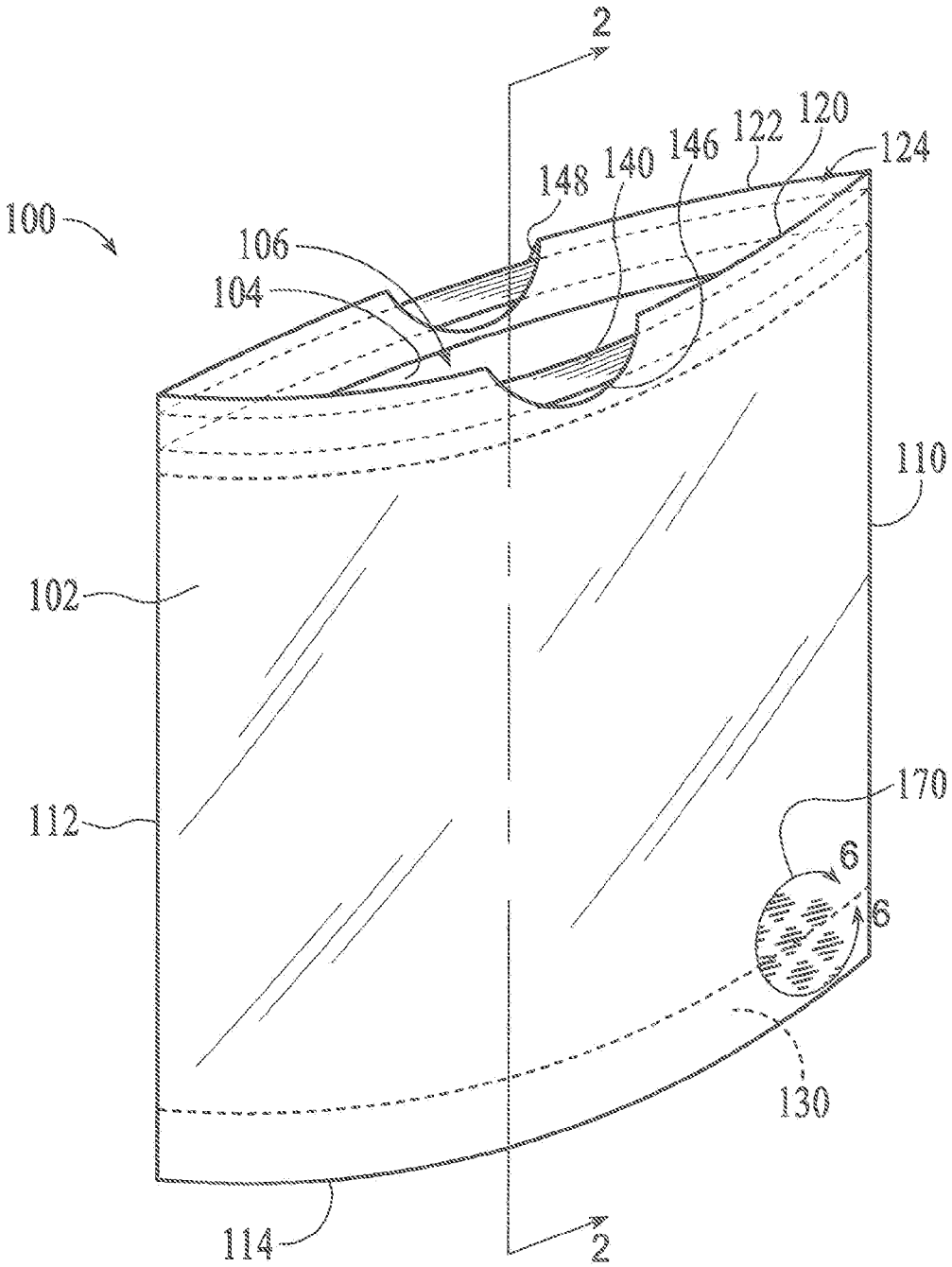
FIG. 1A is a perspective view of a thermoplastic bag including a reinforcing strip inserted into the bag proximate the bottom edge of the bag.

As used herein, "anti-block agent" refers to an additive that is incorporated into a film to prevent the surface of a film from sticking to itself or other surfaces.

As used herein, the term "oriented" refers to a polymer-containing material which has been stretched at an elevated temperature (the orientation temperature), followed by being "set" in the stretched configuration by cooling the material while substantially retaining the stretched dimensions. Upon subsequently heating unrestrained, unannealed, oriented polymer-containing material to its orientation temperature, heat shrinkage is produced.

As used herein, the term "cold bonded" refers to processes for bonding two or more film layers without the application of heat, or adhesives, or without the application of polymer surface modification techniques to enhance bonding, such as electrostatic pinning, corona or flame treatment, or photografting. Cold bonding processes involve simultaneously bonding and stretching two or more layers. Examples include cold ring-rolling, cold embossing, and cold forming strainable networks.

Useful materials in the inventive films include but are not limited to thermoplastic polyolefins, including polyethylene and copolymers thereof and polypropylene and copolymers thereof. Useful copolymers include ethylene vinylacetate (EVA), ethylene methyl acrylate (EMA) and ethylene acrylic acid (EAA), or blends of such polyolefins. Other examples of polymers suitable for use as films include elastomeric polymers. Suitable elastomeric polymers include poly(ethylene-butene), poly(ethylene-hexene), poly(ethylene-octene), poly (ethylene-propylene), poly(styrene-butadiene-styrene), poly (styrene-isoprene-styrene), poly(styrene-ethylene-butylene-styrene), poly(ester-ether), poly(ether-amide), poly (ethylene-vinylacetate), poly(ethylene-methylacrylate), poly (ethylene-acrylic acid), poly(ethylene butylacrylate), polyurethane, poly(ethylene-propylene-diene), ethylene-propylene rubber. It can be suitable to blend into the resin a suitable amount of a cling agent, such as polyisobutylene, to control the level of bonding during the bonding process.

The Melt Index (MI) of polyethylene is useful and is in the range of from about 0.01 to about 10. (Melt Index is expressed as g/10 min.) Melt index is generally understood to be inversely related to viscosity, and decreases as molecular weight increases. Accordingly, higher molecular weight polyethylene generally has a lower melt index. Methods for determining melt index are known in the art, e.g., ASTM D 1238.

Vicat softening temperature or Vicat hardness is the determination of the softening point for materials that have no definite melting point, such as plastics. It is taken as the temperature at which the specimen is penetrated to a depth of 1 mm by a flat-ended needle with a 1 square mm circular or square cross-section. The Vicat softening temperature is measured according to ASTM D1525.

As the term "high density polyethylene" (HDPE) is used herein, it is defined to mean an ethylene-containing polymer having a density of 0.940 or higher. (Density (d) is expressed as g/cm$^3$) One particularly suitable HDPE for use with the methods of the present invention is the resin sold as M6211 (d=0.958) by Equistar. Another particularly suitable HDPE is the resin sold as HD 7845.30 (d=0.958) by Exxon. Other suitable HDPE resins include, for example, BDM 94-25 (d=0.961) and 6573 XHC (d=0.959) which are both available from Fina Oil and Chemical Co., Dallas, Tex. and Sclair 19C (d=0.951) and 19F (d=0.961) which are both available from Nova Corporation, Sarnia, Ontario, Canada.

The term "low density polyethylene" (LDPE) as used herein is defined to mean an ethylene-containing polymer having a density of about 0.930 or lower and a MI of about 7. LDPE is readily available, e.g., PE 1017 (MI=7; d=0.917) from Chevron, San Francisco, Calif., SLP 9045 (MI=7.5; d=0.908) from Exxon, Houston, Tex., and ZCE 200 (MI=3; d=0.918) from Mobil Chemical Corporation, Fairfax, Va.

The term "very low density polyethylene" (VLDPE) as used herein is defined to mean an ethylene-based hexane copolymer having a density of from about 0.880 to about 0.915 and a MI of from about 3 to about 17. VLDPE is readily available from Exxon, e.g., Exact Plastomer SLP-9087 (MI=7.5; d=0.900) and Exact Plastomer SLP-9088 (MI=16.5; d=0.900). Other suitable VLDPE resins include, for example, product No. XPR 0545-33260 46L (MI=3.3; d=0.908) from Dow Chemical Company, Midland, Mich. The term "ultra low density polyethylene" (ULDPE) as used herein is defined to mean ethylene-containing polymer having a density of about 0.890 to about 0.920.

The term "linear low density polyethylene" (LLDPE) as used herein is defined to mean a copolymer of ethylene and a minor amount of an olefin containing 4 to 10 carbon atoms, having a density of from about 0.910 to about 0.932 and a MI of from about 0.5 to about 10. LLDPE is readily available, e.g., Dowlex® 2045.03 (MI=1.1; d=0.920) from Dow Chemical Company, Midland, Mich.

Referring to FIGS. 1A-1F, there is illustrated an embodiment of a flexible bag 100. While flexible bags are generally capable of holding a vast variety of different contents, the specific bag 100 illustrated in FIGS. 1A-1F may be used as a liner for a garbage can or similar refuse container. The bag 100 may be made from a first sidewall 102 and an opposing second sidewall 104 overlying the first sidewall to provide an interior volume 106 therebetween. The first and second sidewalls 102, 104 may be joined along a first side edge 110, a parallel or non-parallel second side edge 112, and a closed bottom edge 114 that extends between the first and second side edges. The sidewalls 102, 104 may be joined along the first and second side edges 110, 112 and bottom edge 114 by any suitable process such as, for example, heat sealing.

For accessing the interior volume 106 to, for example, to insert refuse or garbage, the top edges 120, 122 of the first and second sidewalls 102, 104 remain un-joined to define an opening 124 located opposite the closed bottom edge 114. When placed in a trash receptacle, the top edges 120, 122 of the first and second sidewalls 102, 104 may be folded over the rim of the receptacle.

The first and second sidewalls 102, 104 may be made of flexible or pliable thermoplastic material formed or drawn into a smooth, thin-walled web or sheet. Examples of suitable thermoplastic material may include polyethylenes, such as, high density polyethylene, low density polyethylene, linear low density polyethylene, polypropylene, ethylene vinyl acetate, nylon, polyester, ethylene vinyl alcohol, ethylene methyl acrylate, or other materials and may be formed in combinations and in single or multiple layers. When used as a garbage can liner, the thermoplastic material may be opaque but in other applications may be transparent, translucent, or tinted. Furthermore, the material used for the sidewalls may be a gas impermeable material.

To strengthen the bag 100 in order to reduce rupture or puncture, the bag may include a reinforcing feature in the form of a reinforcing strip 130 proximate and attached to the bottom edge 114 of the bag. In the illustrated embodiment, the reinforcing strip 130 may be inserted into the interior volume 106 between the first and second sidewalls 102, 104. The reinforcing strip 130 may extend between the first and second side edges 110, 112 to be substantially coextensive with the bottom edge 114.

Figure 2A:
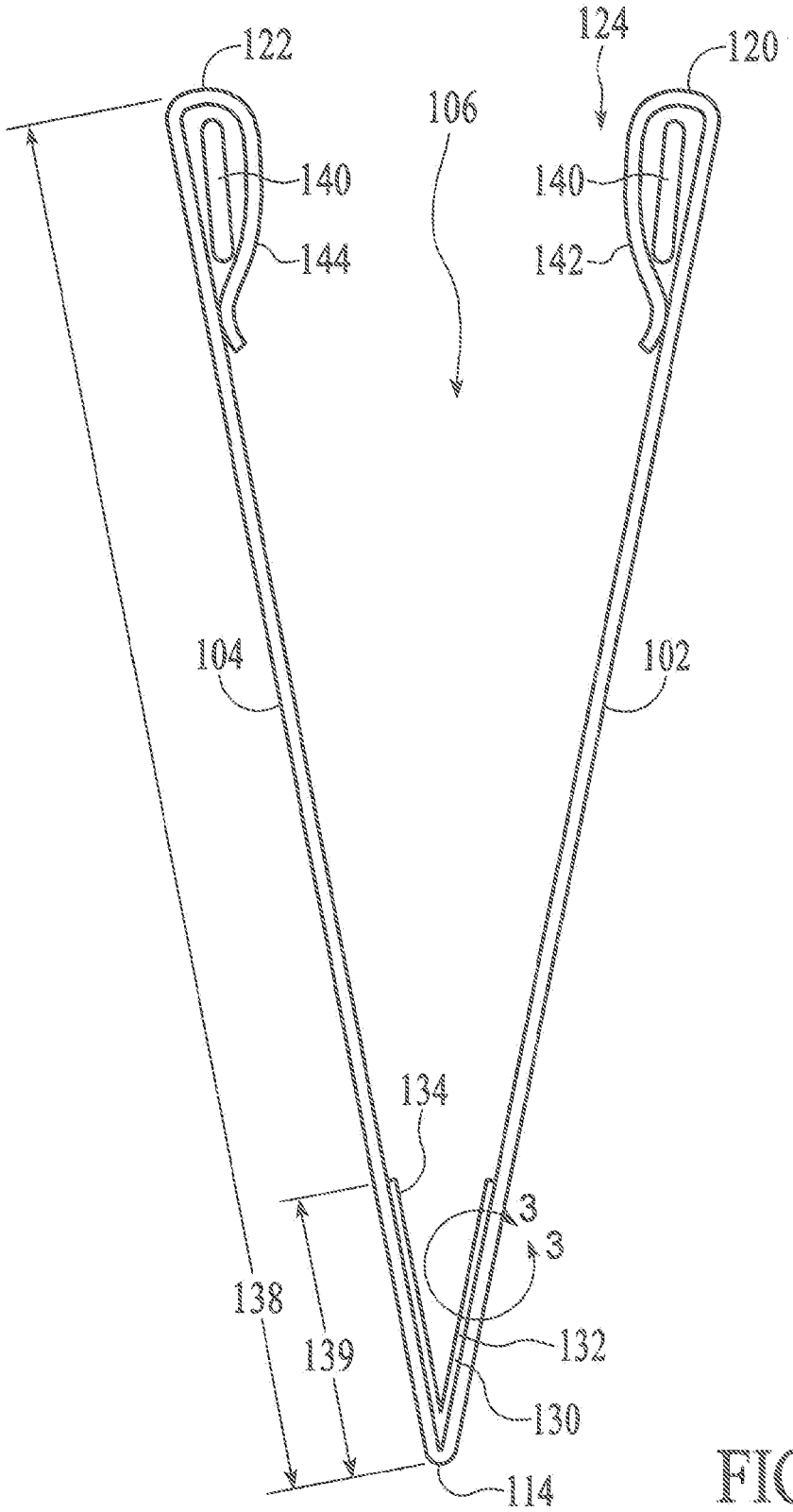
FIG. 2A is a cross-sectional view taken along line 2-2 of FIGS. 1A-1F depicting the reinforcing strip inserted into the bottom interior of the bag.
Figure 2B:
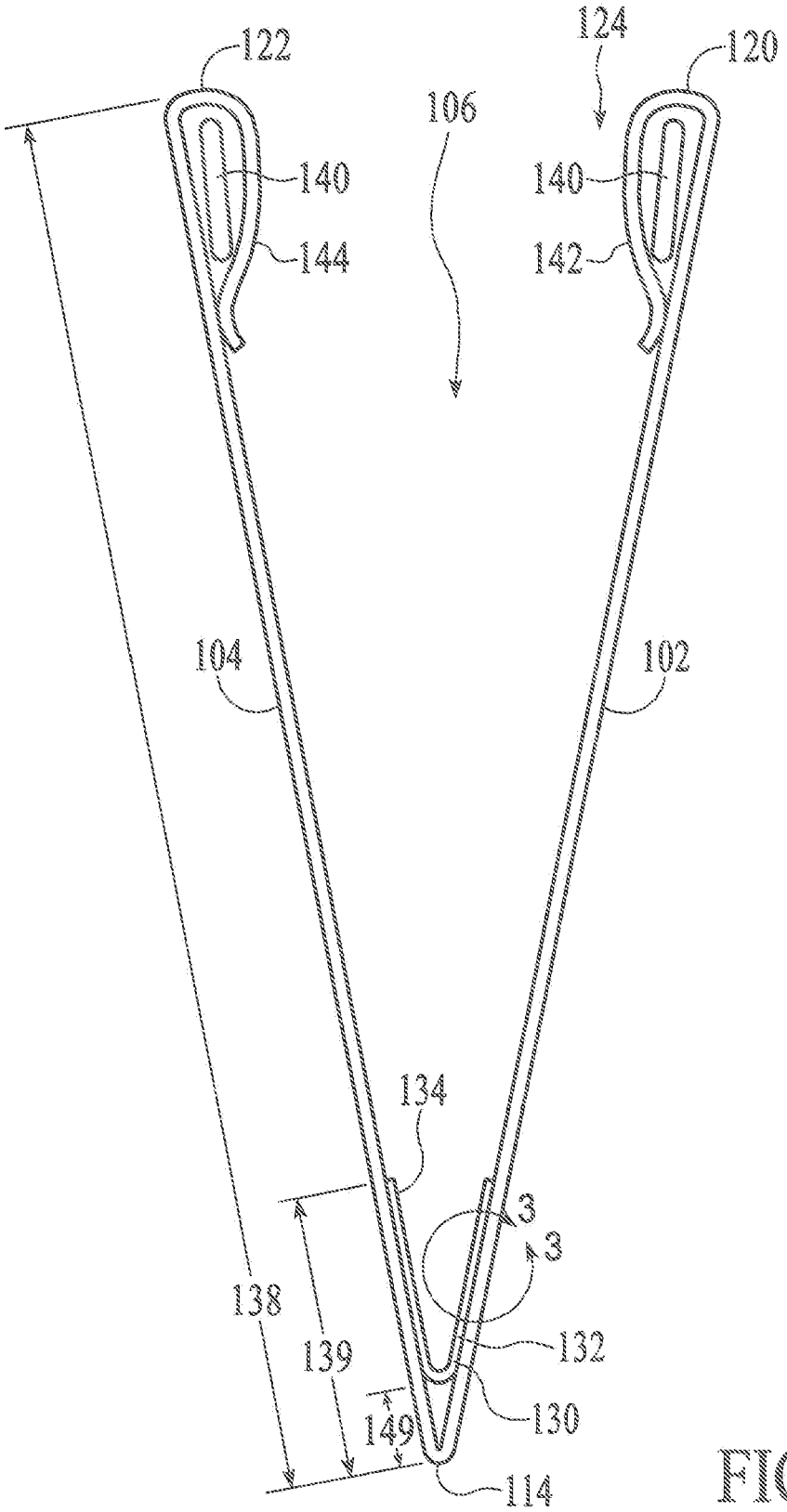
FIG. 2B is a cross-sectional view taken along line 2-2 of a bag similar to FIGS. 1A-1F depicting the reinforcing strip inserted the interior of the bag and raised from the bottom of the bag.
Figure 2C:
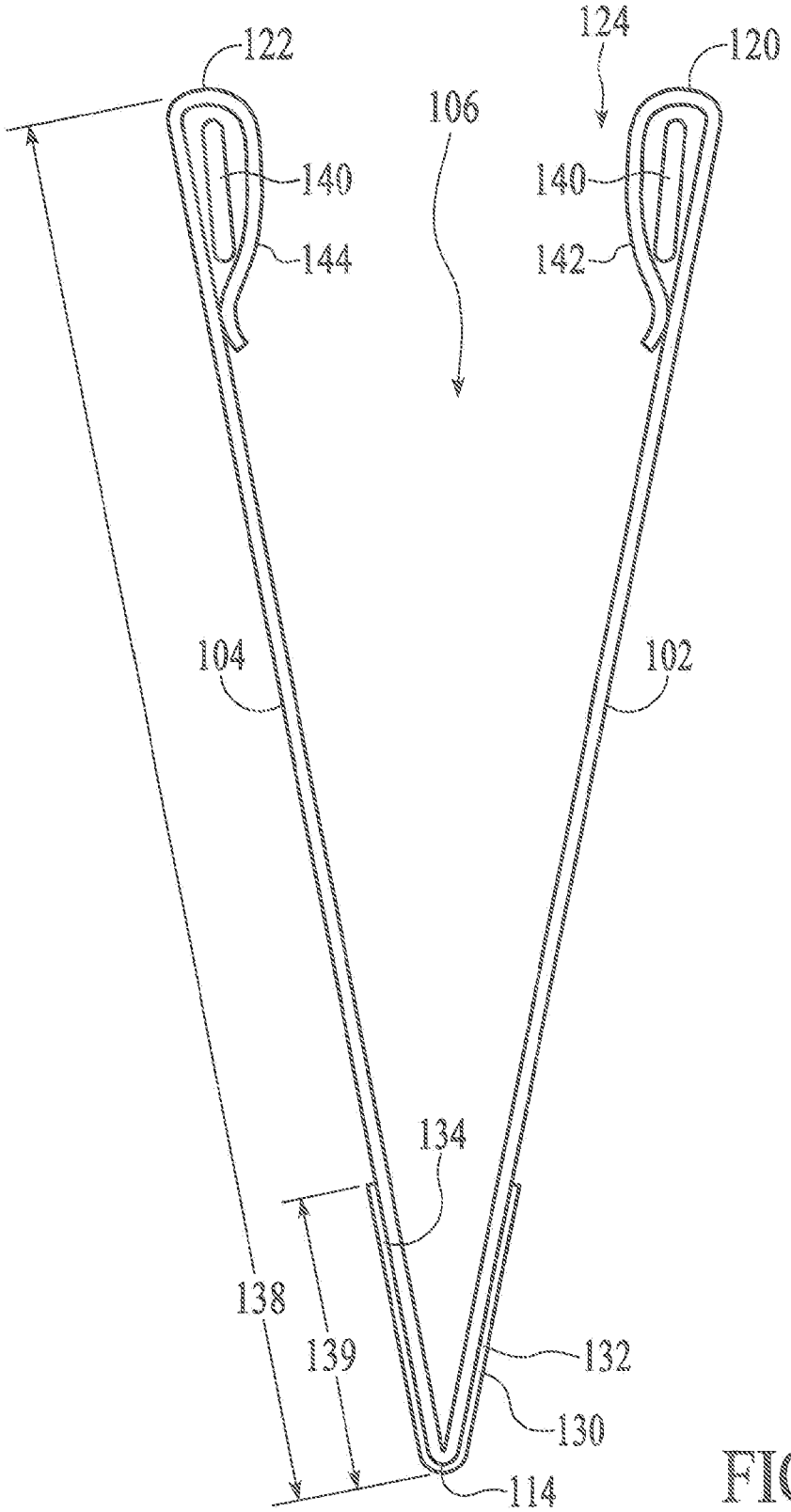
FIG. 2C is a cross-sectional view taken along line 2-2 of a bag similar to FIGS. 1A-1F depicting the reinforcing strip on the exterior of the the bag.

Referring to FIGS. 2A-2C, the reinforcing strip 130 thereby provides an extra layer of material in a region of the bag 100 that may be prone to failure because gravity directs the weight of the contents against the bottom edge 114. This region may be prone to failure because, when replacing liners in a trash receptacle, a user may grasp the bag 100 about its opening 124 and may drag the bag along the floor or ground causing wear to the bottom edge 114.

The reinforcing strips 130 may be made from any suitable, thermoplastic material including, for example, polyethylenes, such as, high molecular weight high density polyethylene, high density polyethylene, low density polyethylene, linear low density polyethylene, polypropylene, ethylene vinyl acetate, nylon, polyester, ethylene vinyl alcohol, ethylene methyl acrylate, or other materials and can be formed in combinations and in single or multiple layers. In various embodiments, the material of the reinforcing strip may have a higher strength and abrasion resistance than the material of the bag sidewalls 102, 104. Making the reinforcing strip of stronger and/or tougher material may help further protect the bag against rupture and/or puncture. In suitable examples, the reinforcing strip 130 may comprise the same materials as the sidewalls 102, 104, and may be of the same or different thickness.

For ease of assembly and manufacturing, the reinforcing strip 130 preferably visually contrasts with the bag sidewalls 102, 104. The contrast may also enable visual confirmation that the reinforcing strip 130 has been sufficiently bonded to the bag sidewalls 102, 104, since sufficient bonding may make the reinforcing strip visually apparent through the sidewall. The thermoplastic bag may comprise a first sidewall 102 made of flexible, translucent thermoplastic web material; a second sidewall 104 of flexible, translucent thermoplastic web material overlaid and joined to the first sidewall 102 to provide an interior volume, the first and second sidewalls 102, 104 joined along a first side edge, an opposite second side edge, and a closed bottom edge, the first and second sidewalls un-joined along their respective top edges to define an opening opposite the bottom edge for accessing the interior volume; wherein the bag includes a reinforcing opaque feature 130 disposed along the interior of the closed bottom edge. The reinforcing strip 130 may be formed as a separate, elongated rectangular strip of material that may be attached to the bottom edge. Referring to FIGS. 2A-2B, the rectangular reinforcing strip 130 may be folded in half along its length to form a first half portion 132 and a second half portion 134. The folded reinforcing strip 130 may be inserted into the interior volume 106, and the first half and second half portions 132, 134 may be attached to the respective first and second sidewalls 102, 104. Attachment of the reinforcing strip and sidewalls may be achieved by any suitable means including cold bonding, heat-sealing the materials together, or use of adhesive. Alternatively attachment of the reinforcing strip and sidewalls may be achieved by polymer surface modification techniques that may enhance electrostatic attraction (static pinning), increase hydrogen bonding through incorporation of oxidized chemical moieties (corona or flame treatment), or by incorporating a polymeric adhesion network where the degree of surface functionalization is determined by substrate selection and type and extent of photoinitiation (photografting). As shown in FIG. 2A, the reinforcing strip 130 is substantially aligned with the bag bottom edge 114. The reinforcing strip 130 may be bonded to the bag sidewalls 102, 104 along the entire height 139 of the reinforcing strip. Alternately, the reinforcing strip 130 may only be bonded along the top edge height 144. In an alternative embodiment as shown in FIG. 2B, the reinforcing strip 130 is raised a distance 149 above the bag bottom edge 114. In an alternative embodiment as shown in FIG. 2C, the reinforcing strip 130 is on the exterior of the bag sidewalls 102, 104.

Referring to FIG. 3A, the sidewall may have a thickness 150. The thickness 150 may have a first range of about 0.0005 inches (0.0013 cm) to about 0.0014 inches (0.0036 cm), a second range of about 0.0006 inches (0.0015 cm) to about 0.001 inches (0.0025 cm), and a third range of about 0.0007 inches (0.0018 cm) to about 0.00085 inches (0.0021 cm). In one embodiment, the thickness 150 may be about 0.0008 (0.0020 cm). The single layer reinforcing strip 130 may have a thickness 152. The thickness 152 may have a first range of about 0.0001 inches (0.00025 cm) to about 0.0006 inches (0.0015 cm), a second range of about 0.00025 (0.00064 cm) to about 0.0005 inches (0.0013 cm), and a third range of about 0.00035 inches (0.00089 cm) to about 0.00045 inches (0.0011 cm). In one embodiment, the thickness 152 may be 0.0004 inches (0.001 cm).

Referring to FIGS. 3B-3E, to facilitate attaching the reinforcing strip 130 to the sidewalls of the bag, in various embodiments the reinforcing strip and/or the sidewalls may be made as a multilayered structure. Referring to FIG. 3B, the strip 130 may include a first layer 156, a second layer 157 and a third layer 158. The first layer 156 and third layer 158 may include polyethylenes (such as, low density polyethylene, or very low density polyethylene), ethylene vinyl acetate and ethylene methyl acrylate, or other material. The second layer 157 may include polyethylenes, such as, high density polyethylene, linear low density polyethylene, high molecular weight high density polyethylene, low density polyethylene or other material. The sidewalls 102, 104 may include a first layer 160, a second layer 161, and a third layer 162. The first layer 160 and the third layer 162 may include polyethylenes (such as, low density polyethylene, or very low density polyethylene), ethylene vinyl acetate and ethylene methyl acrylate, or other material. The second layer 161 may include polyethylenes, such as, high density polyethylene, linear low density polyethylene, high molecular weight high density polyethylene, low density polyethylene or other material. The first layer 156 of the strip 130 may directly contact the first layer 160 of the sidewall. If the first layer 156 of the strip is the same as or compatible with the first layer 160 of the sidewall, then the first layer 156 may bond better with the first layer 160.

The thickness 164 of the multilayer sidewall 130 may be the same as thickness 150 of the single layer sidewall 102 as noted above. The thickness 166 of the multilayer strip 130 may be the same as the thickness 152 of the single layer reinforcing strip 130 as noted above. The thickness of the first and third layers 160, 162 may be a weight percentage of the thickness 164 of the sidewall. The combined weight percentage of the first and third layers 160, 162 may have a first range of about 1% to about 99%, a second range of about 15% to about 75%, and a third range of about 30% to about 50%. In one embodiment, the combined weight percentage of the first and third layers 160, 162 may be about 40%, so that the first layer 160 is about 20%, the second layer 161 is about 60% and the third layer 162 is about 20%. In other embodiments, the first layer and the third layer may have different weight percentage of thicknesses, such as, the first layer may be 30% and the third layer may be 10%. The thickness of the first and third layers 156, 158 may be a weight percentage of the thickness 166 of the strip. The combined weight percentage of the first and third layers 156, 158 may have a first range of about 1% to about 99%, a second range of about 15% to about 75%, and a third range of about 30% to about 50%. In one embodiment, the combined weight percentage of layers 156, 158 may be 40%, so that the first layer 156 is about 20%, the second layer 157 is about 60% and the third layer 158 is about 20%. In other embodiments, the first layer and the third layer may have different weight percentage of thicknesses, such as, the first layer may be 30% and the third layer may be 10%. Referring to FIG. 3C, the single layer sidewall may be combined with the multilayer strip. Referring to FIG. 3D, the multilayer sidewall may be combined with the single layer strip. In other embodiments, the sidewall and/or the strip may have two, four, five, six or more layers. Referring to FIG. 3E, the single layer sidewall 102 may be combined with the bilayer reinforcing strip 160 having a bonding layer 156 which is at least partially bonded to the sidewall 102 and a release layer 158.

Referring back to FIG. 2A, the first half portion 132 of the reinforcing strip 130 may extend adjacently along the first sidewall 102 from the closed bottom edge 114 only part way towards the opening 124 of the bag 100. The bag 100 may have a height 138 measured between the closed bottom edge 114 and opening 124. The first half portion 132 may have a height 139 measured from the closed bottom edge 114 toward the opening 124. The height 138 may have a first range of about 20 inches (50.8 cm) to about 48 inches (121.9 cm), a second range of about 23 inches (58.4 cm) to about 33 inches (83.8 cm), and a third range of about 26 inches (66 cm) to about 28 inches (71.1 cm). In one embodiment, the height 138 may be 27.375 inches (69.5 cm). The height 139 may have a first range of about 1 inches (2.54 cm) to about 10 inches (25.4 cm), a second range of about 3 inches (7.6 cm) to about 8 inches (20.3 cm), and a third range of about 4 inches (10.2 cm) to about 6 inches (15.2 cm). In one embodiment, the height 139 may be 5 inches (12.7 cm). As illustrated, the second half portion 134 may extend along the second sidewall 104 a similar distance. As will be appreciated, because the reinforcing strip only extends over a portion of the sidewalls, the reinforcing strip comprises significantly less material than the sidewalls. Thus, the reinforcing strip saves material by using the reinforcing strip in the desired area. In addition, this may be beneficial when the reinforcing strip may be made from higher strength, more expensive materials by focusing a minimal amount of these materials at the location of optimal utilization.

In one embodiment of FIG. 3A, a single layer of reinforcing strip 130 may be used and may comprise high density polyethylene HDPE, low density polyethylene LDPE, or linear low density polyethylene LLDPE, with or without anti-blocking agents.

It may be preferable to have a two-sided reinforcing strip comprising a film with bonding qualities on one side and release qualities on the opposite side, where the strip is designed to easily adhere to trash bag sidewall upon bonding, yet when folded on itself inside the bag the strip can be separated (as would be expected when opening the bag) without becoming detached from bag sidewall. Furthermore, wound rolls of the two-sided reinforcing strip film should tolerate storage without becoming overly blocked such that they are difficult to unwind. In one embodiment of FIG. 3B, the inner layer 156 adjacent to the sidewall 102 comprises a bonding composition that differs from the release composition of the outer layer 158 facing away from the sidewall 102. The bonding inner layer 156 may have a lower density than the density of the release outer layer 158. In one embodiment having three layers, the bonding composition of the inner layer 156 is ULDPE, ultra-low density polyethylene, or VLDPE, very low density polyethylene, and the release composition of the outer layer 158 is MDPE, medium density polyethylene, or HDPE, high density polyethylene. The composition of the middle layer 157 is LLDPE, linear low density polyethylene. In one embodiment having two layers shown in FIG. 3E, the bonding composition of the inner layer 156 is ULDPE, ultra-low density polyethylene, or VLDPE, very low density polyethylene, and the release composition of the outer layer 158 is LLDPE, linear low density polyethylene, MDPE, medium density polyethylene, or HDPE, high density polyethylene.

In one embodiment, the inner bonding layer 156 has a Vicat softening temperature lower than the outer release layer 158, using ASTM D1525 to measure the Vicat softening temperature. Examples of suitable resins include Dow™ LDPE 5011 has a density of 0.922 g/cm$^3$ and a Vicat softening temperature of 92.2° C., Dow™ LDPE 135A has a density of 0.923 g/cm$^3$ and a Vicat softening temperature of 95.6° C., Dow™ LDPE 1321 has a density of 0.921 g/cm$^3$ and a Vicat softening temperature of 96.1° C., Dow™ LDPE 50041 has a density of 0.924 g/cm$^3$ and a Vicat softening temperature of 95.0° C., Dow™ LDPE 5351 has a density of 0.925 g/cm$^3$ and a Vicat softening temperature of 97.8° C., Dow™ LLDPE DFDA 7047 NT7 has a density of 0.918 g/cm$^3$ and a Vicat softening temperature of 101° C., Dow™ LLDPE DFDA 7340 NT7 has a density of 0.920 g/cm$^3$ and a Vicat softening temperature of 98.9° C., Dow™ LLDPE DFDA 7509 NT7 has a density of 0.924 g/cm$^3$ and a Vicat softening temperature of 104° C., Dow™ LLDPE DFDA 1081 NT7 has a density of 0.931 g/cm$^3$ and a Vicat softening temperature of 97.2° C., Dow™ ULDPE ATTANE™ 4201G has a density of 0.912 g/cm$^3$ and a Vicat softening temperature of 92.8° C., Dow™ VLDPE FLEXOMER™ DFDA-1137 NT7 has a density of 0.905 g/cm$^3$ and a Vicat softening temperature of 86.1° C., Dow™ VLDPE FLEXOMER™ DFDA-9078 NT7 has a density of 0.910 g/cm$^3$ and a Vicat softening temperature of 90.0° C., Dow™ LLDPE TUFLIN™ HS-7021 NT7 has a density of 0.919 g/cm$^3$ and a Vicat softening temperature of 100° C., Dow™ LLDPE TUFLIN™ HSE-7002 NT7 has a density of 0.918 g/cm$^3$ and a Vicat softening temperature of 98.9° C., Dow™ LLDPE TUFLIN™ HS-7066 NT7 has a density of 0.926 g/cm$^3$ and a Vicat softening temperature of 113° C., Dow™ HDPE DGDP-6097 NT7 has a density of 0.948 g/cm$^3$ and a Vicat softening temperature of 124° C., Dow™ HDPE DGDA-5004 NT7 has a density of 0.961 g/cm$^3$ and a Vicat softening temperature of 131° C., Dow™ Enhanced PE ELITE™ 5500G has a density of 0.914 g/cm$^3$ and a Vicat softening temperature of 124° C., Dow™ Enhanced PE ELITE™ 5110G has a density of 0.926 g/cm$^3$ and a Vicat softening temperature of 111° C., and Dow™ MDPE FINGERPRINT™ DFDC-7525 NT has a density of 0.926 g/cm$^3$ and a Vicat softening temperature of 116° C. Suitable additives or polymer mixtures may also the Vicat softing temperature and/or the density.

In another embodiment of FIG. 3B, the bonding inner layer 156 may have an anti-block agent and the release outer layer 158 may have substantially no anti-block agent. The anti-block agent may be a particulate anti-block agent. One advantage of a particulate anti-block agent may be that it will not migrate between layers. The anti-block agent may comprise mineral-based anti-block agent and/or synthetic-based anti-block agent. Mineral-based anti-block agents include both silica-based agents (e.g., diatomaceous earth, quartz, and silica sand), as well as others such as kaolin, talc, feldspar, and calcium carbonate. Synthetic-based anti-block agents include synthetic silica anti-block agents, for example gel-type synthetic silica, and precipitated-type synthetic silica.

Suitably, the anti-block agent comprises at least one member selected from the group consisting of silica, silicate, and glass, and suitably the anti-block agent is in the form of approximately spherical particles. However, particles of irregular shape, and angular particles, can be used. Suitably, the anti-block agent comprises at least one member selected from the group consisting of aluminum silicate (clay), silica (silicon dioxide), sodium calcium alumino silicate, magnesium silicate (talc), and calcium silicate; more preferably, at least one member selected from the group consisting of aluminum silicate, silica, sodium calcium alumino silicate, and magnesium silicate; still more preferably, at least one member selected from the group consisting of aluminum silicate, silica, and sodium calcium alumino silicate; yet still more preferably, at least one member selected from the group consisting of aluminum silicate and silica; and yet still more preferably, aluminum silicate. Silicas with average particle sizes of about 2 microns or less can be utilized for this purpose, and only small amounts (for example, 1000 to 5000 ppm) of the fine silica are needed. One example of a particulate anti-block agent is talc.

The anti-block agent can comprise an organic material such as crosslinked or uncrosslinked organic materials. Examples include polyester, EVOH (ethylene/vinyl alcohol copolymer), nylon 6, nylon 6,6, syndiotactic polystyrene, engineering resins, liquid crystalline polymers, and aromatic nylons. Selecting the appropriate anti-block agent depends at least in part on the nature of the layer in which the anti-block agent is present. The Vicat softening point of the organic anti-block agent should be sufficiently higher than that of the host polymer.

In accordance with the present invention, anti-block agents have an average particle size (diameter) of from about 0.1 to 10 microns, such as 1 to 8 microns, and 2 to 6 micrometer, and are preferably present at a level of from 0.1 to 6 weight percent, such as 0.2 to 4 wt. %, and 0.3 to 3 wt. %, based on the weight of the reinforcing strip layer.

Other suitable anti-block agents are organic anti-block agents. Suitable organic anti-block agents include organosiloxanes, such as silicone oil, which can be included in the release layer. Other suitable organic anti-block agents are fatty amides, such as primary fatty amide, secondary fatty amide, tertiary fatty amide, fatty alkanolamide, and fatty bisamide. More specifically, the fatty amide preferably comprises at least one member selected from the group consisting of erucamide, stearamide, oleamide, behenamide, and ethylene bisstearamide.

Figure 4:
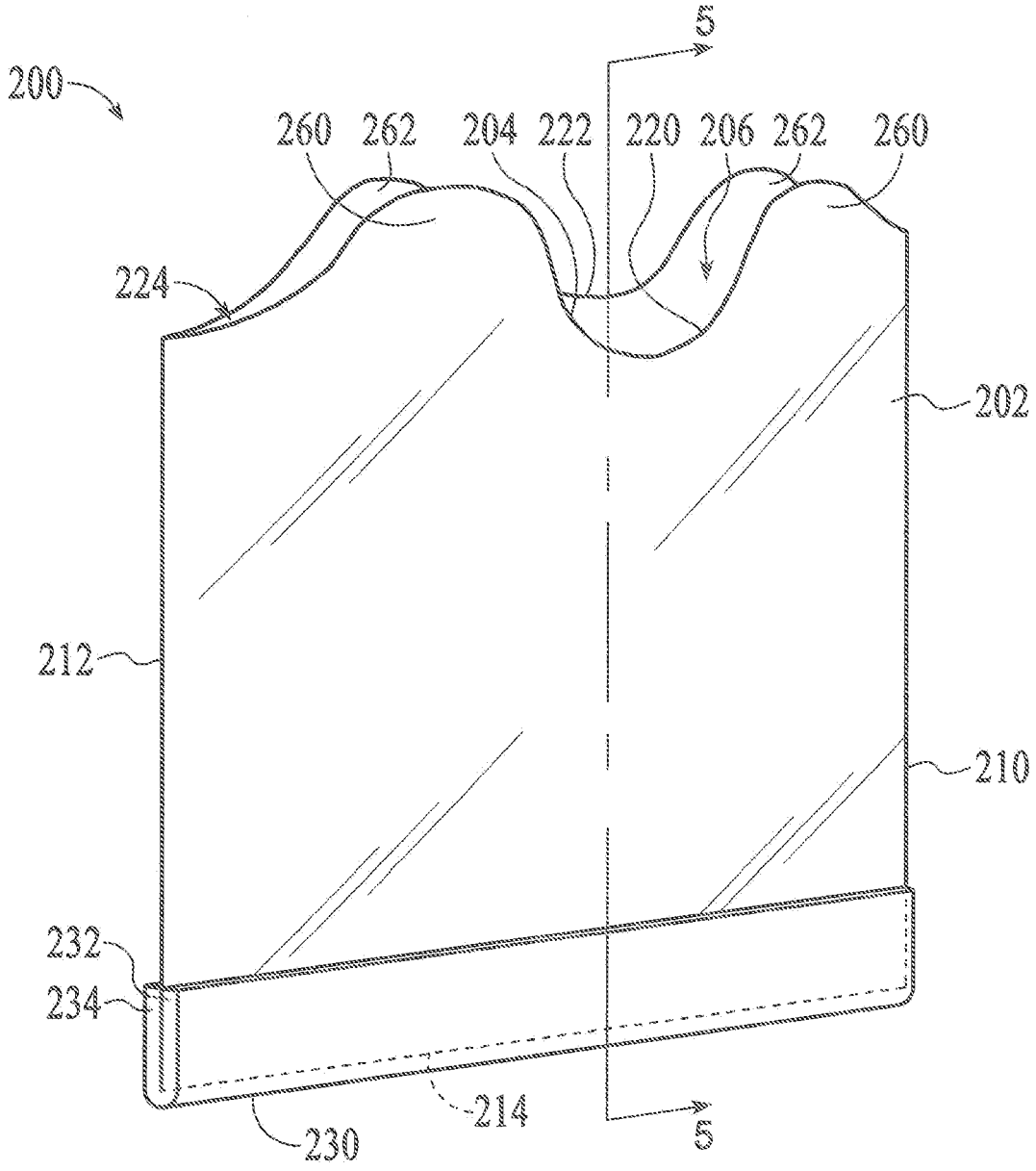
FIG. 4 is a perspective view of another embodiment of the thermoplastic bag including a reinforcing strip folded about the exterior bottom edge of the bag.
Figure 5A:
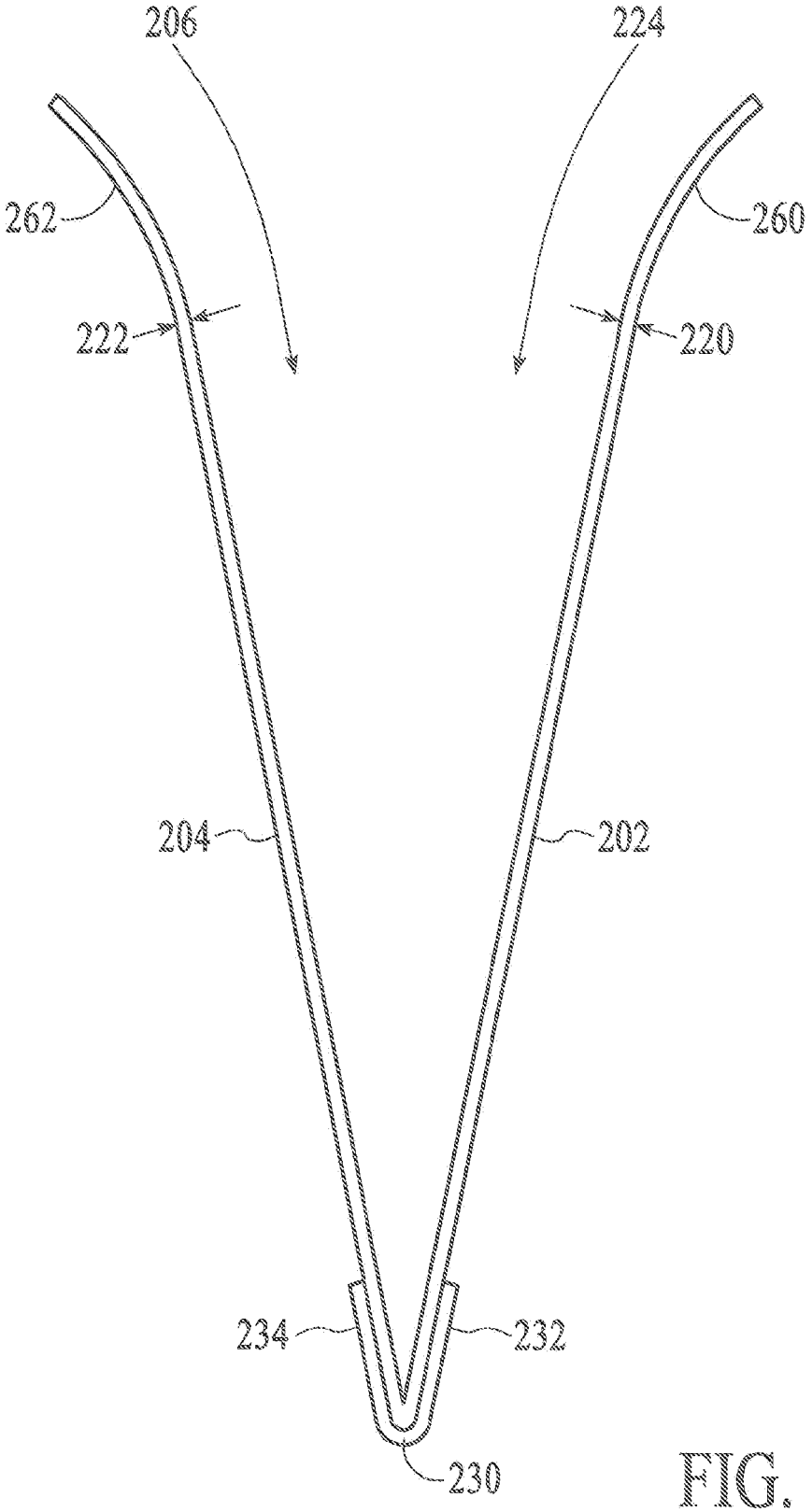
FIG. 5A is a cross-sectional view taken along line 5-5 of FIG. 4 depicting the reinforcing strip folded about the exterior bottom edge of the bag.
Figure 5B:
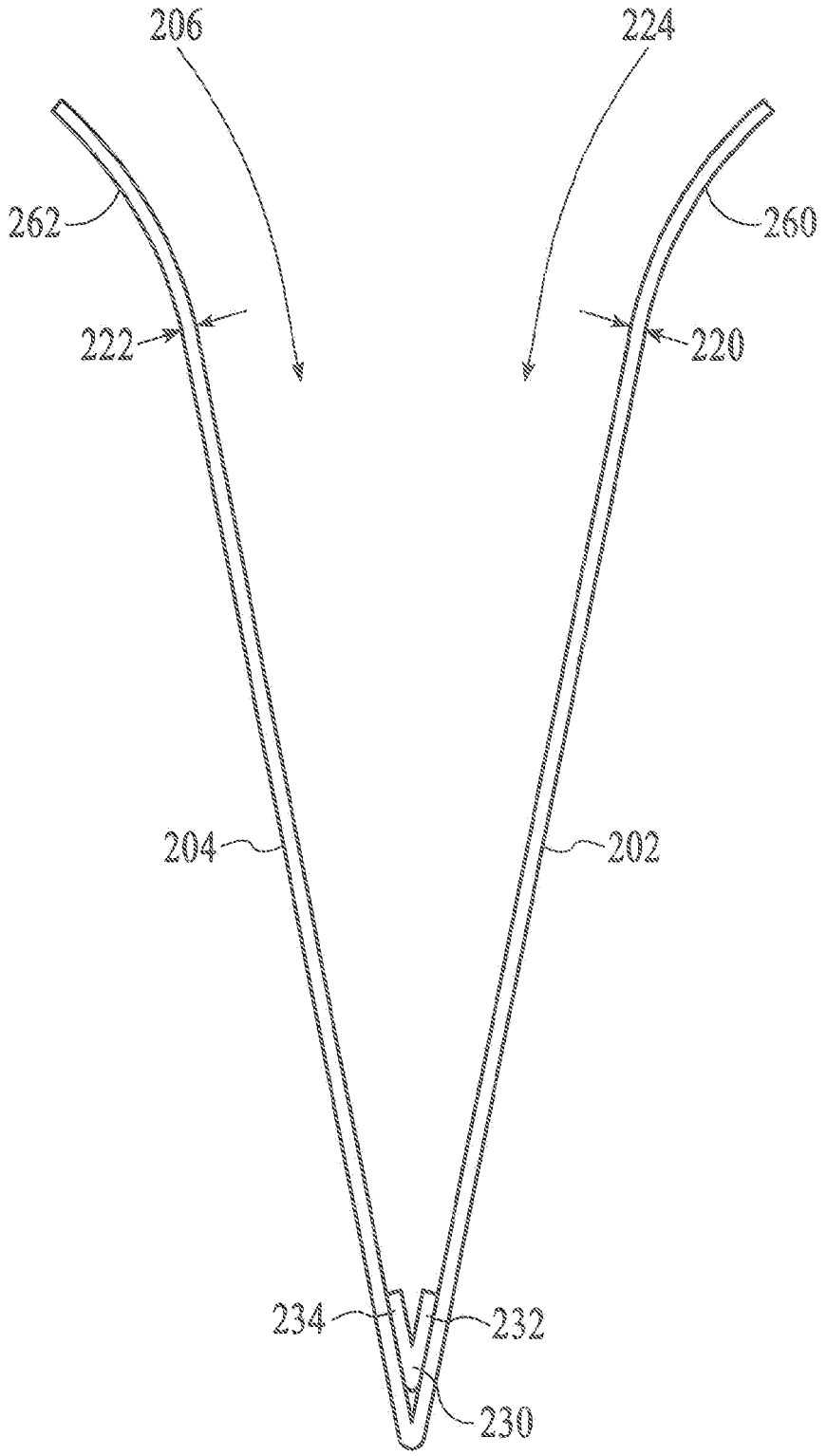
FIG. 5B is a cross-sectional view taken along line 5-5 of a bag similar to FIG. 4 depicting the reinforcing strip folded on the interior bottom edge of the bag.

Referring now to FIGS. 4, 5A and 5B, there is illustrated another embodiment of the thermoplastic bag 200 including a reinforcing strip 230. The bag 200 may include a first sidewall 202 overlaid and joined to a second sidewall 204 to provide an interior volume 206. The first and second sidewalls 202, 204 may be joined along a first side edge 210, a spaced apart second side edge 212, and a closed bottom edge 214 extending between the first and second side edges. To access the interior volume 206, the top edges 220, 222 of the respective first and second sidewalls remain un-joined to provide an opening 224.

To reinforce the bottom edge 214 against rupture and puncture, a reinforcing strip 230 may be attached to bag 200. In the illustrated embodiment, the reinforcing strip 230 may be attached to the exterior of the bag 200 and may extend along the bottom edge 214 from the first side edge 210 to the second side edge 212. The reinforcing strip 230 may be made as an elongated rectangular strip that may be folded in half along its length about the bottom edge 214 such that a first half portion 232 may extend adjacent the exterior surface of the first sidewall 202 and a second half portion 234 may extend adjacent the exterior surface of the second sidewall 204. The reinforcing strip 230 may be substantially aligned with the bag bottom edge 214. The reinforcing strip 230 may be bonded to the bag sidewalls 202, 204 along the entire height 239 of the reinforcing strip. Alternately, the reinforcing strip 230 may only be bonded along the top edge height 244. In an alternative embodiment as shown in FIG. 2C, the reinforcing strip 230 is lowered below the bag bottom edge 214.

Accordingly, in the present embodiment in FIGS. 4 and 2C, the reinforcing strip 230 may be located on the exterior of the bag in contrast to the embodiment illustrated in FIGS. 1A-1F and 2A-2B wherein the reinforcing strip 130 may be located on the interior of the bag. The reinforcing strip 230 provides an additional layer of material along the bottom edge 214. Additionally, the first half portion 232 and second half portion 234 may extend only partially toward the open top 224 so that the additional material is strategically placed in an area prone to failure. The reinforcing strip may have the dimensional ranges noted herein. In various embodiments, the reinforcing strip 230 may be made of a material having higher strength and abrasion characteristics than the material of the sidewalls 202, 204 as noted herein. Additionally, the reinforcing strip may be made of single or multiple layers as noted herein.

In addition to the reinforcing strip, the bag may include other features that facilitate its use as a liner for trash receptacles. For example, referring back to FIGS. 1A-1F and 2A-2C, to close the opening 124 of the bag 100 when, for example, disposing of the trash receptacle liner, the bag may be fitted with a draw tape 140. To accommodate the draw tape 140, referring to FIGS. 2A-2C, the first top edge 120 of the first sidewall 102 may be folded back into the interior volume 106 and may be attached to the interior surface of the sidewall to form a first hem 142. Similarly, the second top edge 122 of the second sidewall 104 may be similarly folded back into the interior volume and may be attached to the second sidewall to form a second hem 144. The draw tape 140, which may be fixedly attached at the first and second side edges 110, 112, extends along the first and second top edge 120, 122 loosely through the first and second hems 142, 144. To access the draw tape 140, first and second notches 146, 148 may be disposed through the respective first and second top edges 120, 122. Pulling the draw tape 140 through the notches 146, 148 will constrict the top edge 120, 122 thereby closing the opening 124. The draw tape closure may be used with any of the embodiments herein, as appropriate.

Referring back to the embodiment illustrated in FIGS. 4, 5A and 5B, different closing mechanisms such as tie flaps 260, 262 may be employed to close the opening 224 of the bag. The tie flaps 260, 262 may be extensions of the top edges 220, 222 of the respective sidewalls 202, 204 that may be tied together when the bag 200 is removed from the receptacle and disposed of. The tie flap closure may be used with any of the embodiments herein, as appropriate. In addition to tie flaps and draw-tapes, other suitable closing mechanisms may include twist ties and mechanical clips. Furthermore, for securing the bag to a garbage container, an elastic strip may be attached about the opening of the bag which may be folded over so as to constrict about the rim of the container. In those embodiments where the bag is intended for use in applications besides garbage can liners, other suitable closure mechanisms may include interlocking fastening strips, low-tack or peelable adhesive, or various fold-top arrangements.

The reinforcing strip 130 may be merely inserted into the bottom of the bag, however, the reinforcing strip 130 may have more effective properties if it is bonded to the sidewalls 102, 104 of the bag 100. Traditional methods of bonding layers include adhesive bonding and heat bonding. When multiple layers are heated together, they may not be efficiently laminated because the layers may have different thermal properties on heating and subsequent cooling. Heated embossing may also not efficiently bond different layers. For this reason, a combination of heat bonding or heat sealing and adhesive bonding have been used. Although the reinforcing feature may be attached by adhesively bonding or heat bonding, it may be more economical and less messy to attach the reinforcing feature by cold bonding.

Cold bonding can include cold ring-rolling, cold embossing, and cold forming strainable networks, using processes described in U.S. Patent App. 2010/0266222 which is herein incorporated by reference in its entirety.

Figure 1B:
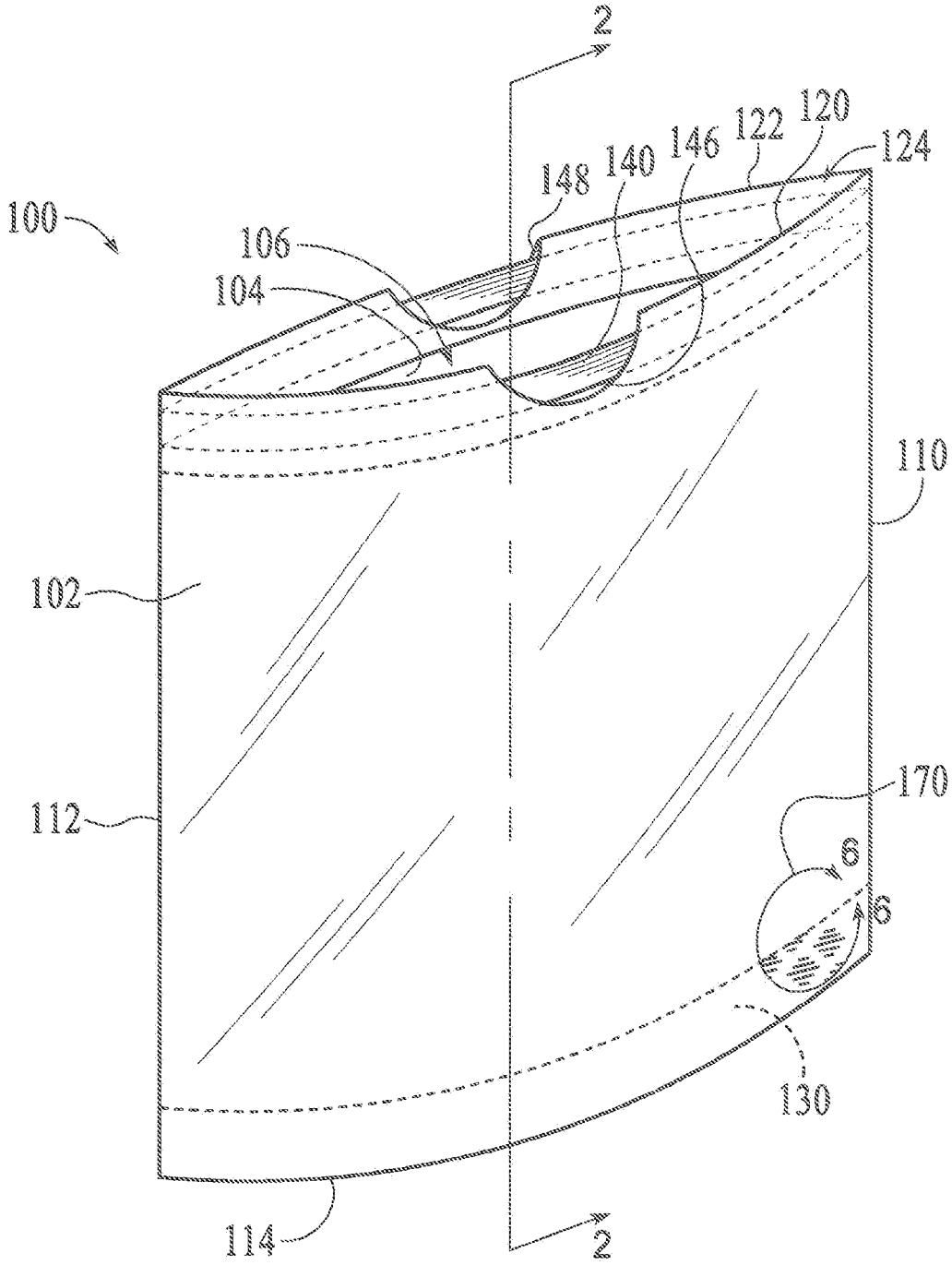
FIG. 1B is a perspective view of a thermoplastic bag including a reinforcing strip inserted into the bag proximate the bottom edge of the bag.
Figure 1C:
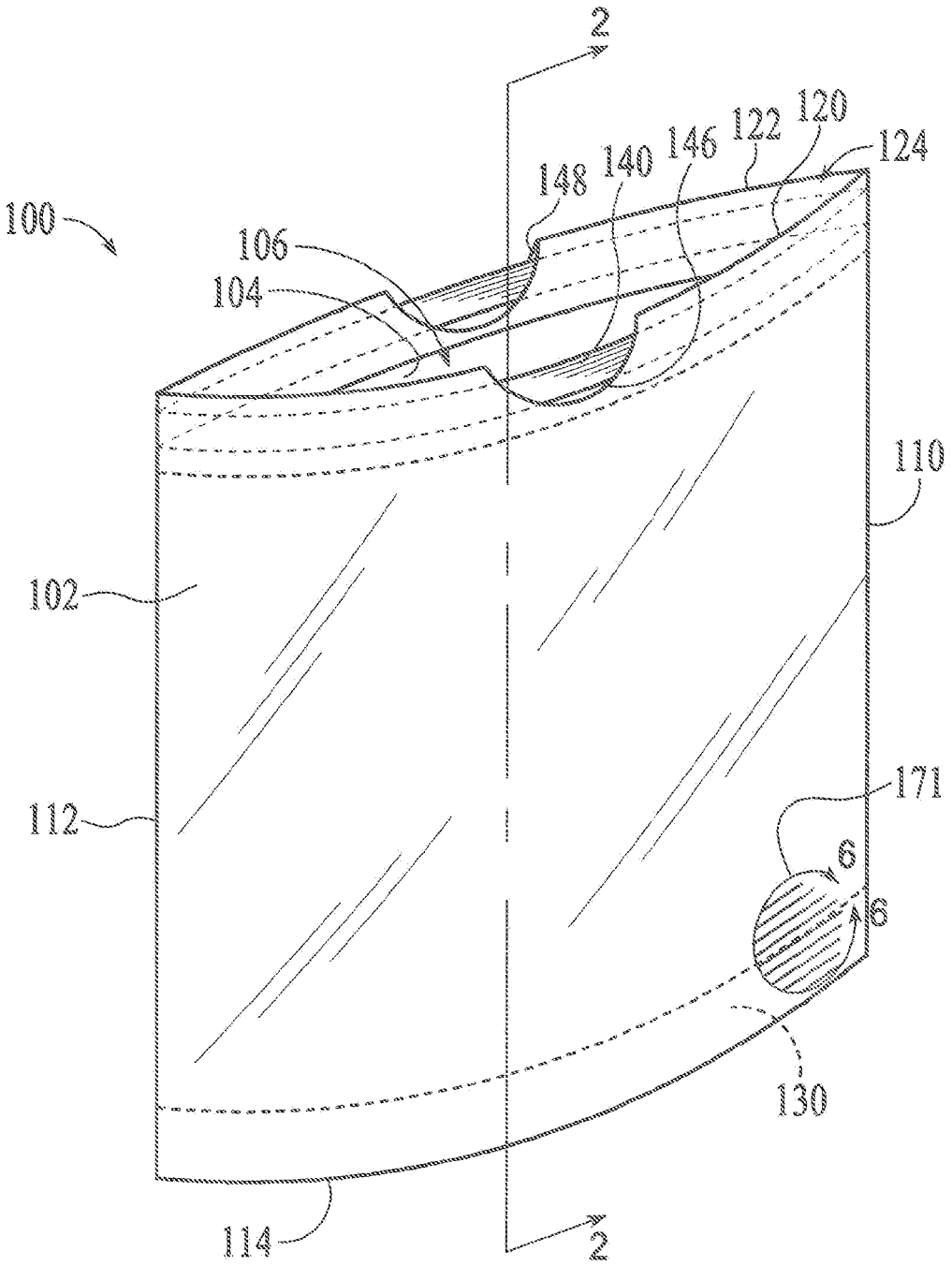
FIG. 1C is a perspective view of a thermoplastic bag including a reinforcing strip inserted into the bag proximate the bottom edge of the bag.
Figure 1D:
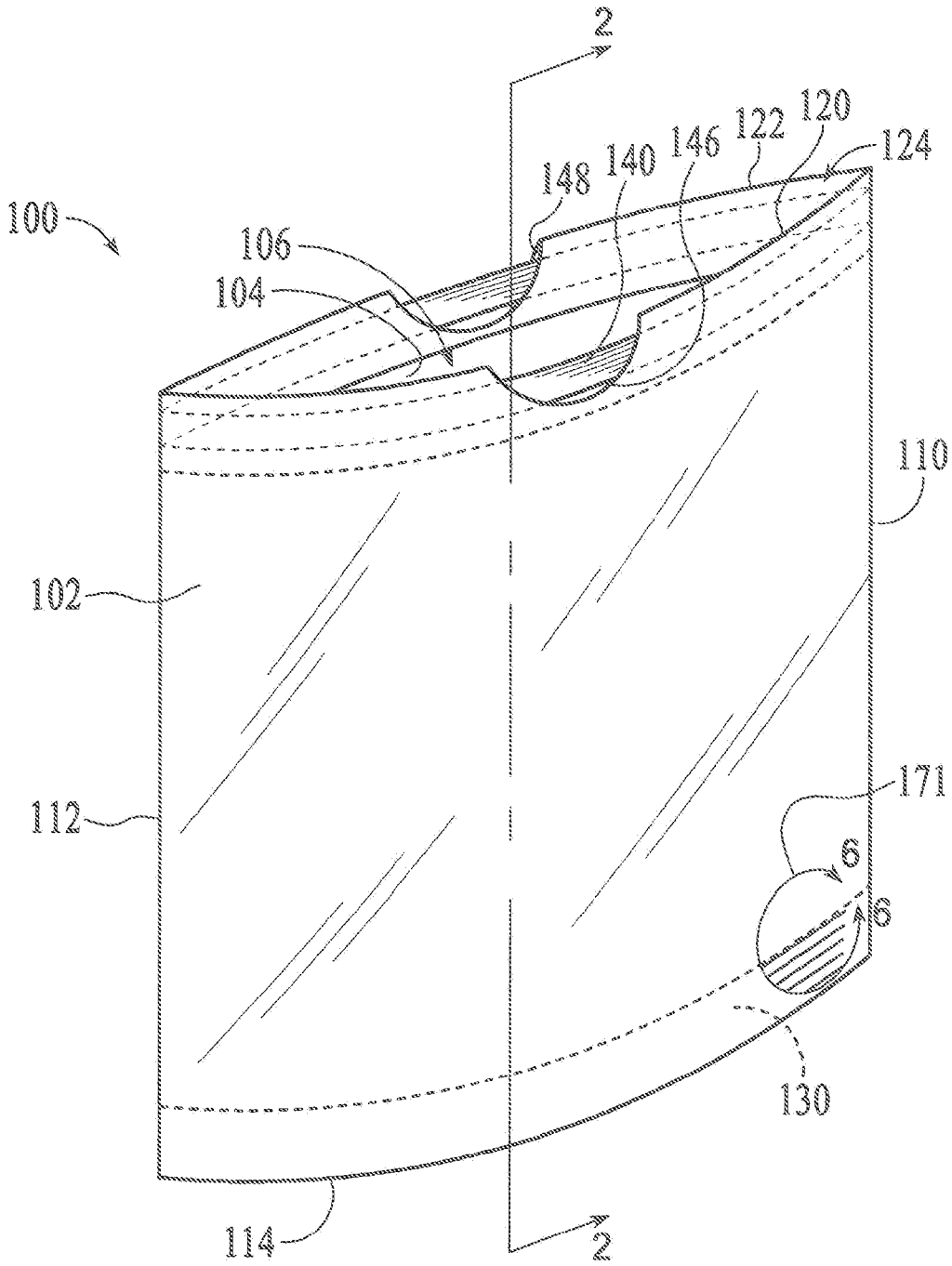
FIG. 1D is a perspective view of a thermoplastic bag including a reinforcing strip inserted into the bag proximate the bottom edge of the bag.
Figure 1E:
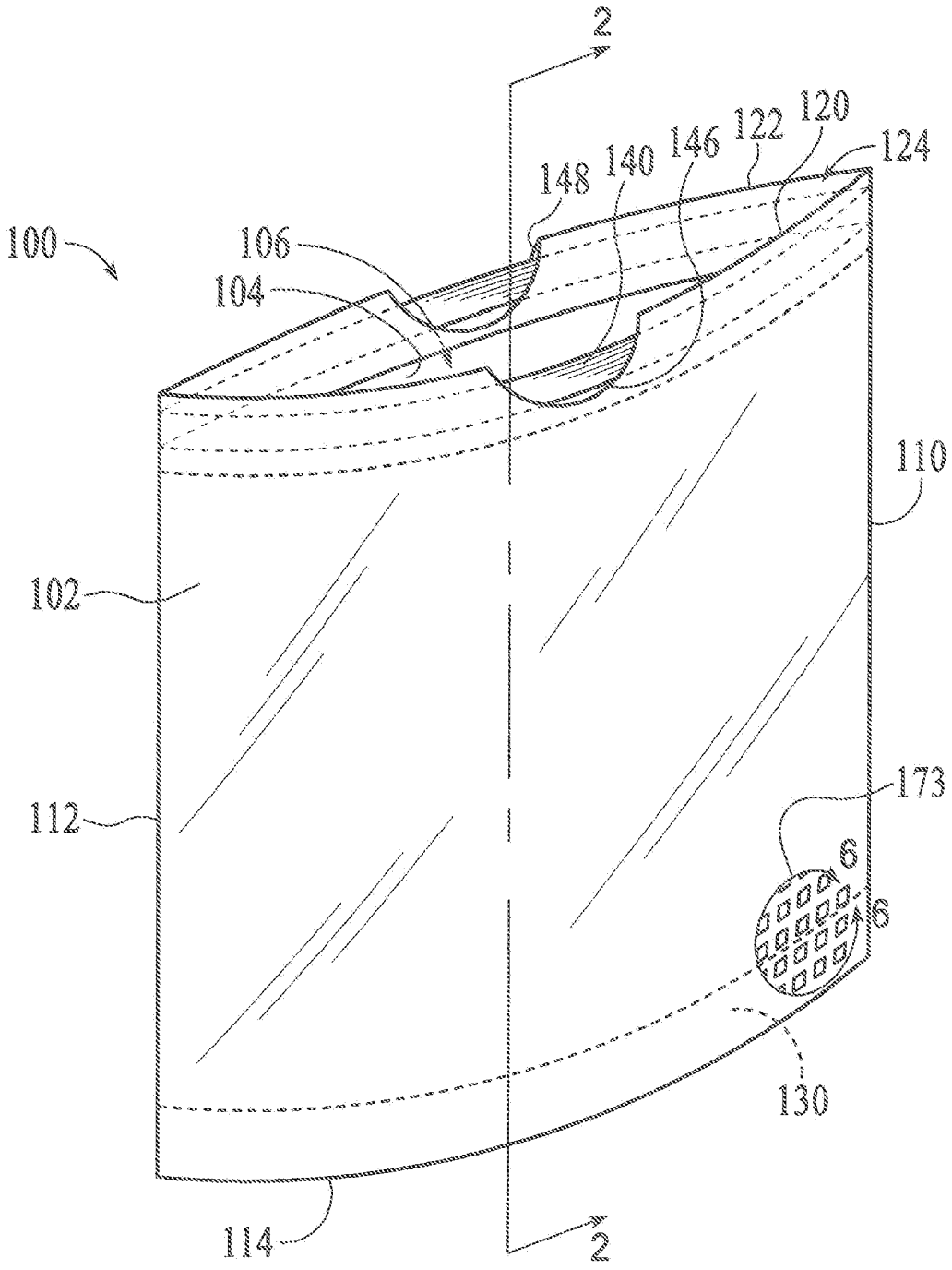
FIG. 1E is a perspective view of a thermoplastic bag including a reinforcing strip inserted into the bag proximate the bottom edge of the bag.
Figure 1F:
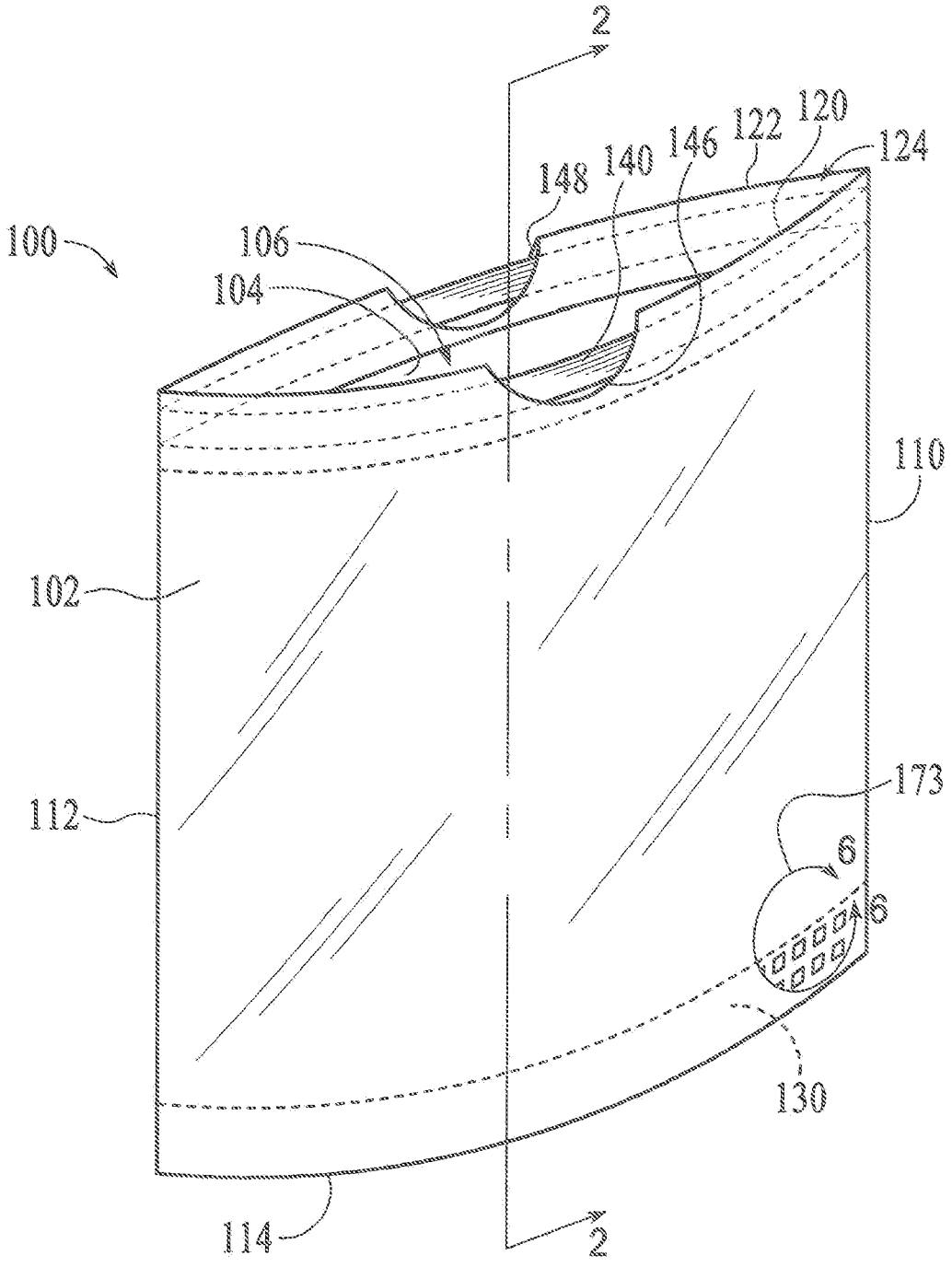
FIG. 1F is a perspective view of a thermoplastic bag including a reinforcing strip inserted into the bag proximate the bottom edge of the bag.

Cold forming strainable networks are illustrated in FIG. 1A where the strainable network pattern 170 covers both the area of the sidewall 102 above the reinforcing strip 130 and the area adjacent to the reinforcing strip 130, and in FIG. 1B where the strainable network pattern 170 covers only the area of the sidewall 102 adjacent to the reinforcing strip 130. Cold forming ring rolling patterns are illustrated in FIG. 1C where the ring rolling pattern 171 covers both the area of the sidewall 102 above the reinforcing strip 130 and the area adjacent to the reinforcing strip 130, and in FIG. 1D where the ring rolling pattern 171 covers only the area of the sidewall 102 adjacent to the reinforcing strip 130. Cold forming embossing patterns are illustrated in FIG. 1E where the embossed pattern 173 covers both the area of the sidewall 102 above the reinforcing strip 130 and the area adjacent to the reinforcing strip 130, and in FIG. 1F where the embossed pattern 173 covers only the area of the sidewall 102 adjacent to the reinforcing strip 130. A modified combined ring rolling/SELFing pattern alternates a strainable network (SELFing) pattern with a ring rolling pattern. Examples are shown in FIGS. 30A, 30B, 31A, 31B. In one example the modified combined ring rolling/SELFing pattern contains "stripes" of ring rolling and "stripes" of SELFing running parallel to the machine direction of the bag. One modified combined ring rolling/SELFing pattern has 4 rows of teeth SELFing or ring rolling in each "stripe".

Cold ring-rolling involves MD or TD stretching between intermeshing rollers. As the film is cold ring-rolled, the film forms both stretched and unstretched areas, where the stretched areas are thinned and oriented in the direction of stretching while the unstretched areas are not oriented or stretched to form a ring-rolling pattern. In this manner, the extra step of heat bonding or adhesively bonding can be avoided. Rather than forming strong bonding normally achieved by heat bonding or adhesive bonding, cold bonding processes such as cold ring rolling may form relatively weak bonding between the bag sidewalls and the reinforcing strip. This relatively weak bonding may be sufficient to allow the reinforcing strip to open when the bag is opened because this weak bonding is greater than any adhesion between the release side of the reinforcing strip. This relatively weak bonding may also allow the reinforcing strip to act as a shock absorber by debonding from the bag sidewalls as articles, such as trash, are added to the bag. This debonding may allow the reinforcing strip to move downward, if the reinforcing strip is bonded slightly above the bottom of the bag. This debonding may also allow the reinforcing strip to separate in areas away for the added article and thus absorb some of the energy. In this respect, the partial bonding achieved by cold bonding processes may have superior reinforcement properties compared to a similarly thick single layer.

Cold embossing may act the same way by creating areas of weak bonding surrounded by non-bonded areas. This relatively weak bonding may be sufficient to allow the reinforcing strip to open when the bag is opened because this weak bonding is great than any adhesion between the release side of the reinforcing strip. This relatively weak bonding may also allow the reinforcing strip to act as a shock absorber by debonding from the bag sidewalls as articles, such as trash, are added to the bag. This debonding may allow the reinforcing strip to move downward, if the reinforcing strip is bonded slightly above the bottom of the bag. This debonding may also allow the reinforcing strip to separate in areas away for the added article and thus absorb some of the energy.

In further embodiments, the thermoplastic sidewalls of the bag may be configured to stretch or yield to accommodate cumbersome or bulky objects and/or to provide further puncture or rupture resistance. For example, referring back to FIGS. 1A and 1B, the thermoplastic sheet material making up the sidewalls 102, 104 may be formed with a plurality of strainable network patterns 170 that allow the sidewalls to stretch or yield. These patterns 170 can be cold forming strainable networks. Examples of such patterns and similar features are disclosed in U.S. Pat. No. 6,139,185; U.S. Publication No. 2004/0134923; U.S. Pat. No. 6,394,651; U.S. Pat. No. 6,394,652; U.S. Pat. No. 6,150,647; U.S. Pat. No. 6,513,975; or U.S. Pat. No. 6,695,476, each of which are herein incorporated by reference in their entirety.

Figure 6:
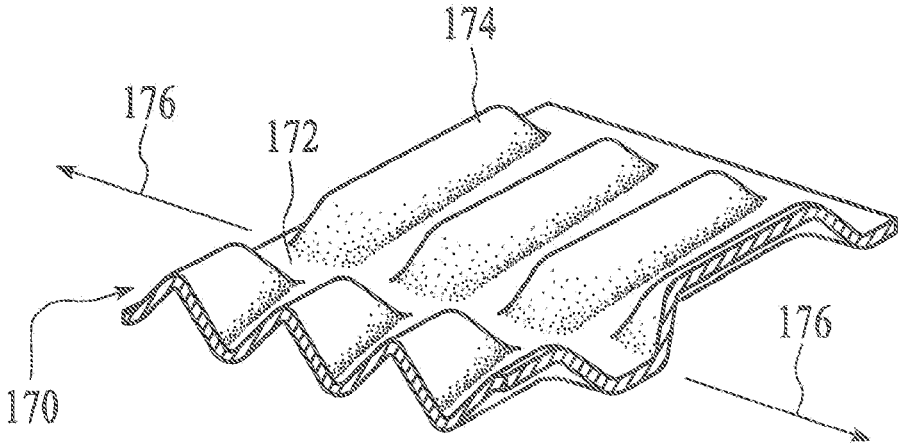
FIG. 6 is a perspective view of the area indicated in FIG. 1 by circle 6-6, illustrating one type of thermoplastic material suitable for the bag and having a stretchable or yieldable characteristic, the material being in the un-stretched condition.
Figure 7:
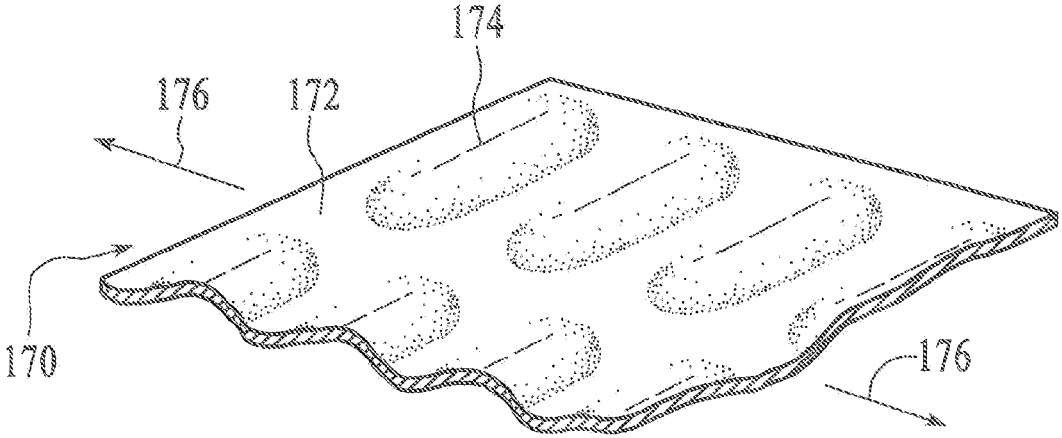
FIG. 7 is a perspective view similar to that of FIG. 6 illustrating the thermoplastic material in a partially-stretched condition.

Referring to FIGS. 6 and 7, each pattern 170 may form a "strainable network" that may include a plurality of first regions 172 and a plurality of second regions 174. The second regions 174 may be formed as rib-like elements in the material of the sidewall such that first regions and second regions appear bunched or contracted together in the un-tensioned state illustrated in FIG. 6. When a pulling force is applied, as indicted by the arrows 176 in FIG. 7, the second regions 174 are able to unbend or geometrically deform so that the first and second regions 172, 174 may become substantially coplanar with each other. As will be appreciated, this action stretches or elongates the pattern thereby adding to the overall area of the sidewall. In addition to accommodating bulky objects, the strainable networks provide shock dampening when objects are suddenly thrust or dropped into the bag.

The cold forming strainable network patterns can be formed with two or more layers combining both the bag sidewalls 102, 104 and the reinforcing strip 130. In this manner, the extra step of heat bonding or adhesively bonding can be avoided.

Figure 8:
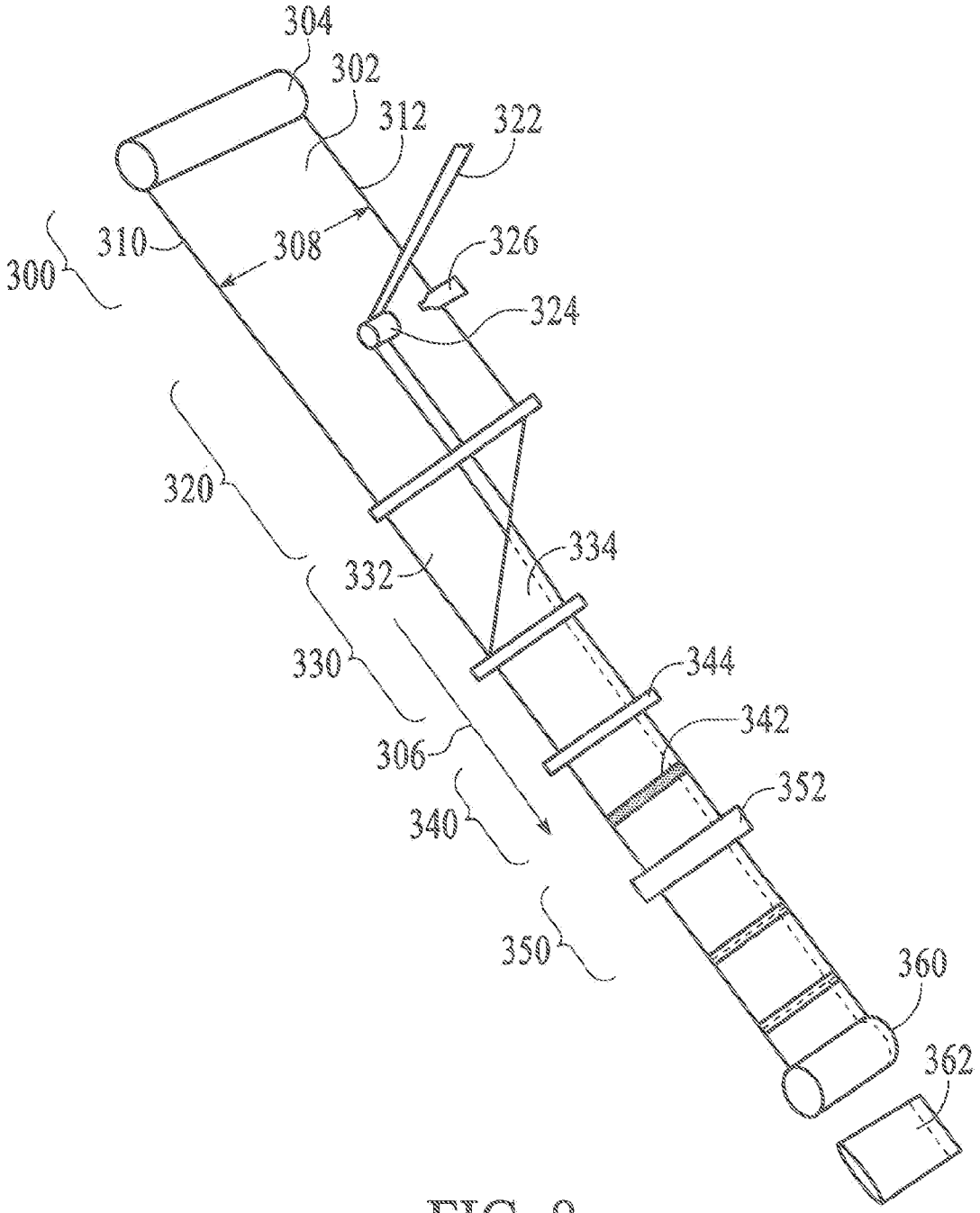
FIG. 8 is a schematic view of a thermoplastic bag processing environment for the production of bags having reinforcing strips wherein the reinforcing strip is attached to a web prior to folding the web.

Manufacturing of a bag with a reinforcing feature may be accomplished in a number of different ways. To minimize the incremental costs of the bags, manufacturing may be accomplished in a high-speed automated process. For example, referring to FIG. 8, there is illustrated a schematic of an embodiment for high-speed automated manufacturing of bags in which the reinforcing strip is provided internally of the bag; i.e. in the interior volume. In the illustrated embodiment, production may begin at a first step 300 by unwinding a web 302 of thermoplastic sheet material from a roll 304 and advancing the web along a machine direction 306. The unwound web 302 may have a rectangular profile including a width 308 that is perpendicular to the machine direction 306 as measured between a first edge 310 and an opposite second edge 312. In other manufacturing environments, the web 302 may initially be provided in other forms or even extruded directly from a thermoplastic production process.

In a subsequent attachment step 320, a continuous strip 322 of thermoplastic material intended to become the reinforcing strip may be advanced toward the web 302 and may be redirected to proceed in parallel and in step with the advancing web along the machine direction 306. The thermoplastic strip 322 may initially be provided from a roll, like the web, or may be directly extruded. During redirection, the strip 322 may be oriented about mid-width of the web 302 between the first and second edges 310, 312 by a roller 324.

To facilitate attaching the strip 322 to the web 302, the roller 324 may be heated. Heating of the thermoplastic material of the strip 322 may transition the strip material to a phase or physical state in which it may more readily bond with the thermoplastic material of the web 302. Besides or in addition to using a heated roller 324, hot air 326 may be directed onto the web and/or strip. Additionally, in some embodiments in which the strip 322 is extruded just prior to attachment to the web, the strip material may remain at a sufficiently elevated temperature to readily bond to the web.

In a subsequent folding step 330, the web 302 may be folded about its width 308 and inline with the machine direction 306 to provide adjacent first and second folded halves 332, 334. The folding step 330 may cause the second edge 312 to move adjacent to the first edge 310 such that the two edges correspond to the opened top edge of the finished bag. The mid-width portion of the web 302 with the strip 322 attached thereto may correspond to the reinforced bottom edge portion of the finished bag which may move in parallel with the machine direction 306. Additionally, the folded-over halves 332, 334 of the web 302 correspond to the first and second sidewalls of the finished bag.

Additional processing steps may be applied to produce the finished bag. For example, in an edging step 340, heat seals 342 may be formed across the width of the folded web 302 perpendicular to the machine direction 306 by a heat sealing device 344. In a perforating step 350, the heat seals 342 may be perforated by, for example, a perforating knife 352. The folded, sealed, and perforated web may then wound into a roll 360 for distribution. As can be appreciated, finished bags 362 can be unwound and detached from the roll 360 for use trash receptacle liners. In another embodiment, the web may be folded one or more times prior to the perforating step. In another embodiment, the web 302 may be cut into individual bags after the side seals 342. The web may be folded one or more times prior to the cutting step. The individual bags may be interleaved and may be wound onto a roll.

Figure 9:
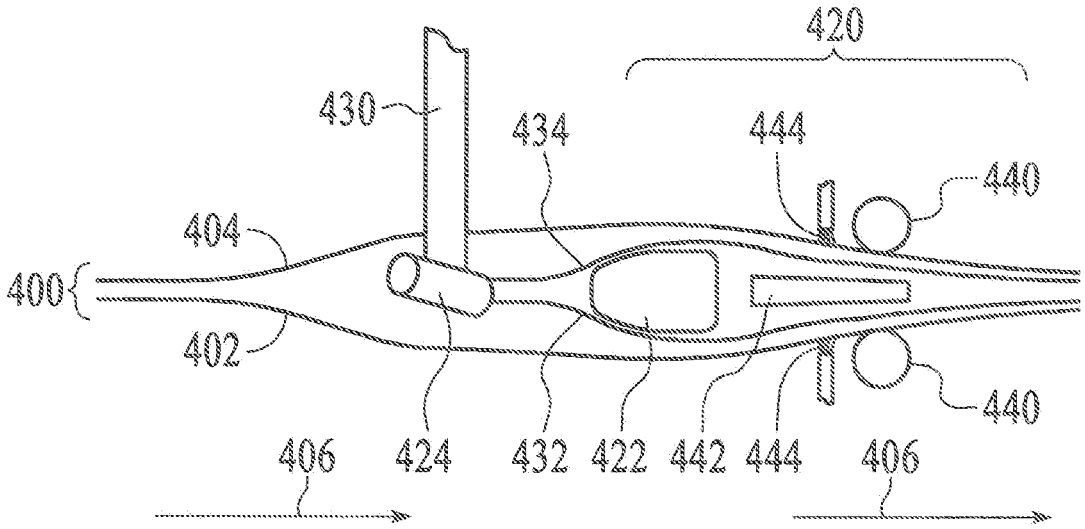
FIG. 9 is a schematic view of another embodiment of the bag processing environment wherein the folded reinforcing strip is inserted into a folded web.
Figure 10:
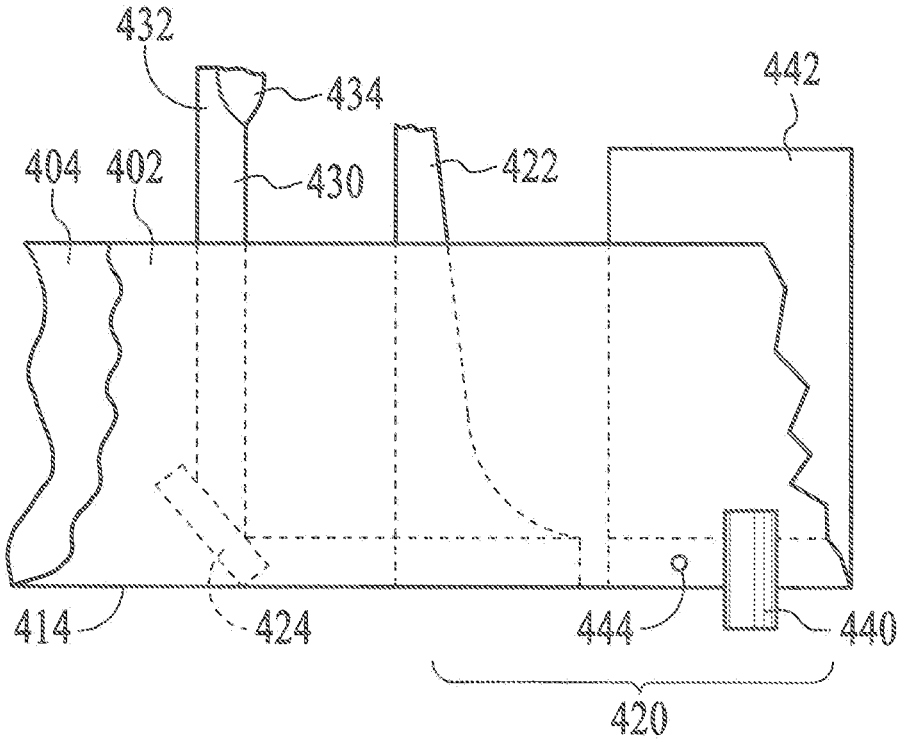
FIG. 10 is a top plan view of the bag processing environment of FIG. 9 illustrating the folded reinforcing strip being inserted into the folded web.

Referring to FIGS. 9 and 10, there is illustrated another embodiment of an automated manufacturing process for manufacturing the bags with internal reinforcing strips. In the illustrated process, the thermoplastic web 400 may be folded into adjacent first and second halves 402, 404 that may be joined at a common bottom edge 414. The process advances the folded web 400 in a machine direction 406 toward a spreader and attachment assembly 420 such that the bottom edge 414 may be aligned parallel to the machine direction. The spreader assembly 420 may include a depending rigid spreader bar 422 that may extend between the first and second web halves 402, 404 proximate the bottom edge 414 thereby spreading the halves apart. Just prior to the spreader assembly 420, a continuous strip 430 of thermoplastic material may be directed perpendicularly to the machine direction 406 between the first and second web halves 402, 404. The strip 430 may be folded lengthwise to provide a first strip half 432 and a corresponding second strip half 434. The folded strip 430 may be redirected by an appropriately arranged roller 424 or similar device to an orientation adjacent the bottom edge 414 running parallel with the machine direction. The spreader bar 422 may also spread the first and second strip halves 432, 434 of the folded strip 430 apart from each other and adjacent to the respective first and second web halves 402, 404 of the web 400.

To attach the first and seconds strip halves 432, 434 of the folded strip to the first and second web halves 402, 404 of the web, two opposed rollers 440 may be provided rearward of the spreader bar 422 with respect to the machine direction 406. The rollers 440 may be heated and/or hot air 444 may be applied to the web and/or strips. The rollers 440 may be positioned proximately toward the bottom edge 414 of the web 400. Located between the rollers 440 may be a vertically arranged separator plate 442. The separator plate 442 may depend between the first and second web halves 402, 404 of the folded web 400 proximate to the common bottom edge 414. The separator plate 442 may be narrower in width than the spreader bar 422. Accordingly, as the web 400 moves along the machine direction 406 past the spreader bar 422 the first and second web halves 402, 404 move towards each other but are still separated by the separator plate 442.

At this stage, it will be appreciated that the first web half 402 and adjacent first strip half 432 are both directed between a heat roller 440 and the separator plate 442 while the second web half 404 and adjacent second strip half 434 are directed between the opposite roller 440 and the separator plate 442. The rollers 440 may be heated and/or hot air 444 may be applied to the web and/or strip. The first web half 402 and first strip half 432 may be fused together while the second web half 404 and second strip half 434 may be fused together. Because of the separator plate 442, the joined first web and strip half and joined second web and strip half may remain separate and are joined by the common bottom edge 414. The web 400 can continue to be directed along the machine direction 406 for further processing steps to provide a finished bag.

Figure 11:
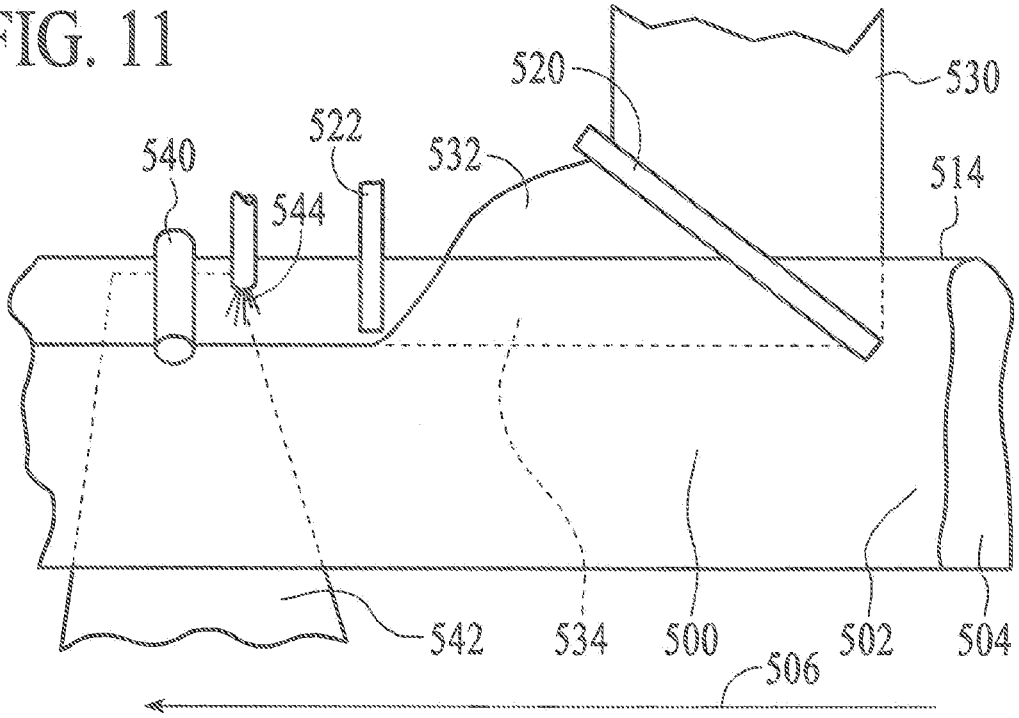
FIG. 11 is a schematic view of another embodiment of the bag processing environment wherein the reinforcing strip is folded over a folded web.
Figure 12:
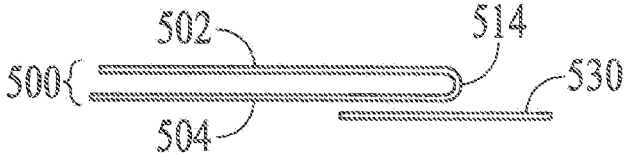
FIG. 12 is a front plan view of the environment of FIG. 11 schematically illustrating a first processing step for reinforcing the web with the reinforcing strip.

Referring to FIG. 11, there is schematically illustrated another embodiment of a manufacturing process for applying an external reinforcing strip 530 about the bottom edge 514 of a plastic bag. According to the process of FIG. 11, a continuous web 500 may be folded into first and second web halves 502, 504 that are joined along a common bottom edge 514. Initially, the process may direct the folded web 500 along a machine direction 506. The bottom edge 514 may be aligned parallel to the machine direction 506. An unfolded strip 530 of reinforcing material may be oriented to be running in parallel with the folded web 500 proximate the bottom edge along the machine direction 506. Orientation of the reinforcing strip may be accomplished by redirection members 520 such as rollers, pull-nips or appropriately arranged static rod-like bars. As depicted in FIG. 12, the unfolded reinforcing strip 530 may proceed in parallel with and adjacent to the second web halve 504. A portion of the reinforcing strip 530 may extend beyond the bottom edge 514.

Figure 13:
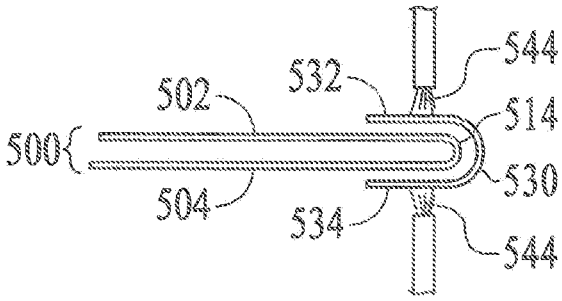
FIG. 13 is a front plan view of the environment of FIG. 11 schematically illustrating a second processing step for reinforcing the web with the reinforcing strip.

The reinforcing strip 530 may be folded in half along the machine direction 506 into first and second strip halves 532, 534 so that the portion of the strip that had previously extended beyond the bottom edge 514 may be folded over the bottom edge. Folding of the reinforcing strip 530 may be accomplished by another redirection member 522 such as a roller, a pull-nip or a rigid bar. Referring to FIG. 13, the portion of the web 500 proximate the bottom edge 514 may be located between the external folded reinforcing strip 530 with the first web half 502 adjacent the first strip half 532 and the second web half 504 adjacent the second strip half 534.

Figure 14:
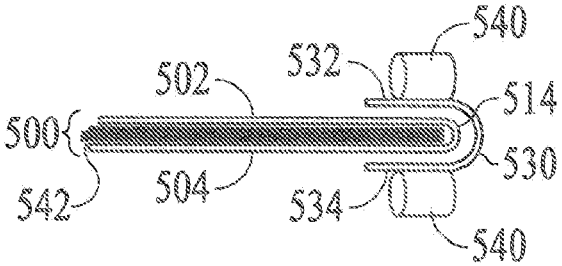
FIG. 14 is a front plan view of the environment of FIG. 11 schematically illustrating a third processing step for reinforcing the web with the reinforcing strip.

To attach the reinforcing strip 530 to the web 500, the strip and web may be directed along the machine direction 506 between a pair of opposed rollers 540. The rollers 540 may be heated and/or hot air 544 may be applied to the web and/or strip. As illustrated in FIG. 14, the rollers 540 may be arranged to be proximate the bottom edge 514 of the web 500 to press the first and second strip halves 532, 534 towards the respective first and second web halves 502, 504. The first and second strip halves 532, 534 may be fused to the respective first and second web halves 502, 504. To prevent the web halves 502, 504 from fusing together, a separator plate 542 may depend in between the web halves and the rollers 540. The web 500 with the reinforcing strip 530 attached externally to the bottom edge 514 may then proceed along the machine direction 506 for further processing.

Figure 15:
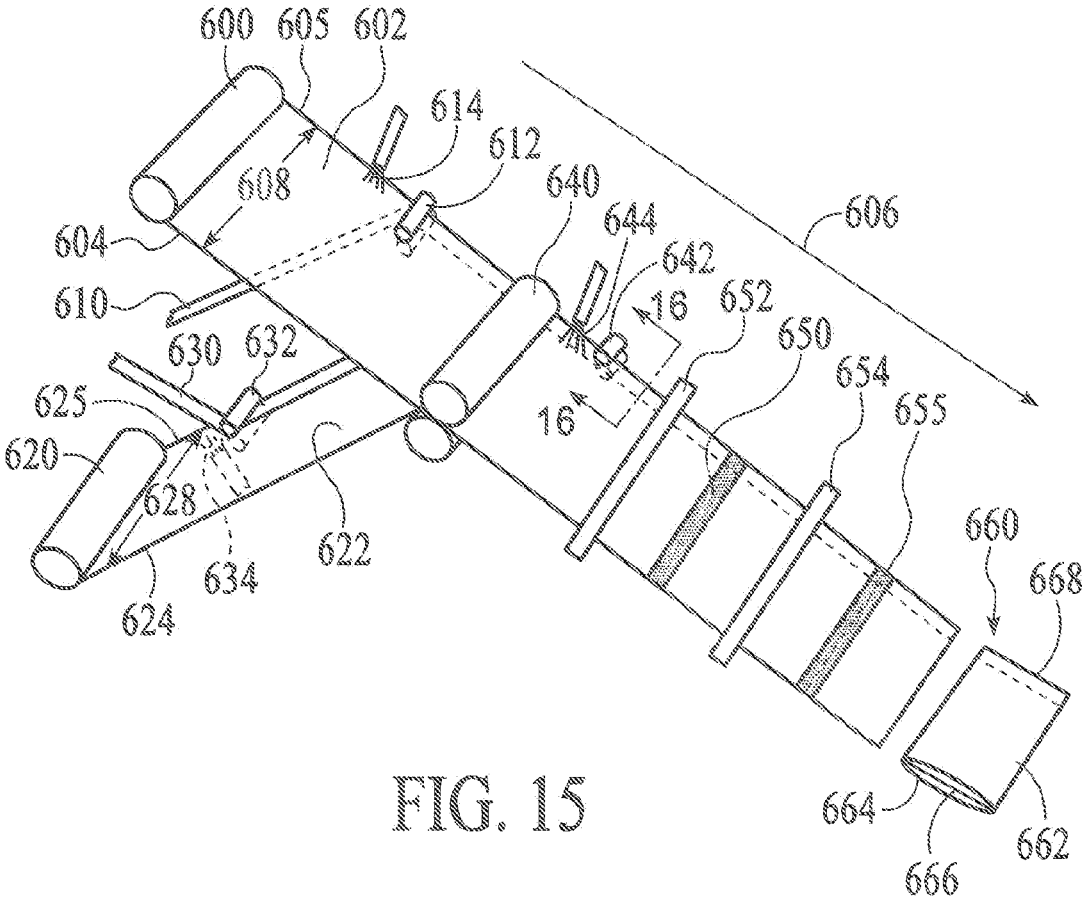
FIG. 15 is a schematic view of another embodiment of a bag processing environment in which the bag is produced from first and second webs each having a reinforcing portion.

Referring to FIG. 15, there is illustrated another embodiment of a manufacturing process for producing a thermoplastic bag with a reinforcing feature from a plurality of separate webs of material. According to the process, a first web 602 of thermoplastic may be unwound from a roll 600 of web or sheet material and may be directed along a machine direction 606. The web 602 may have a width 608 delineated between first and second edges 604, 605 perpendicular to the machine direction 606. To provide a portion of the reinforcing feature, a strip 610 of thermoplastic reinforcing material, narrower in width than the first web, may be directed toward the first web and reoriented to run in the machine direction 606 parallel and adjacent to the second edge 605. The first strip 610 may be attached to the first web 602 by, for example, a pair of rollers 612 which may be heated and/or hot air 614 may be applied to the web and/or the strip. In the illustrated embodiment, the rollers 612 may be arranged to simultaneously accomplish reorientation and attachment of the strip to the web.

A second web 622 of thermoplastic material may be unwound from a second roll 620 of material and directed toward the first web 602. The second web may have a width 628 delineated between first and second edges 624, 625. To provide another portion of the reinforcing feature, a second strip 630 may be directed toward the second web 622 and reoriented to run parallel and adjacent to the second edge 625. Reorientation of the strip 630 may be accomplished by an appropriately arranged pair of rollers 632. The strip 630 may be attached to the second web 622 by, for example, the pair of rollers 632 which may be heated and/or hot air 634 may be applied to the web and/or the strip.

Figure 16:
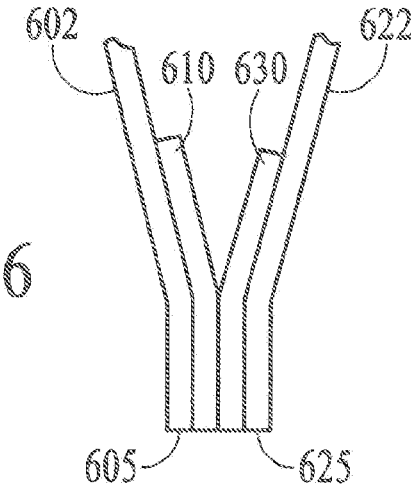
FIG. 16 is a cross-sectional view taken along line 16-16 of FIG. 15 showing the construction of the processed bag.

The second web 622 with the second strip attached 630 may be redirected to run parallel and adjacent to the first web 602 along the machine direction 606 by a pair of rollers 640. The first and second webs 602, 622 may be oriented so that the first and second strips 610, 630 may be facing toward one another. To attach the webs 602, 622 together, the webs may be directed between a pair of rollers 642 that are arranged proximate the second edge 605, 625 of the respective webs. The rollers 642 may be heated and/or hot air 644 may be applied to the web 602 and/or web 622. The second edges 605, 625 of the webs and the corresponding portions of the first and second strips 610, 630 may be fused together along second edges 605, 625. Referring to FIG. 16, the first and second webs 602, 622 may be joined along the second edges 605, 625 with the remainder of the webs separable.

The joined webs 602, 622 may proceed along the machine direction 606 for further processing to produce a finished bag. For example, the webs 602, 622 may be joined together by intermittent heat seals 650 formed along the web widths 608, 628 by a heat sealing device 652. The webs may be perforated along the heat seals 650 by a perforating device 654. A finished bag 660 may be detached along the perforation 655. In another embodiment, the webs may be cut into individual bags after the side seals, and the bags may be interleaved and rolled onto a roll, as described herein. As noted herein, the web may be folded one or more times before the perforating step or cutting step. The finished bag 660 may include opposing first and second sidewalls 662, 664 that define an interior volume 666. As will be appreciated, the opposing first and second sidewalls 662, 664 are the resulting product of the first and second webs 602, 622. Likewise, the bottom edge 668 of the finished bag 660 may be reinforced by the resulting product of the first and second strips 610, 630.

In another embodiment, the process shown in FIG. 15 and the bag shown in FIG. 15 may be changed so that the first and second strips 610, 630 may be located on the outside of the first and second webs 602, 622 and sidewalls 662, 664.

Figure 17:
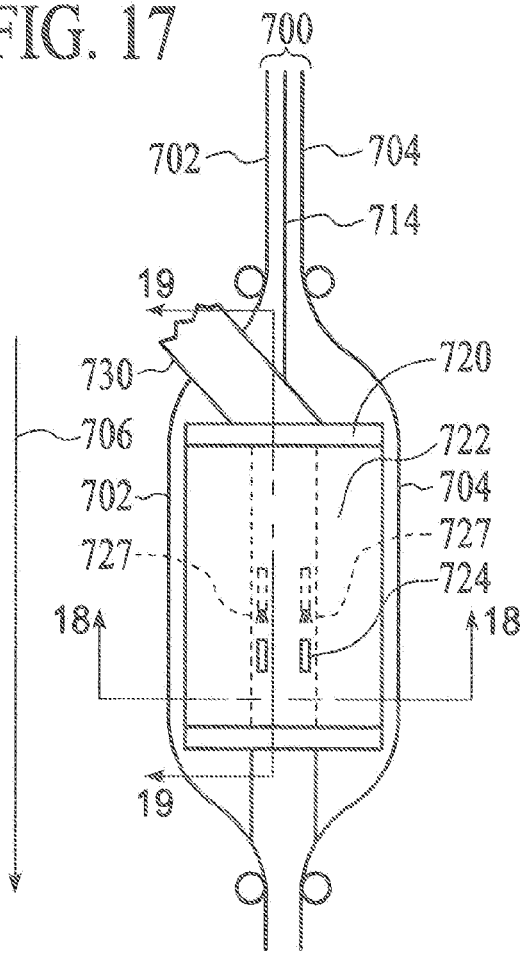
FIG. 17 is a top plan view of another embodiment of a bag processing environment wherein a folded web is partially separated and a reinforcing strip is inserted into the separated web.
Figure 18:
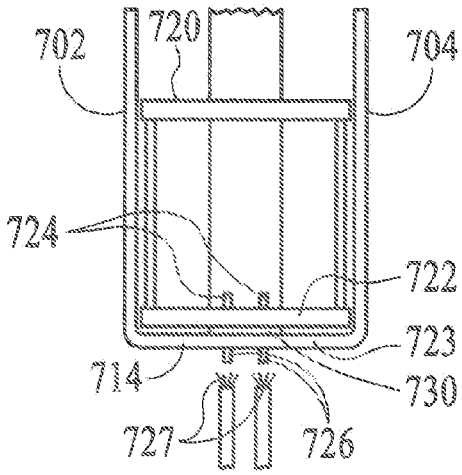
FIG. 18 is a cross-sectional view taken along line 18-18 of FIG. 17 illustrating the arrangement of the separated web and reinforcing strip within the bag processing environment.
Figure 19:
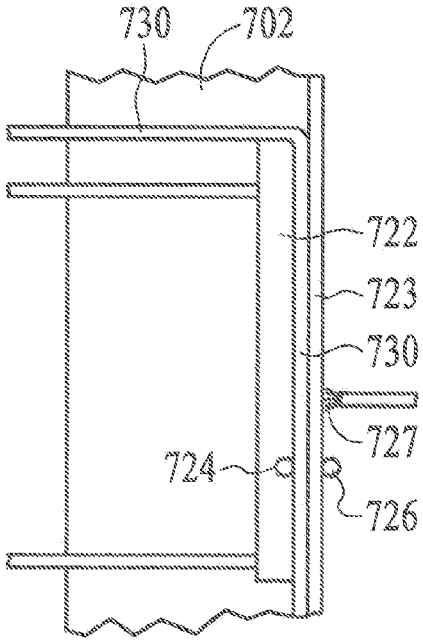
FIG. 19 is a cross-sectional view taken along line 19-19 of FIG. 17.

Referring now to FIGS. 17-19, there is illustrated another embodiment of the step or stage within an automated manufacturing environment in which the reinforcing strip may be arranged next to and may be attached to a flexible thermoplastic web or sheet which will be processed into the finished bag. The web 700, which may be folded into first and second web halves 702, 704 that lay adjacent to each other, may be aligned and directed along a machine direction 706 toward a spreader frame 720. The spreader frame 720, which may be made of various plastic or metal bars and plates attached together, may be disposed in between the folded web 700 so as to partially separate the folded web halves 702, 704 that are proceeding along the machine direction 706. The spreader frame 720 may include a bottom plate 722. As the first and second web halves 702, 704 are separated by the spreader frame 720, the crease 714 which joins the webs halves and corresponds to the bottom edge of the finished bag may move toward and run adjacently along the plate 722. As shown in FIG. 18, the bottom plate 722 may cause a portion of the web halves 702, 704 to form an attachment portion 723. The attachment portion 723 may be relatively flat as it passes over the bottom plate 722.

Referring to FIGS. 17-19, a strip of reinforcing material 730 may be directed to the upstream end of the spreader frame 720 where the strip may be positioned near the attachment portion 723 of the web halves 702, 704. The strip 730 may further be directed downward toward the bottom plate 722 of the frame 720 where the strip may be aligned with the crease 714 and attachment portion 723, and the strip may be redirected to run parallel to the machine direction 706, the crease 714 and attachment portion 723. Accordingly, in this embodiment as illustrated in FIGS. 18 and 19, the strip 730 may be located between the attachment portion 723 and the bottom plate 722 of the spreader frame 720.

To attach the reinforcing strip 730 and web 700, the spreader frame 720 may include rollers 724. The rollers 724 may be supported by and disposed through the bottom plate 722 downstream along the machine direction 706 from where the strip is initially introduced between the separated web halves 702, 704. The rollers 724 may be heated. Second rollers 726 may be located beneath the frame 720 and opposed to the first rollers 724. The rollers 726 may be heated. The opposing rollers 724, 726 may be arranged perpendicular to the machine direction 706. Hot air 727 may be applied to the strip 730 and/or the web 700. Accordingly, when the rollers 724, 726 are heated and/or the hot air activated, the web material 700 and the reinforcing strip 730 may bond or heat seal together. In other embodiments, the rollers 724 may not be used and the rollers 726 may press against the plate 722 through the reinforcing strip 730 and the web 700 to attach the strip to the web. In another embodiment, the hot air 727 may not be used and the rollers may be heated. In another embodiment, the hot air may be used and the rollers may not be heated. In other embodiments, the processing equipment for attaching the web 700 and strip 730 may be located further along the machine direction downstream of the folding frame 720.

Referring to FIGS. 20-22, there is illustrated another embodiment of a step or stage for placing together a flexible thermoplastic web 800 and a strip of thermoplastic reinforcing material 830 within a high speed manufacturing environment. The web 800, as initially provided, may be folded lengthwise into adjacent first and second web halves 802, 804 that may be movingly directed along a machine direction 806.

To separate the adjacent web halves 802, 804, a V-shaped plate 820 made of a material, such as metal or plastic, may be disposed between the first and second webs halves with its inclined peak 821 directed against the machine direction 806. The V-shaped plate 820 may be made from any suitable material, such as metal or plastic, and may include inclining first and second legs 822, 824 that may be reinforced by support bars 826 arranged to traverse the V-shape. As the web 800 is directed along the machine direction 806, the V-shaped plate 820 may partially separate the adjacent first and second web halves 802, 804. Additionally, as separation of the web halves occurs, the bottom crease 814 which joins the webs halves and corresponds to the bottom edge of the finished bag may move toward and run adjacently along the bottom of the V-shaped plate 820. As shown in FIG. 21, the V-shaped plate 820 may cause a portion of the web halves 802, 804 to form an attachment portion 823. The attachment portion 823 may be relatively flat as it passes through the V-shaped plate 820.

Also after separation of the web halves, a strip of the reinforcing material 830 may be directed to the V-shaped plate 820 and downward between the inclined legs 822, 824 to a point proximate with the crease 814 and the attachment portion 823 of the web 800. The strip 830 may be redirected by, for example, bars or rollers 828 to run parallel with the machine direction 806 and parallel and adjacent to the crease 814 and the attachment portion 823. The strip 830 may be physically attached to the web 800 within the extension of the V-shaped plate or downstream. The strip 830 may be attached to the web 800 using heated rollers and/or hot air as noted herein. After passing by the V-shaped plate 820, the first and second web halves 802, 804 may be folded adjacent to each other about the crease 814.

Figure 23:
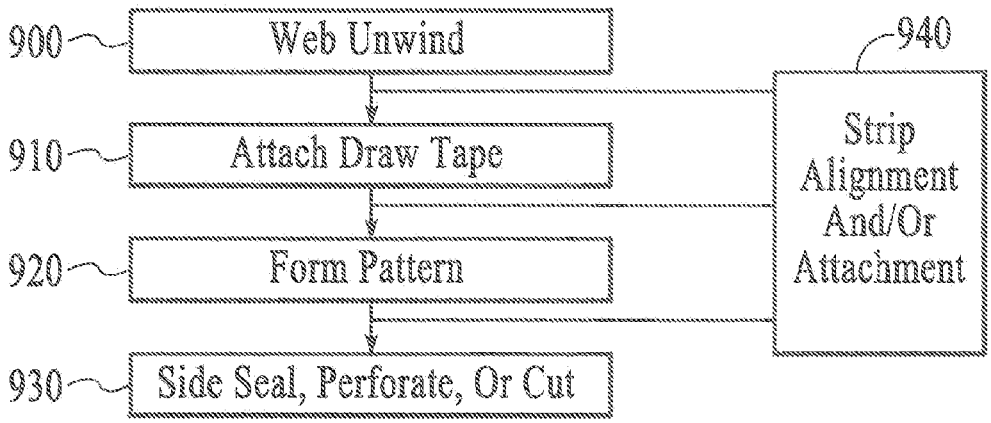
FIG. 23 is a schematic diagram of a bag processing environment with multiple production steps or stages including the step of attaching a reinforcing strip to a web to provide a reinforced thermoplastic bag.

In addition to the step or stage of aligning and/or attaching the reinforcing strip to the thermoplastic web, the manufacturing environment may include any number of additional processing steps or stages for producing a finished bag. Referring to FIG. 23, there is illustrated schematically a plurality of additional processing steps, such as: (1) web unwind 900; (2) attach drawstring 910; (3) form pattern 920 to provide the strainable networks discussed with respect to FIGS. 5 and 6; and (4) side seal, perforate or cut 930. The strip alignment and/or attachment step 940 may be accomplished between any of these foregoing processing steps as appropriate, between other processing steps as appropriate, or can be split among the various processing steps as appropriate, such as, the alignment of the strip may occur before the draw tape step and the attachment of the strip may occur after the draw tape step.

Figure 24:
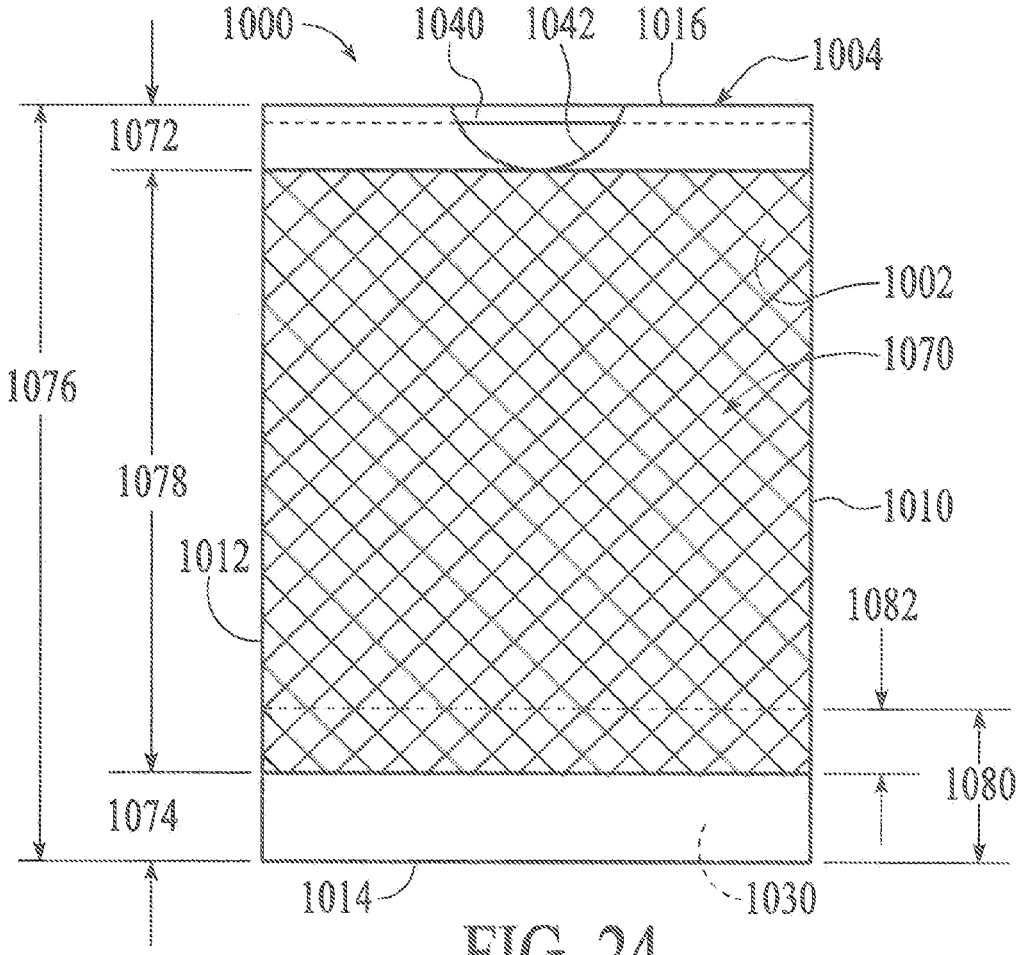
FIG. 24 is a front elevational view of an embodiment of a thermoplastic bag having a reinforcing strip wherein a portion of the bag has been provided with the strainable network illustrated in FIGS. 6 and 7.

Referring to FIG. 24, there is illustrated a thermoplastic bag 1000 in which the step of aligning and attaching the reinforcing strip may occur prior to the step of forming the strainable networks. In this embodiment, the reinforcing strip 1030 may be provided along the closed bottom edge 1014 of the bag 1000 and may extend between the first and second edges 1010, 1012. The open top edge 1016 of the bag 1000, located opposite to the closed bottom edge 1014, may be equipped with a drawstring 1040 accessible via notches 1042 for drawing closed the open top edge.

After the reinforcing strip 1030 and drawstring 1040 have been attached, the bag may proceed through a forming step in which the pattern 1070 may be applied to the opposing first and second sidewalls 1002, 1004. To avoid interfering with the drawstring and closed bottom edge and to possibly provide free edges for rotating rollers to grip and direct the bag material through the processing equipment, the pattern 1070 may be spaced from the open top edge 1016 and closed bottom edge 1014. Accordingly, these portions of the bag may not be formed and the materials at these locations will tend not to affix to each other. By way of example, the uppermost extent of the pattern 1070 may be offset from the top edge 1016 by distance 1072. The distance 1072 may have a first range of about 1.5 inches (3.8 cm) to about 4 inches (10.2 cm), a second range of about 2 inches (5.1 cm) to about 3.25 inches (8.3 cm), and a third range of about 2.5 inches (6.4 cm) to about 3 inches (7.6 cm). In one embodiment, the distance 1072 may be 2.75 inches (7 cm). The lowermost extent of the pattern may be offset from the closed bottom edge by distance 1074. The distance 1074 may have a first range of about 0.5 inches (1.3 cm) to about 4 inches (10.2 cm), a second range of about 1 inches (2.54 cm) to about 3 inches (7.6 cm), and a third range of about 1.5 inches (3.8 cm) to about 2.5 inches (6.4 cm). In one embodiment, the distance 1074 may be 1.75 inches (4.4 cm). The bag may have a height 1076 measured between the top and bottom edges 1016, 1014. The height 1076 may have a first range of about 18 inches (45.7 cm) to about 48 inches (121.9 cm), a second range of about 22 inches (55.9 cm) to about 38 inches (96.5 cm), and a third range of about 24 inches (61 cm) to about 28 inches (71.1 cm). In one embodiment, the height 1076 may be 25.13 inches (63.8 cm). The pattern 1070 may have a height 1078. The height 1078 may have a first range of about 9.8 inches (24.9 cm) to about 45.8 inches (116.3 cm), a second range of about 13.4 inches (34 cm) to about 31.4 inches (79.8 cm), and a third range of about 17 inches (43.2 cm) to about 24.2 inches (61.5 cm). In one embodiment, the height 1078 may be 20.6 inches (52.3 cm).

The reinforcing strip 1030 attached to the bag 1000 may have a height 1080 so that the reinforcing strip extends from the bottom edge 1014 towards the top edge 1016. The height 1080 may have a first range of about 1 inch (2.54 cm) to about 10 inches (25.4 cm), a second range of about 2 inches (5.1 cm) to about 8 inches (20.3 cm), and a third range of about 4 inches (10.2 cm) to about 6 inches (15.2 cm). In one embodiment, the height 1080 may be 5 inches (12.7 cm). For a bag in which the lowermost extent of the pattern 1070 is offset from the bottom edge 1014, the pattern and the reinforcing strip 1030 partially overlap a distance 1082. The distance 1082 may have a first range of about 0 inches (0 cm) to about 9.5 inches (24.13 cm), a second range of about 1 inch (2.54 cm) to about 7 inches (17.78 cm), and a third range of about 1.5 inches (3.8 cm) to about 3.5 inches (8.9 cm). In one embodiment, the distance 1082 may be 3.25 inches (8.3 cm). Partially overlapping the pattern with the reinforcing strip may provide a visually pleasing appearance in which the reinforcing strip visually blends with the sidewall.

Referring to FIG. 25, there is illustrated a cost efficient manner of producing both a sidewall web and a reinforcing strip from the same sheet of thermoplastic material. An initial continuous sheet 1100 of flexible thermoplastic material may be directed along a machine direction 1102. The sheet 1100 may have an initial width 1108, measured perpendicular to the machine direction 1102 between a first side edge 1104 and a second side edge 1106. The width 1108 may have a first range of about 19 inches (48.3 cm) to about 58 inches (147.3 cm), a second range of about 24 inches (61 cm) to about 46 inches (116.8 cm), and a third range of about 28 inches (71.1 cm) to about 34 inches (86.4 cm). In one embodiment, the width 1108 may be 32.56 inches (82.7 cm). The sheet 1100 may be directed through a cutting device 1110 that slits or cuts the sheet along the machine direction 1102. The slit may be located along the width of the sheet closer to the first edge 1104 than the second edge 1106 so that the sheet may be separable into a strip portion 1120 and a web portion 1130. The strip portion 1120 may have a width 1122 and the web portion 1130 may have a width 1132. The width 1122 may have a first range of about 1 inch (2.54 cm) to about 10 inches (25.4 cm), a second range of about 2 inches (5.1 cm) to about 8 inches (20.3 cm), and a third range of about 4 inches (10.2 cm) to about 6 inches (15.2 cm). In one embodiment, the width 1122 may be 5 inches (12.7 cm). The width 1132 may have a first range of about 19 inches (48.3 cm) to about 50 inches (127 cm), a second range of about 23 inches (58.4 cm) to about 40 inches (101.6 cm), and a third range of about 25 inches (63.5 cm) to about 30 inches (76.2 cm). In one embodiment, the width 1132 may be 27.56 inches (70 cm). The separable strip portion 1120 may be wound onto a first roll 1124 while the web portion may be wound onto a separate second roll 1134. As will be appreciated, the first roll provides the reinforcing strip material and the second roll provides the sidewall material.

Referring to FIGS. 26 and 27, there is illustrated another embodiment of the invention in which the thermoplastic bag has a reinforced bottom edge. The reinforced bottom edge may be provided by making the bag from thermoplastic web or sheet material having varying thickness. For example, referring to FIG. 26, the bag 1200 may be made from a single web 1201 of flexible thermoplastic material that may be folded along a closed bottom edge 1214 to provide first sidewall 1202 and an opposing second sidewall 1204. The opposing first and second sidewalls 1202, 1204 provide an interior volume 1206 for receiving items. To access the interior volume, the top edges 1220, 1222 of the respective sidewalls 1202, 1204 opposite the closed bottom edge 1214 may remain un-joined to provide an opening 1224 opposite the closed bottom edge 1214.

To reinforce the bag 1200, the web material 1201 that provides the first and second sidewalls 1202, 1204 may have varying thicknesses. For example, the web material may have a material thickness indicated by thickness 1230 proximate the bottom edge 1214 that is greater than the material thickness proximate the top edges 1220, 1222 indicated by thickness 1232. The first thickness 1230 may have a first range of about 0.0009 inches (0.0023 cm) to about 0.0015 inches (0.0038 cm), a second range of about 0.00095 inches (0.0024 cm) to about 0.0014 inches (0.0036 cm), and a third range of about 0.001 inches (0.0025 cm) to about 0.0013 inches (0.0033 cm). In one embodiment, the thickness 1230 may be 0.0012 inches (0.0030 cm). The second thickness 1232 may have a first range of about 0.0005 inches (0.0013 cm) to about 0.0014 inches (0.0036 cm), a second range of about 0.0006 inches (0.0015 cm) to about 0.001 inches (0.0025 cm), and a third range of about 0.0007 inches (0.0018 cm) to about 0.00085 inches (0.0021 cm). In one embodiment, the thickness 1232 may be 0.0008 inches (0.0020 cm). The bottom edge 1214 is therefore reinforced with more web material and thus more resistant to rupture and/or puncture.

Referring to FIG. 27, there is illustrated another embodiment of a reinforced plastic bag 1300 manufactured from webs of varying thickness. The bag 1300 may be made from a first sidewall 1302 of thermoplastic material and a separate, opposing second sidewall 1304 of similar material. The first and second sidewalls 1302, 1304 may be joined along a closed bottom edge 1314 by, for example, heat sealing. The opposing sidewalls 1302, 1304 thereby define an interior volume 1306 for receiving items for storage. To access the interior volume 1306, the top edges 1320, 1322 of the respective sidewalls 1302, 1304 remain un-joined to provide an opening 1324. To reinforce the bag, the material of the first sidewall 1302 may be thicker proximate the closed bottom edge 1314 than the opened top edge 1320. The thickness 1330 proximate the bottom edge 1314 may have a first range of about 0.0009 inches (0.0023 cm) to about 0.0015 inches (0.0038 cm), a second range of about 0.00095 inches (0.0024 cm) to about 0.0014 inches (0.0036 cm), and a third range of about 0.001 inches (0.0025 cm) to about 0.0013 inches (0.0033 cm). In one embodiment, the thickness 1330 may be 0.0012 inches (0.0030 cm). The thickness 1332 proximate the top edge 1320 may have a first range of about 0.0005 inches (0.0013 cm) to about 0.0014 inches (0.0036 cm), a second range of about 0.0006 inches (0.0015 cm) to about 0.001 inches (0.0025 cm), and a third range of about 0.0007 inches (0.0018 cm) to about 0.00085 inches (0.0020 cm). In one embodiment, the thickness 1332 may be 0.0008 inches (0.0020 cm). The web material forming the second sidewall 1304 may be similarly shaped so that the bottom edge 1314 is reinforced with more web material.

Formation of the web material have varying thicknesses may be achieved in a number of suitable ways. For example, the web extrusion process may be modified so that the extrusion die includes a slot of varying width. In another example, additional web material may be co-extruded along with the primary web material so that the materials bond together. Another example is to blow extrude a web or sheet of thermoplastic material, then vary the cooling rate of the blown sheet at different portions. The uneven cooling rate will cause different portions of the sheet to have different thicknesses. Other suitable methods of altering thermoplastic sheet thicknesses may be utilized.

In addition to heat rollers and/or hot air, other techniques for attaching the reinforcing strip to the web may be used as appropriate, such as, ultrasonic techniques, adhesive, and/or mechanical modification, such as, forming a pattern as noted herein.

Figure 28A:
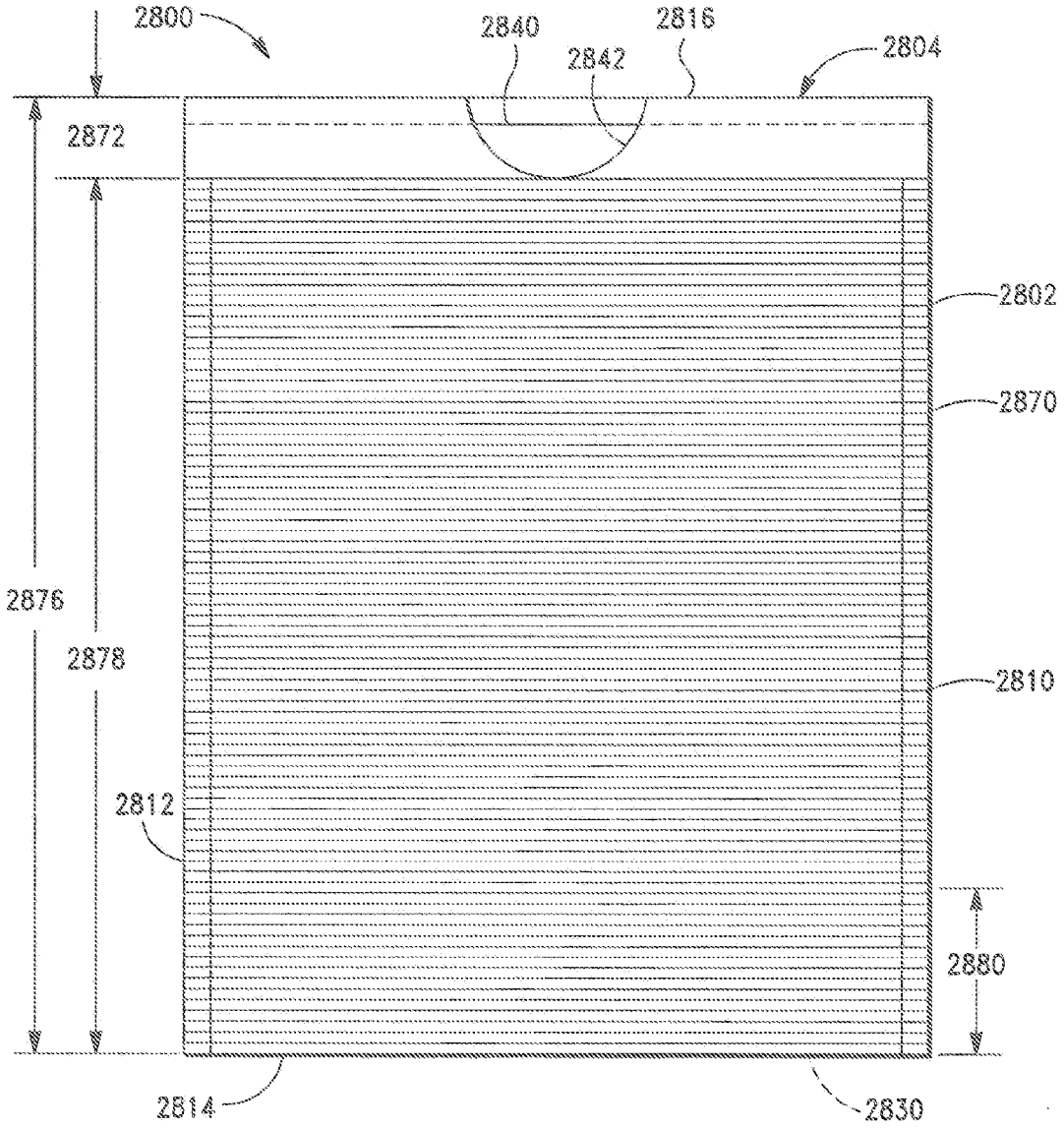
FIG. 28A is a front elevational view of an embodiment of a thermoplastic bag having a reinforcing strip wherein a portion of the bag has been provided with pattern or patterns.

Referring to FIG. 28A, there is illustrated a thermoplastic bag 2800 in which the step of aligning and attaching the reinforcing strip may occur prior to the step of forming the ring rolling pattern. In this embodiment, the reinforcing strip 2830 may be provided along the closed bottom edge 2814 of the bag 2800 and may extend between the first and second edges 2810, 2812. The open top edge 2816 of the bag 2800, located opposite to the closed bottom edge 2814, may be equipped with a drawstring 2840 accessible via notches 2842 for drawing closed the open top edge.

After the reinforcing strip 2830 and drawstring 2840 have been attached, the bag may proceed through a forming step in which the ring rolling pattern 2870 may be applied to the opposing first and second sidewalls 2802, 2804. To avoid interfering with the drawstring and closed bottom edge and to possibly provide free edges for rotating rollers to grip and direct the bag material through the processing equipment, the pattern 2870 may be spaced from the open top edge 2816 and the pattern 2870 may run to the closed bottom edge 2814. Accordingly, the unpatterned portions of the bag may not be formed and the materials at these locations will tend not to affix to each other. By way of example, the uppermost extent of the pattern 2870 may be offset from the top edge 2816 by distance 2872. The distance 2872 may have a first range of about 1.5 inches (3.8 cm) to about 4 inches (10.2 cm), a second range of about 2 inches (5.1 cm) to about 3.25 inches (8.3 cm), and a third range of about 2.5 inches (6.4 cm) to about 3 inches (7.6 cm). In one embodiment, the distance 2872 may be 2.75 inches (7 cm). The bag may have a height 2876 measured between the top and bottom edges 2816, 2814. The height 2876 may have a first range of about 18 inches (45.7 cm) to about 48 inches (121.9 cm), a second range of about 22 inches (55.9 cm) to about 38 inches (96.5 cm), and a third range of about 24 inches (61 cm) to about 28 inches (71.1 cm). In one embodiment, the height 2876 may be 25.13 inches (63.8 cm). The pattern 2870 may have a height 2878. The height 2878 may have a first range of about 11.6 inches (29.3 cm) to about 47.6 inches (120.7 cm), a second range of about 15.2 inches (38.4 cm) to about 33.2 inches (84.2 cm), and a third range of about 18.8 inches (47.6 cm) to about 26.0 inches (65.9 cm). In one embodiment, the height 2878 may be 22.4 inches (56.7 cm).

The reinforcing strip 2830 attached to the bag 2800 may have a height 2880 so that the reinforcing strip extends from the bottom edge 2814 towards the top edge 2816. The height 2880 may have a first range of about 1 inch (2.54 cm) to about 10 inches (25.4 cm), a second range of about 2 inches (5.1 cm) to about 8 inches (20.3 cm), and a third range of about 4 inches (10.2 cm) to about 6 inches (15.2 cm). In one embodiment, the height 2880 may be 5 inches (12.7 cm).

Figure 28B:
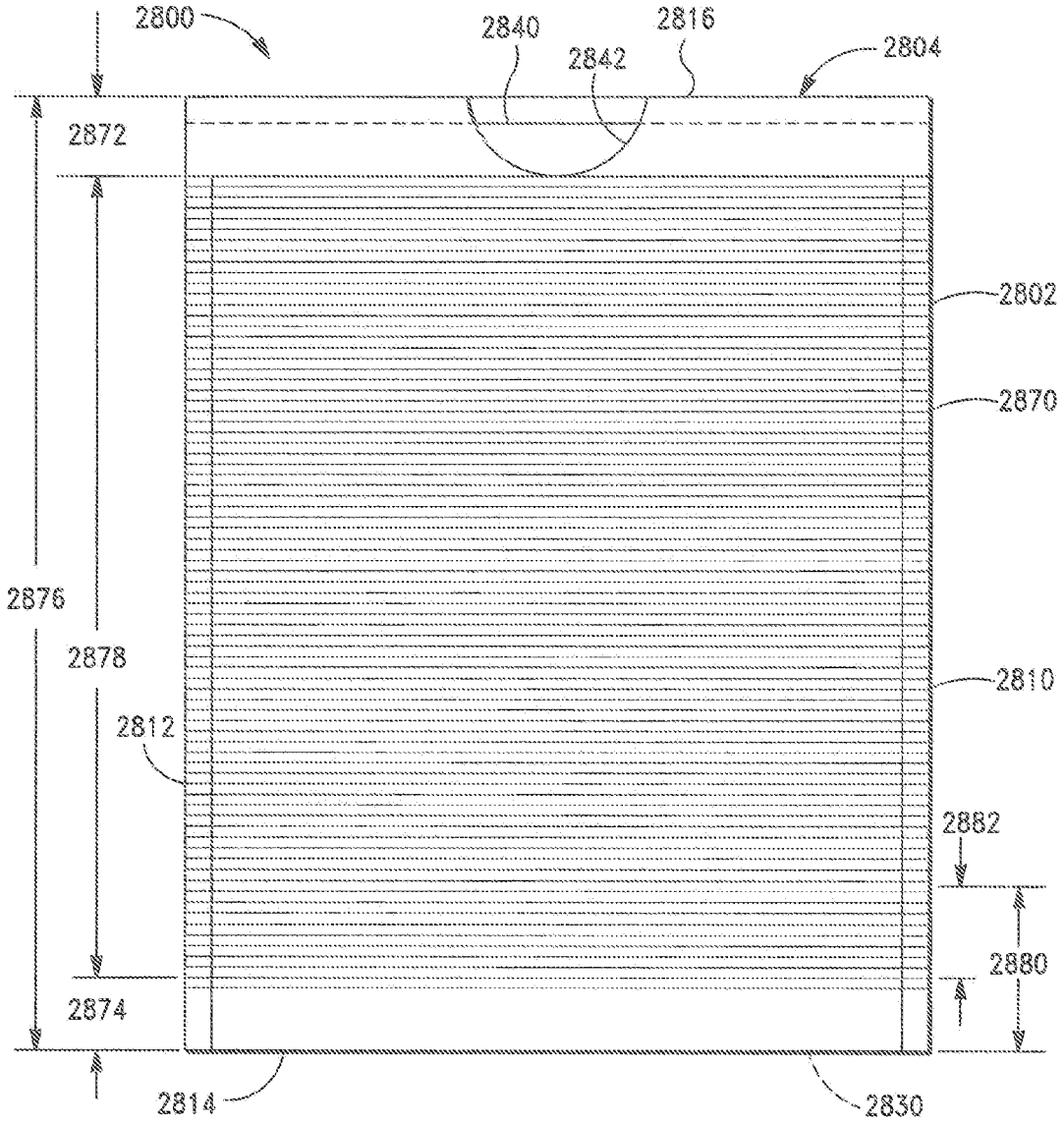
FIG. 28B is a front elevational view of an embodiment of a thermoplastic bag having a reinforcing strip wherein a portion of the bag has been provided with pattern or patterns.

Referring to FIG. 28B, there is illustrated a thermoplastic bag 2800 in which the step of aligning and attaching the reinforcing strip may occur prior to the step of forming the ring rolling pattern. In this embodiment, the reinforcing strip 2830 may be provided along the closed bottom edge 2814 of the bag 2800 and may extend between the first and second edges 2810, 2812. The open top edge 2816 of the bag 2800, located opposite to the closed bottom edge 2814, may be equipped with a drawstring 2840 accessible via notches 2842 for drawing closed the open top edge.

After the reinforcing strip 2830 and drawstring 2840 have been attached, the bag may proceed through a forming step in which the ring rolling pattern 2870 may be applied to the opposing first and second sidewalls 2802, 2804. To avoid interfering with the drawstring and closed bottom edge and to possibly provide free edges for rotating rollers to grip and direct the bag material through the processing equipment, the pattern 2870 may be spaced from the open top edge 2816 and spaced from the closed bottom edge 2814. Accordingly, the unpatterned portions of the bag may not be formed and the materials at these locations will tend not to affix to each other. By way of example, the uppermost extent of the pattern 2870 may be offset from the top edge 2816 by distance 2872. The distance 2872 may have a first range of about 1.5 inches (3.8 cm) to about 4 inches (10.2 cm), a second range of about 2 inches (5.1 cm) to about 3.25 inches (8.3 cm), and a third range of about 2.5 inches (6.4 cm) to about 3 inches (7.6 cm). In one embodiment, the distance 2872 may be 2.75 inches (7 cm). The lowermost extent of the pattern may be offset from the closed bottom edge by distance 2874. The distance 2874 may have a first range of about 0.5 inches (1.3 cm) to about 4 inches (10.2 cm), a second range of about 1 inches (2.54 cm) to about 3 inches (7.6 cm), and a third range of about 1.5 inches (3.8 cm) to about 2.5 inches (6.4 cm). In one embodiment, the distance 2874 may be 1.75 inches (4.4 cm). The bag may have a height 2876 measured between the top and bottom edges 2816, 2814. The height 2876 may have a first range of about 18 inches (45.7 cm) to about 48 inches (121.9 cm), a second range of about 22 inches (55.9 cm) to about 38 inches (96.5 cm), and a third range of about 24 inches (61 cm) to about 28 inches (71.1 cm). In one embodiment, the height 2876 may be 25.13 inches (63.8 cm). The pattern 2870 may have a height 2878. The height 2878 may have a first range of about 9.8 inches (24.9 cm) to about 45.8 inches (116.3 cm), a second range of about 13.4 inches (34 cm) to about 31.4 inches (79.8 cm), and a third range of about 17 inches (43.2 cm) to about 24.2 inches (61.5 cm). In one embodiment, the height 2878 may be 20.6 inches (52.3 cm).

The reinforcing strip 2830 attached to the bag 2800 may have a height 2880 so that the reinforcing strip extends from the bottom edge 2814 towards the top edge 2816. The height 2880 may have a first range of about 1 inch (2.54 cm) to about 10 inches (25.4 cm), a second range of about 2 inches (5.1 cm) to about 8 inches (20.3 cm), and a third range of about 4 inches (10.2 cm) to about 6 inches (15.2 cm). In one embodiment, the height 2880 may be 5 inches (12.7 cm). For a bag in which the lowermost extent of the pattern 2870 is offset from the bottom edge 2814, the pattern and the reinforcing strip 2830 partially overlap a distance 2882. The distance 2882 may have a first range of about 0 inches (0 cm) to about 9.5 inches (24.13 cm), a second range of about 1 inch (2.54 cm) to about 7 inches (17.78 cm), and a third range of about 1.5 inches (3.8 cm) to about 3.5 inches (8.9 cm). In one embodiment, the distance 2882 may be 3.25 inches (8.3 cm). Partially overlapping the pattern with the reinforcing strip may provide a visually pleasing appearance in which the reinforcing strip visually blends with the sidewall.

Figure 29A:
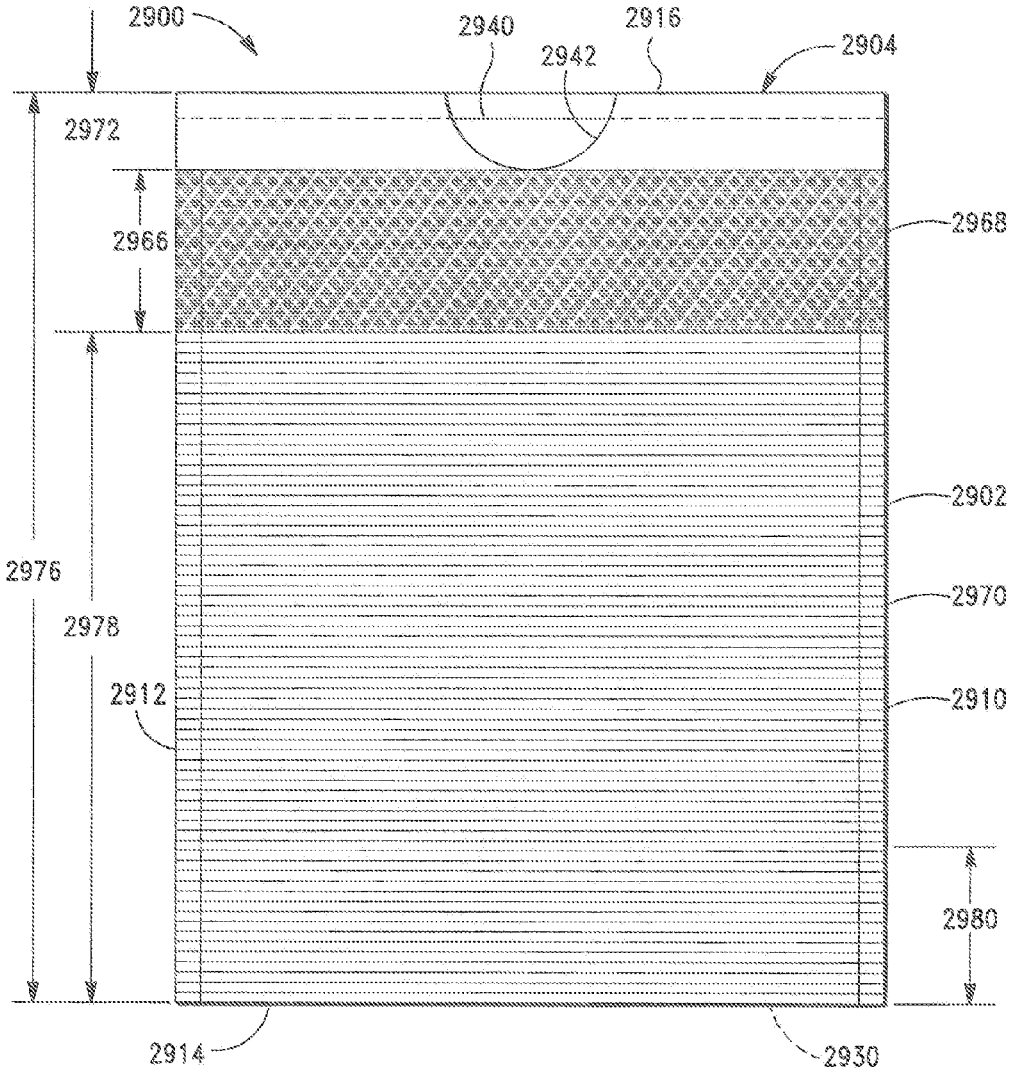
FIG. 29A is a front elevational view of an embodiment of a thermoplastic bag having a reinforcing strip wherein a portion of the bag has been provided with pattern or patterns.

Referring to FIG. 29A, there is illustrated a thermoplastic bag 2900 in which the step of aligning and attaching the reinforcing strip may occur prior to the step of forming the ring rolling and the SELFing patterns. In this embodiment, the reinforcing strip 2930 may be provided along the closed bottom edge 2914 of the bag 2900 and may extend between the first and second edges 2910, 2912. The open top edge 2916 of the bag 2900, located opposite to the closed bottom edge 2914, may be equipped with a drawstring 2940 accessible via notches 2942 for drawing closed the open top edge.

After the reinforcing strip 2930 and drawstring 2940 have been attached, the bag may proceed through one or more forming steps in which the SELFing (strainable network) pattern 2968 and/or the ring rolling pattern 2970 may be applied to the opposing first and second sidewalls 2902, 2904. To avoid interfering with the drawstring and closed bottom edge and to possibly provide free edges for rotating rollers to grip and direct the bag material through the processing equipment, the pattern 2968 may be spaced from the open top edge 2916 and the pattern 2970 may run to the closed bottom edge 2914. Accordingly, the unpatterned portions of the bag may not be formed and the materials at these locations will tend not to affix to each other. By way of example, the uppermost extent of the pattern 2968 may be offset from the top edge 2916 by distance 2972. The distance 2972 may have a first range of about 1.5 inches (3.8 cm) to about 4 inches (10.2 cm), a second range of about 2 inches (5.1 cm) to about 3.25 inches (8.3 cm), and a third range of about 2.5 inches (6.4 cm) to about 3 inches (7.6 cm). In one embodiment, the distance 2972 may be 2.75 inches (7 cm). The bag may have a height 2976 measured between the top and bottom edges 2916, 2914. The height 2976 may have a first range of about 18 inches (45.7 cm) to about 48 inches (121.9 cm), a second range of about 22 inches (55.9 cm) to about 38 inches (96.5 cm), and a third range of about 24 inches (61 cm) to about 28 inches (71.1 cm). In one embodiment, the height 2976 may be 25.13 inches (63.8 cm). The pattern 2968 may have a height 2966. The height 2966 may have a first range of about 6.0 inches (15.2 cm) to about 1.0 inches (2.5 cm), a second range of about 5.0 inches (12.7 cm) to about 1.25 inches (3.2 cm), and a third range of about 4.0 inches (10.2 cm) to about 1.5 inches (3.8 cm). In one embodiment, the height 2966 may be 2.0 inches (5.1 cm). The pattern 2970 may have a height 2978. The height 2978 may have a first range of about 9.6 inches (24.4 cm) to about 45.6 inches (115.8 cm), a second range of about 13.2 inches (33.5 cm) to about 31.2 inches (79.2 cm), and a third range of about 16.8 inches (42.7 cm) to about 24.0 inches (61.0 cm). In one embodiment, the height 2978 may be 20.0 inches (50.8 cm).

The reinforcing strip 2930 attached to the bag 2900 may have a height 2980 so that the reinforcing strip extends from the bottom edge 2914 towards the top edge 2916. The height 2980 may have a first range of about 1 inch (2.54 cm) to about 10 inches (25.4 cm), a second range of about 2 inches (5.1 cm) to about 8 inches (20.3 cm), and a third range of about 4 inches (10.2 cm) to about 6 inches (15.2 cm). In one embodiment, the height 2980 may be 5 inches (12.7 cm).

Figure 29B:
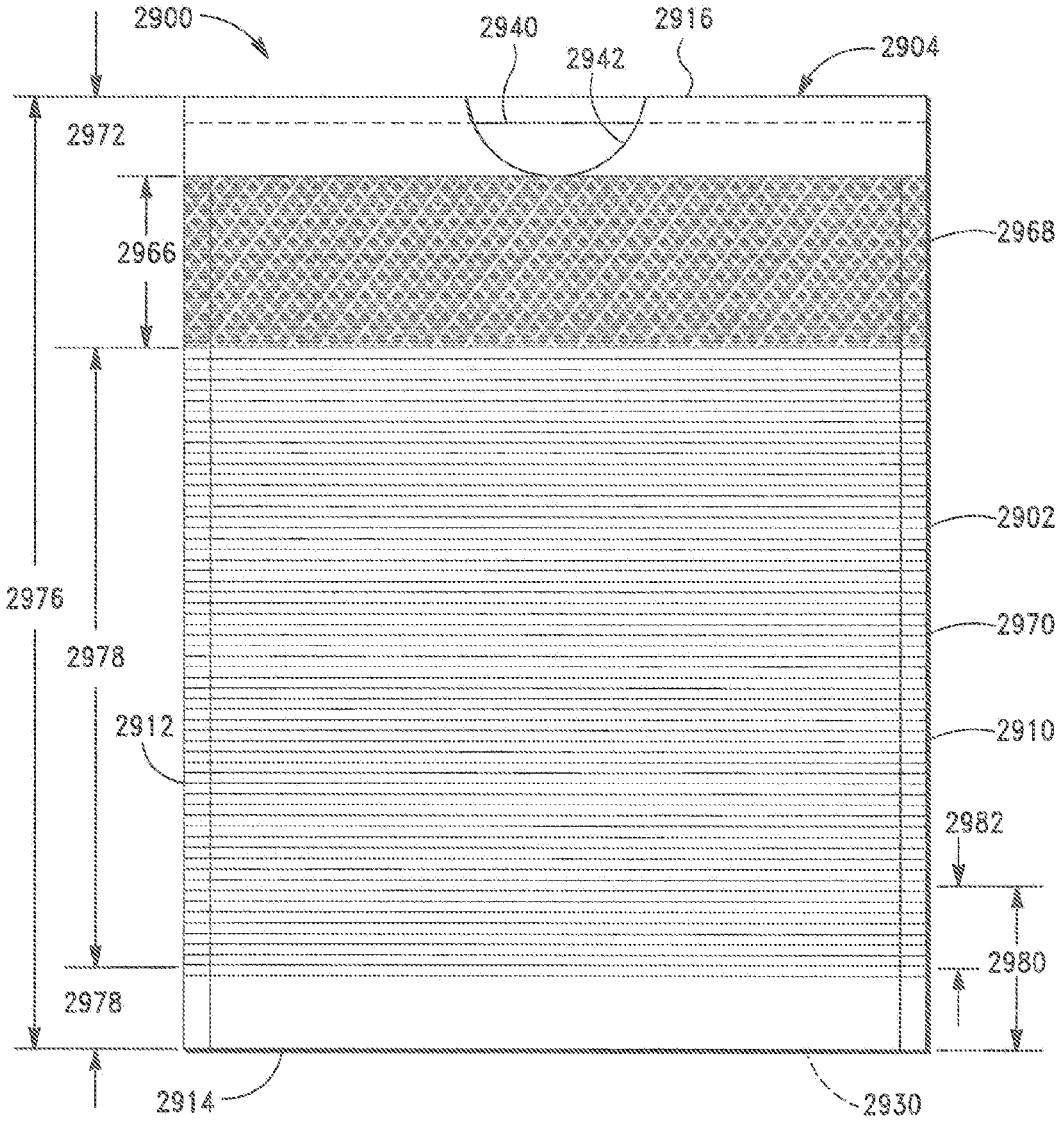
FIG. 29B is a front elevational view of an embodiment of a thermoplastic bag having a reinforcing strip wherein a portion of the bag has been provided with pattern or patterns.

Referring to FIG. 29B, there is illustrated a thermoplastic bag 2900 in which the step of aligning and attaching the reinforcing strip may occur prior to the step of forming the ring rolling and the SELFing pattern. In this embodiment, the reinforcing strip 2930 may be provided along the closed bottom edge 2914 of the bag 2900 and may extend between the first and second edges 2910, 2912. The open top edge 2916 of the bag 2900, located opposite to the closed bottom edge 2914, may be equipped with a drawstring 2940 accessible via notches 2942 for drawing closed the open top edge.

After the reinforcing strip 2930 and drawstring 2940 have been attached, the bag may proceed through one or more forming steps in which the SELFing (strainable network) pattern 2968 and/or the ring rolling pattern 2970 may be applied to the opposing first and second sidewalls 2902, 2904. To avoid interfering with the drawstring and closed bottom edge and to possibly provide free edges for rotating rollers to grip and direct the bag material through the processing equipment, the pattern 2968 may be spaced from the open top edge 2916 and the pattern 2970 spaced from the closed bottom edge 2914. Accordingly, the unpatterned portions of the bag may not be formed and the materials at these locations will tend not to affix to each other. By way of example, the uppermost extent of the pattern 2968 may be offset from the top edge 2916 by distance 2972. The distance 2972 may have a first range of about 1.5 inches (3.8 cm) to about 4 inches (10.2 cm), a second range of about 2 inches (5.1 cm) to about 3.25 inches (8.3 cm), and a third range of about 2.5 inches (6.4 cm) to about 3 inches (7.6 cm). In one embodiment, the distance 2972 may be 2.75 inches (7 cm). The lowermost extent of the pattern may be offset from the closed bottom edge by distance 2974. The distance 2974 may have a first range of about 0.5 inches (1.3 cm) to about 4 inches (10.2 cm), a second range of about 1 inches (2.54 cm) to about 3 inches (7.6 cm), and a third range of about 1.5 inches (3.8 cm) to about 2.5 inches (6.4 cm). In one embodiment, the distance 2974 may be 1.75 inches (4.4 cm). The bag may have a height 2976 measured between the top and bottom edges 2916, 2914. The height 2976 may have a first range of about 18 inches (45.7 cm) to about 48 inches (121.9 cm), a second range of about 22 inches (55.9 cm) to about 38 inches (96.5 cm), and a third range of about 24 inches (61 cm) to about 28 inches (71.1 cm). In one embodiment, the height 2976 may be 25.13 inches (63.8 cm). The pattern 2968 may have a height 2966. The height 2966 may have a first range of about 6.0 inches (15.2 cm) to about 1.0 inches (2.5 cm), a second range of about 5.0 inches (12.7 cm) to about 1.25 inches (3.2 cm), and a third range of about 4.0 inches (10.2 cm) to about 1.5 inches (3.8 cm). In one embodiment, the height 2966 may be 2.0 inches (5.1 cm). The pattern 2970 may have a height 2978. The height 2978 may have a first range of about 9.8 inches (24.9 cm) to about 45.8 inches (116.3 cm), a second range of about 13.4 inches (34 cm) to about 31.4 inches (79.8 cm), and a third range of about 17 inches (43.2 cm) to about 24.2 inches (61.5 cm). In one embodiment, the height 2978 may be 20.6 inches (52.3 cm).

The reinforcing strip 2930 attached to the bag 2900 may have a height 2980 so that the reinforcing strip extends from the bottom edge 2914 towards the top edge 2916. The height 2980 may have a first range of about 1 inch (2.54 cm) to about 10 inches (25.4 cm), a second range of about 2 inches (5.1 cm) to about 8 inches (20.3 cm), and a third range of about 4 inches (10.2 cm) to about 6 inches (15.2 cm). In one embodiment, the height 2980 may be 5 inches (12.7 cm). For a bag in which the lowermost extent of the pattern 2970 is offset from the bottom edge 2914, the pattern and the reinforcing strip 2930 partially overlap a distance 2982. The distance 2982 may have a first range of about 0 inches (0 cm) to about 9.5 inches (24.13 cm), a second range of about 1 inch (2.54 cm) to about 7 inches (17.78 cm), and a third range of about 1.5 inches (3.8 cm) to about 3.5 inches (8.9 cm). In one embodiment, the distance 2982 may be 3.25 inches (8.3 cm). Partially overlapping the pattern with the reinforcing strip may provide a visually pleasing appearance in which the reinforcing strip visually blends with the sidewall.

Figure 30A:
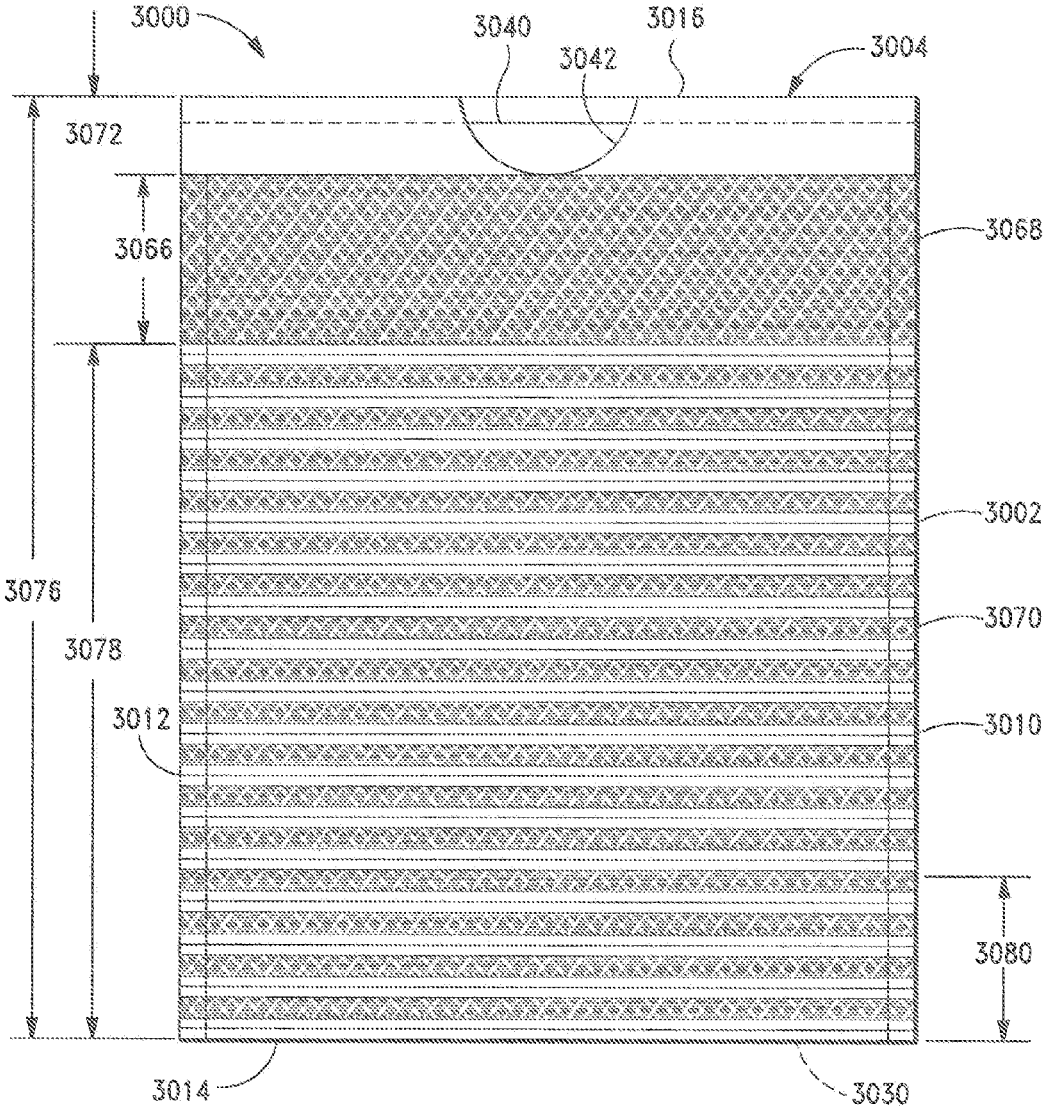
FIG. 30A is a front elevational view of an embodiment of a thermoplastic bag having a reinforcing strip wherein a portion of the bag has been provided with pattern or patterns.

Referring to FIG. 30A, there is illustrated a thermoplastic bag 3000 in which the step of aligning and attaching the reinforcing strip may occur prior to the step of forming the modified combined ring rolling/SELFing pattern and the SELFing pattern. In this embodiment, the reinforcing strip 3030 may be provided along the closed bottom edge 3014 of the bag 3000 and may extend between the first and second edges 3010, 3012. The open top edge 3016 of the bag 3000, located opposite to the closed bottom edge 3014, may be equipped with a drawstring 3040 accessible via notches 3042 for drawing closed the open top edge.

After the reinforcing strip 3030 and drawstring 3040 have been attached, the bag may proceed through one or more forming steps in which the SELFing (strainable network) pattern 3068 and/or the modified combined ring rolling/SELFing pattern 3070 may be applied to the opposing first and second sidewalls 3002, 3004. To avoid interfering with the drawstring and closed bottom edge and to possibly provide free edges for rotating rollers to grip and direct the bag material through the processing equipment, the pattern 3068 may be spaced from the open top edge 3016 and the pattern 3070 may run to the closed bottom edge 3014. Accordingly, the unpatterned portions of the bag may not be formed and the materials at these locations will tend not to affix to each other. By way of example, the uppermost extent of the pattern 3068 may be offset from the top edge 3016 by distance 3072. The distance 3072 may have a first range of about 1.5 inches (3.8 cm) to about 4 inches (10.2 cm), a second range of about 2 inches (5.1 cm) to about 3.25 inches (8.3 cm), and a third range of about 2.5 inches (6.4 cm) to about 3 inches (7.6 cm). In one embodiment, the distance 3072 may be 2.75 inches (7 cm). The bag may have a height 3076 measured between the top and bottom edges 3016, 3014. The height 3076 may have a first range of about 18 inches (45.7 cm) to about 48 inches (121.9 cm), a second range of about 22 inches (55.9 cm) to about 38 inches (96.5 cm), and a third range of about 24 inches (61 cm) to about 28 inches (71.1 cm). In one embodiment, the height 3076 may be 25.13 inches (63.8 cm). The pattern 3068 may have a height 3066. The height 3066 may have a first range of about 6.0 inches (15.2 cm) to about 1.0 inches (2.5 cm), a second range of about 5.0 inches (12.7 cm) to about 1.25 inches (3.2 cm), and a third range of about 4.0 inches (10.2 cm) to about 1.5 inches (3.8 cm). In one embodiment, the height 3066 may be 2.0 inches (5.1 cm). The pattern 3070 may have a height 3078. The height 3078 may have a first range of about 9.6 inches (24.4 cm) to about 45.6 inches (115.8 cm), a second range of about 13.2 inches (33.5 cm) to about 31.2 inches (79.2 cm), and a third range of about 16.8 inches (42.7 cm) to about 24.0 inches (61.0 cm). In one embodiment, the height 3078 may be 20.0 inches (50.8 cm).

The reinforcing strip 3030 attached to the bag 3000 may have a height 3080 so that the reinforcing strip extends from the bottom edge 3014 towards the top edge 3016. The height 3080 may have a first range of about 1 inch (2.54 cm) to about 10 inches (25.4 cm), a second range of about 2 inches (5.1 cm) to about 8 inches (20.3 cm), and a third range of about 4 inches (10.2 cm) to about 6 inches (15.2 cm). In one embodiment, the height 3080 may be 5 inches (12.7 cm).

Figure 30B:
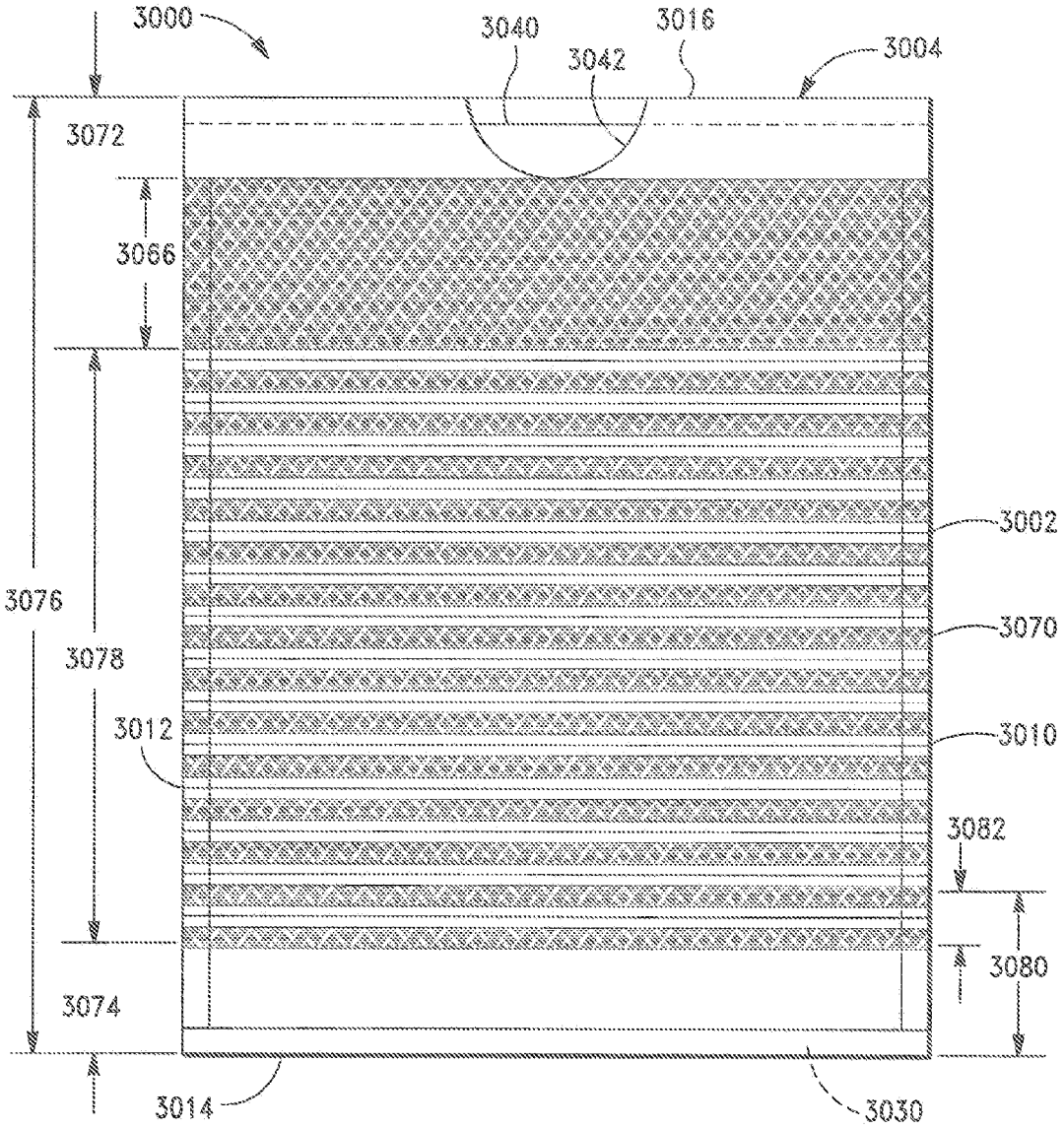
FIG. 30B is a front elevational view of an embodiment of a thermoplastic bag having a reinforcing strip wherein a portion of the bag has been provided with pattern or patterns.

Referring to FIG. 30B, there is illustrated a thermoplastic bag 3000 in which the step of aligning and attaching the reinforcing strip may occur prior to the step of forming the modified combined ring rolling/SELFing pattern and the SELFing pattern. In this embodiment, the reinforcing strip 3030 may be provided along the closed bottom edge 3014 of the bag 3000 and may extend between the first and second edges 3010, 3012. The open top edge 3016 of the bag 3000, located opposite to the closed bottom edge 3014, may be equipped with a drawstring 3040 accessible via notches 3042 for drawing closed the open top edge.

After the reinforcing strip 3030 and drawstring 3040 have been attached, the bag may proceed through one or more forming steps in which the SELFing (strainable network) pattern 3068 and/or the modified combined ring rolling/SELFing pattern 3070 may be applied to the opposing first and second sidewalls 3002, 3004. To avoid interfering with the drawstring and closed bottom edge and to possibly provide free edges for rotating rollers to grip and direct the bag material through the processing equipment, the pattern 3068 may be spaced from the open top edge 3016 and the pattern 3070 spaced from the closed bottom edge 3014. Accordingly, the unpatterned portions of the bag may not be formed and the materials at these locations will tend not to affix to each other. By way of example, the uppermost extent of the pattern 3068 may be offset from the top edge 3016 by distance 3072. The distance 3072 may have a first range of about 1.5 inches (3.8 cm) to about 4 inches (10.2 cm), a second range of about 2 inches (5.1 cm) to about 3.25 inches (8.3 cm), and a third range of about 2.5 inches (6.4 cm) to about 3 inches (7.6 cm). In one embodiment, the distance 3072 may be 2.75 inches (7 cm). The lowermost extent of the pattern may be offset from the closed bottom edge by distance 3074. The distance 3074 may have a first range of about 0.5 inches (1.3 cm) to about 4 inches (10.2 cm), a second range of about 1 inches (2.54 cm) to about 3 inches (7.6 cm), and a third range of about 1.5 inches (3.8 cm) to about 2.5 inches (6.4 cm). In one embodiment, the distance 3074 may be 1.75 inches (4.4 cm). The bag may have a height 3076 measured between the top and bottom edges 3016, 3014. The height 3076 may have a first range of about 18 inches (45.7 cm) to about 48 inches (121.9 cm), a second range of about 22 inches (55.9 cm) to about 38 inches (96.5 cm), and a third range of about 24 inches (61 cm) to about 28 inches (71.1 cm). In one embodiment, the height 3076 may be 25.13 inches (63.8 cm). The pattern 3068 may have a height 3066. The height 3066 may have a first range of about 6.0 inches (15.2 cm) to about 1.0 inches (2.5 cm), a second range of about 5.0 inches (12.7 cm) to about 1.25 inches (3.2 cm), and a third range of about 4.0 inches (10.2 cm) to about 1.5 inches (3.8 cm). In one embodiment, the height 3066 may be 2.0 inches (5.1 cm). The pattern 3070 may have a height 3078. The height 3078 may have a first range of about 9.8 inches (24.9 cm) to about 45.8 inches (116.3 cm), a second range of about 13.4 inches (34 cm) to about 31.4 inches (79.8 cm), and a third range of about 17 inches (43.2 cm) to about 24.2 inches (61.5 cm). In one embodiment, the height 3078 may be 20.6 inches (52.3 cm).

The reinforcing strip 3030 attached to the bag 3000 may have a height 3080 so that the reinforcing strip extends from the bottom edge 3014 towards the top edge 3016. The height 3080 may have a first range of about 1 inch (2.54 cm) to about 10 inches (25.4 cm), a second range of about 2 inches (5.1 cm) to about 8 inches (20.3 cm), and a third range of about 4 inches (10.2 cm) to about 6 inches (15.2 cm). In one embodiment, the height 3080 may be 5 inches (12.7 cm). For a bag in which the lowermost extent of the pattern 3070 is offset from the bottom edge 3014, the pattern and the reinforcing strip 3030 partially overlap a distance 3082. The distance 3082 may have a first range of about 0 inches (0 cm) to about 9.5 inches (24.13 cm), a second range of about 1 inch (2.54 cm) to about 7 inches (17.78 cm), and a third range of about 1.5 inches (3.8 cm) to about 3.5 inches (8.9 cm). In one embodiment, the distance 3082 may be 3.25 inches (8.3 cm). Partially overlapping the pattern with the reinforcing strip may provide a visually pleasing appearance in which the reinforcing strip visually blends with the sidewall.

Figure 31A:
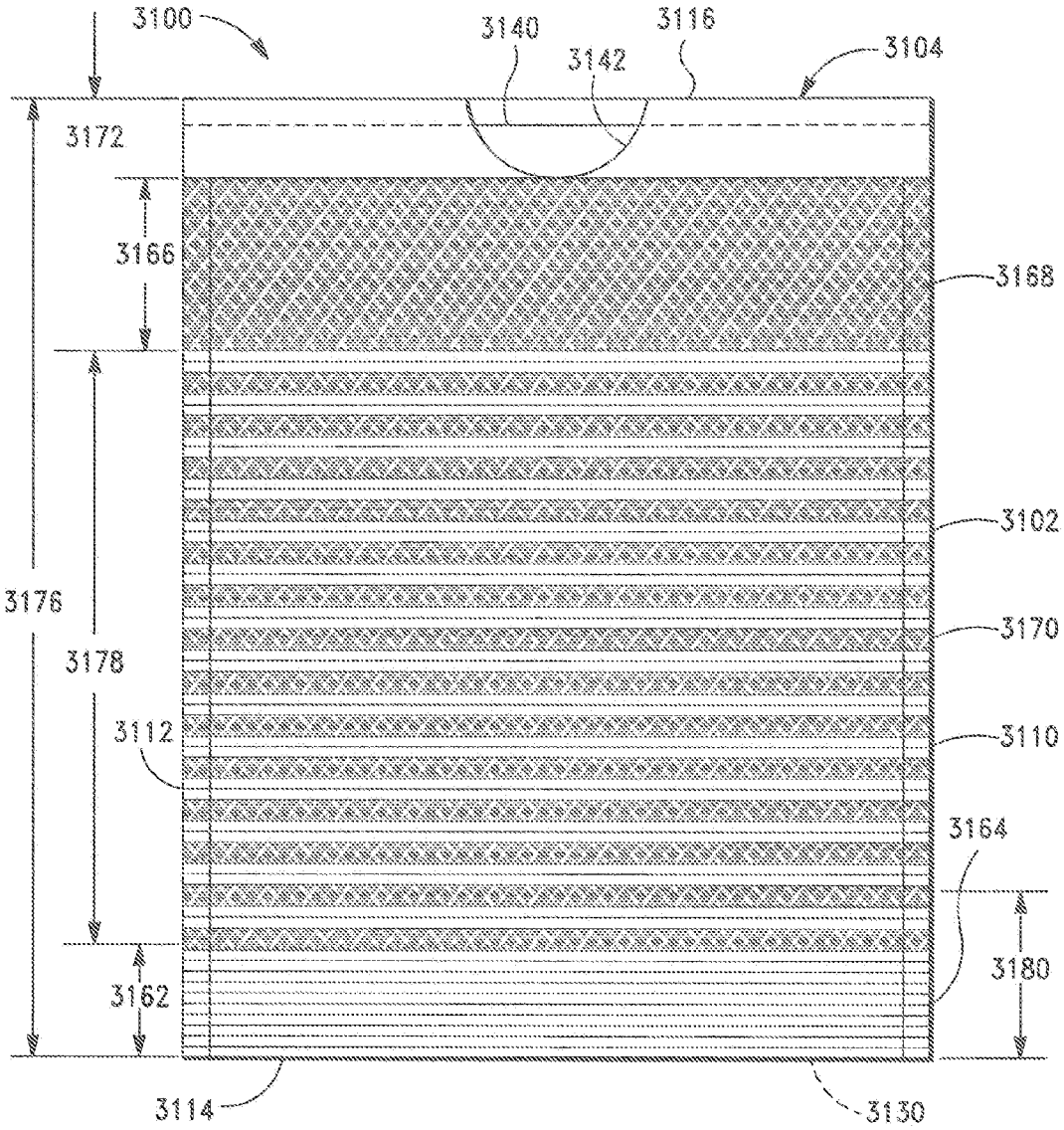
FIG. 31A is a front elevational view of an embodiment of a thermoplastic bag having a reinforcing strip wherein a portion of the bag has been provided with pattern or patterns.

Referring to FIG. 31A, there is illustrated a thermoplastic bag 3100 in which the step of aligning and attaching the reinforcing strip may occur prior to the step of forming the ring rolling, the modified combined ring rolling/SELFing, and the SELFing patterns. In this embodiment, the reinforcing strip 3130 may be provided along the closed bottom edge 3114 of the bag 3100 and may extend between the first and second edges 3110, 3112. The open top edge 3116 of the bag 3100, located opposite to the closed bottom edge 3114, may be equipped with a drawstring 3140 accessible via notches 3142 for drawing closed the open top edge.

After the reinforcing strip 3130 and drawstring 3140 have been attached, the bag may proceed through one or more forming steps in which the SELFing (strainable network) pattern 3168 and/or the ring rolling pattern 3164 and/or the modified combined ring rolling/SELFing pattern 3170 may be applied to the opposing first and second sidewalls 3102, 3104. To avoid interfering with the drawstring and closed bottom edge and to possibly provide free edges for rotating rollers to grip and direct the bag material through the processing equipment, the pattern 3168 may be spaced from the open top edge 3116 and the pattern 3164 may run to the closed bottom edge 3114. Accordingly, the unpatterned portions of the bag may not be formed and the materials at these locations will tend not to affix to each other. By way of example, the uppermost extent of the pattern 3168 may be offset from the top edge 3116 by distance 3172. The distance 3172 may have a first range of about 1.5 inches (3.8 cm) to about 4 inches (10.2 cm), a second range of about 2 inches (5.1 cm) to about 3.25 inches (8.3 cm), and a third range of about 2.5 inches (6.4 cm) to about 3 inches (7.6 cm). In one embodiment, the distance 3172 may be 2.75 inches (7 cm). The bag may have a height 3176 measured between the top and bottom edges 3116, 3114. The height 3176 may have a first range of about 18 inches (45.7 cm) to about 48 inches (121.9 cm), a second range of about 22 inches (55.9 cm) to about 38 inches (96.5 cm), and a third range of about 24 inches (61 cm) to about 28 inches (71.1 cm). In one embodiment, the height 3176 may be 25.13 inches (63.8 cm). The pattern 3168 may have a height 3166. The height 3166 may have a first range of about 6.0 inches (15.2 cm) to about 1.0 inches (2.5 cm), a second range of about 5.0 inches (12.7 cm) to about 1.25 inches (3.2 cm), and a third range of about 4.0 inches (10.2 cm) to about 1.5 inches (3.8 cm). In one embodiment, the height 3166 may be 2.0 inches (5.1 cm). The pattern 3170 may overlap the area of the reinforcing strip 3130 have a height 3178. The height 3178 may have a first range of about 6.1 inches (15.5 cm) to about 42.1 inches (106.9 cm), a second range of about 9.7 inches (24.6 cm) to about 27.7 inches (70.4 cm), and a third range of about 13.3 inches (33.8 cm) to about 20.5 inches (52.1 cm). In one embodiment, the height 3178 may be 16.5 inches (41.9 cm).

The reinforcing strip 3130 attached to the bag 3100 may have a height 3180 so that the reinforcing strip extends from the bottom edge 3114 towards the top edge 3116. The pattern 3164 may have a height 3162 about 1.5 inches (3.8 cm) less than the height 3180. The height 3180 may have a first range of about 1 inch (2.54 cm) to about 10 inches (25.4 cm), a second range of about 2 inches (5.1 cm) to about 8 inches (20.3 cm), and a third range of about 4 inches (10.2 cm) to about 6 inches (15.2 cm). In one embodiment, the height 3180 may be 5 inches (12.7 cm).

Figure 31B:
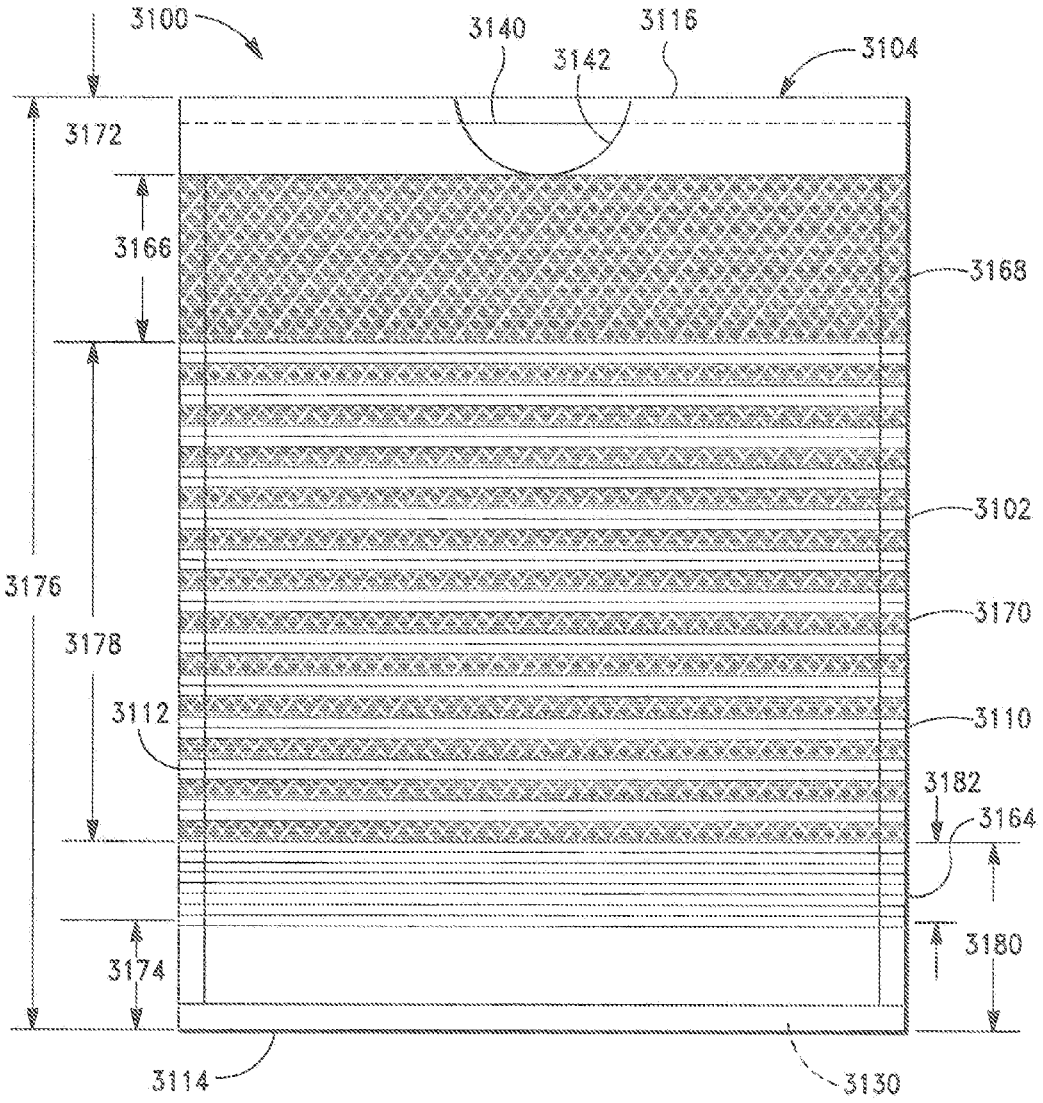
FIG. 31B is a front elevational view of an embodiment of a thermoplastic bag having a reinforcing strip wherein a portion of the bag has been provided with pattern or patterns.

Referring to FIG. 31B, there is illustrated a thermoplastic bag 3100 in which the step of aligning and attaching the reinforcing strip may occur prior to the step of forming the ring rolling, the modified combined ring rolling/SELFing pattern, and the SELFing pattern. In this embodiment, the reinforcing strip 3130 may be provided along the closed bottom edge 3114 of the bag 3100 and may extend between the first and second edges 3110, 3112. The open top edge 3116 of the bag 3100, located opposite to the closed bottom edge 3114, may be equipped with a drawstring 3140 accessible via notches 3142 for drawing closed the open top edge.

After the reinforcing strip 3130 and drawstring 3140 have been attached, the bag may proceed through one or more forming steps in which the SELFing (strainable network) pattern 3168 and/or the ring rolling pattern 3164 and/or the modified combined ring rolling/SELFing pattern 3170 may be applied to the opposing first and second sidewalls 3102, 3104. To avoid interfering with the drawstring and closed bottom edge and to possibly provide free edges for rotating rollers to grip and direct the bag material through the processing equipment, the pattern 3168 may be spaced from the open top edge 3116 and the pattern 3164 spaced from the closed bottom edge 3114. Accordingly, the unpatterned portions of the bag may not be formed and the materials at these locations will tend not to affix to each other. By way of example, the uppermost extent of the pattern 3168 may be offset from the top edge 3116 by distance 3172. The distance 3172 may have a first range of about 1.5 inches (3.8 cm) to about 4 inches (10.2 cm), a second range of about 2 inches (5.1 cm) to about 3.25 inches (8.3 cm), and a third range of about 2.5 inches (6.4 cm) to about 3 inches (7.6 cm). In one embodiment, the distance 3172 may be 2.75 inches (7 cm). The lowermost extent of the pattern 3164 may be offset from the closed bottom edge by distance 3174. The distance 3174 may have a first range of about 0.5 inches (1.3 cm) to about 4 inches (10.2 cm), a second range of about 1 inches (2.54 cm) to about 3 inches (7.6 cm), and a third range of about 1.5 inches (3.8 cm) to about 2.5 inches (6.4 cm). In one embodiment, the distance 3174 may be 1.75 inches (4.4 cm). The bag may have a height 3176 measured between the top and bottom edges 3116, 3114. The height 3176 may have a first range of about 18 inches (45.7 cm) to about 48 inches (121.9 cm), a second range of about 22 inches (55.9 cm) to about 38 inches (96.5 cm), and a third range of about 24 inches (61 cm) to about 28 inches (71.1 cm). In one embodiment, the height 3176 may be 25.13 inches (63.8 cm). The pattern 3168 may have a height 3166. The height 3166 may have a first range of about 6.0 inches (15.2 cm) to about 1.0 inches (2.5 cm), a second range of about 5.0 inches (12.7 cm) to about 1.25 inches (3.2 cm), and a third range of about 4.0 inches (10.2 cm) to about 1.5 inches (3.8 cm). In one embodiment, the height 3166 may be 2.0 inches (5.1 cm). The pattern 3170 may have a height 3178. The height 3178 may have a first range of about 4.6 inches (11.7 cm) to about 40.6 inches (103.1 cm), a second range of about 8.2 inches (20.8 cm) to about 26.2 inches (66.5 cm), and a third range of about 11.8 inches (30.0 cm) to about 19.0 inches (48.3 cm). In one embodiment, the height 3178 may be 15.0 inches (38.1 cm).

The reinforcing strip 3130 attached to the bag 3100 may have a height 3180 so that the reinforcing strip extends from the bottom edge 3114 towards the top edge 3116. The height 3180 may have a first range of about 1 inch (2.54 cm) to about 10 inches (25.4 cm), a second range of about 2 inches (5.1 cm) to about 8 inches (20.3 cm), and a third range of about 4 inches (10.2 cm) to about 6 inches (15.2 cm). In one embodiment, the height 3180 may be 5 inches (12.7 cm). For a bag in which the lowermost extent of the pattern 3164 is offset from the bottom edge 3114, the pattern 3164 and the reinforcing strip 3130 partially overlap a distance 3182. The distance 3182 may have a first range of about 0 inches (0 cm) to about 9.5 inches (24.13 cm), a second range of about 1 inch (2.54 cm) to about 7 inches (17.78 cm), and a third range of about 1.5 inches (3.8 cm) to about 3.5 inches (8.9 cm). In one embodiment, the distance 3182 may be 3.25 inches (8.3 cm). Partially overlapping the pattern with the reinforcing strip may provide a visually pleasing appearance in which the reinforcing strip visually blends with the sidewall.

EXPERIMENTAL

A white bag, according to the design illustrated in FIG. 31A was produced with first and second sidewalls 3102, 3104 having a three coextruded layer B:A:B structure, where the ratio of layers was 20:60:20 and the nominal total thickness of unstretched film was 0.0090 inches. The exterior B layers comprised hexene LLDPE of density 0.918, VLDPE of density 0.905, and metallocene LLDPE of density 0.918. The interior A core layer comprised hexene LLDPE of density 0.926, metallocene LLDPE of density 0.918, butene LLDPE of density 0.918, reclaimed resin from trash bags, and colorant containing white $TiO_2$. The reinforcing strip 3130 had a three coextruded layer B:A:B structure, where the ratio of layers was 15:70:15 and the nominal total thickness of unstretched film was 0.0038 inches. The exterior B layers comprised hexene LLDPE of density 0.928, LDPE of density 0.923, and a processing aide. The interior A core layer comprised HDPE of density 0.949 and colorant containing colored blue pigment. The top patterned bag area 3178 above the strip area 3180 had an opacity of 53.2 and a light transmission of 63.5. The patterned strip area 3180 above the ring rolled area 3162 had an opacity of 72.2 and a light transmission of 48.5. Opacity is measured using a BYK Gardner Spectro-Guide 45/0 Gloss Colorimeter. Light Transmission is measured using a BYK Gardner Haze-Gard Plus conforming to ASTM D1003: Standard Test Method for Haze and Luminous Transmittance of Transparent Plastics. The top patterned bag area 3178 above the strip area 3180 had an MD Tear Resistance of 20.6 N and the patterned strip area 3180 above the ring rolled area 3162 had an MD Tear Resistance of 26.5 N. Tear strength is measured using a Thwing Albert Model 60-2200 ProTear Tearing Tester conforming to ASTM D1922-09 Standard Test Method for Propagation Tear Resistance of Plastic Film and Thin Sheeting by Pendulum Method.

In addition to elements of opacity and color hue, the strip material may also contain optically active additives that would enable detection, such as ultraviolet brighteners or magnetically active markers such as magnetic particles. The reinforcing strip may contain material whose presence can be detected during manufacturing processing steps using visual, ultraviolet, or magnetic field detectors. As such, this would enable quality assurance practices such as edge detection for alignment or detecting discontinuities in the strip insertion process.

In another example, at black bag, according to the design illustrated in FIG. 30A was produced with first and second sidewalls 3002, 3004 having a three coextruded layer B:A:B structure, where the ratio of layers was 20:60:20 and the nominal total thickness of unstretched film was 0.0090 inches. The exterior B layers comprised hexene LLDPE of density 0.918, VLDPE of density 0.905, and metallocene LLDPE of density 0.918. The interior A core layer comprised hexene LLDPE of density 0.926, metallocene LLDPE of density 0.918, butene LLDPE of density 0.918, reclaimed resin from trash bags, processing aide, colorant containing carbon black, and colorant containing white $TiO_2$. The reinforcing strip 3030 had a three coextruded layer B:A:B structure, where the ratio of layers was 15:70:15 and the nominal total thickness of unstretched film was 0.0038 inches. The exterior B layers comprised hexene LLDPE of density 0.928, LDPE of density 0.923, and a processing aide. The interior A core layer comprised HDPE of density 0.949 and colorant containing carbon black. The top patterned bag area 3078 above the strip 3030 had an opacity of 55.9 and a light transmission of 55.6. The patterned strip area 3080 had an opacity of 69.7 and a light transmission of 25.3. The top patterned bag area 3078 above the strip 3030 had an MD Tear Resistance of 22.0 N and the patterned strip area 3080 had an MD Tear Resistance of 25.3 N. The top area of the bag appeared grey and the bottom strip area appeared black.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Exemplary embodiments of this invention are described herein. Variations of those embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A thermoplastic bag comprising:

a first sidewall made of a flexible thermoplastic multilayer web material;

a second sidewall of the flexible thermoplastic multilayer web material overlaid and joined to the first sidewall to provide an interior volume, the first and second sidewalls joined along a first side edge, an opposite second side edge, and a closed bottom edge, the first and second sidewalls un-joined along their respective top edges to define an opening opposite the bottom edge for accessing the interior volume;

a multilayer non-porous thermoplastic reinforcing strip of the flexible thermoplastic multilayer web material disposed along the interior of the closed bottom edge; and a first plurality of discontinuous cold bonds securing the multilayer reinforcing strip directly to the first sidewall and a second plurality of discontinuous cold bonds securing the multilayer reinforcing strip directly to the second sidewall;

wherein the multilayer reinforcing strip:

extends from the first side edge to the opposite second side edge; and has top edges positioned closer to the bottom edge of the bag than the top edges of the first and second sidewalls of the bag such that a majority of a bag body for holding contents is devoid of the multilayer reinforcing strip; and wherein the first plurality of discontinuous cold bonds and the second plurality of discontinuous cold bonds are configured to de-bond and allow the reinforcing strip to act as a shock absorber as articles are added to the bag.

2. The thermoplastic bag of claim 1, wherein the multilayer web material has a BAB structure and the multilayer reinforcing strip has a B'A'B' structure.

3. The thermoplastic bag of claim 2, wherein B' is substantially the same material as B.

4. The thermoplastic bag of claim 2, wherein the multilayer web material has a combined B weight percentage of 30% to 50%.

5. The thermoplastic bag of claim 1, wherein the the first plurality of discontinuous cold bonds and the second plurality of discontinuous cold bonds securing the multilayer reinforcing strip directly to the first and second sidewalls consists of weak bonds.

6. The thermoplastic bag of claim 5, wherein the reinforcing strip is raised above the bag bottom edge and the weak bonds are configured to de-bond and allow the reinforcing strip to move downward and act as a shock absorber as articles are added to the bag.

7. The thermoplastic bag of claim 1, further comprising areas in which the reinforcing strip is not bonded to the first sidewall and the second sidewall dispersed about the first plurality of discontinuous cold bonds and the second plurality of discontinuous cold bonds securing the multilayer reinforcing strip directly to the first and second sidewalls.

8. A thermoplastic bag comprising:

a first sidewall made of a flexible thermoplastic multilayer web material;

a second sidewall of the flexible thermoplastic multilayer web material overlaid and joined to the first sidewall to provide an interior volume, the first and second sidewalls joined along a first sealed side edge, an opposite second sealed side edge, and a closed bottom folded edge, the first and second sidewalls un-joined along their respective top edges to define an opening opposite the bottom edge for accessing the interior volume; and a multilayer reinforcing strip of the flexible thermoplastic multilayer web material extending across the first and second sealed side edges from the bottom folded edge partially toward the opening;

wherein the multilayer reinforcing strip is secured to the first sidewall by a first plurality of discontinuous cold bonds and wherein the multilayer reinforcing strip is secured to the second sidewall by a second plurality of discontinuous cold bonds;

wherein the multilayer reinforcing strip:

extends from the first side edge to the opposite second side edge; and extends between the bottom folded edge and the respective top edges a distance less than a half of a height of the first sidewall such that a majority of a bag body for holding contents is devoid of the multilayer reinforcing strip; and wherein the first plurality of discontinuous cold bonds and the second plurality of discontinuous cold bonds are configured to de-bond and allow the reinforcing strip to act as a shock absorber as articles are added to the bag.

9. The draw tape bag of claim 8, wherein the sidewalls are formed with a plurality of patterns.

10. The thermoplastic bag of claim 8, wherein the first plurality of discontinuous cold bonds and the second plurality of discontinuous cold bonds securing the reinforcing strip to the first sidewall and the second sidewall comprise ring roll bonds or SELFing bonds.

11. The thermoplastic bag of claim 8, wherein the reinforcing strip is additionally adhesively bonded to the first sidewall and the second sidewall.

12. The thermoplastic bag of claim 8, wherein the reinforcing strip is heat bonded to the first sidewall and the second sidewall along the side edges.

13. The thermoplastic bag of claim 8, wherein the first plurality of discontinuous cold bonds and the second plurality of discontinuous cold bonds consists of weak bonds that are configured to break and absorb energy.

14. The thermoplastic bag of claim 8, wherein the first plurality of discontinuous cold bonds and the second plurality of discontinuous cold bonds securing the reinforcing strip to the first and second sidewalls are positioned throughout the reinforcing strip and are surrounded by areas in which the reinforcing strip is not bonded to the first sidewall and the second sidewall.

15. A draw tape bag comprising:

a first sidewall made of a flexible thermoplastic multilayer web material;

a second sidewall of the flexible thermoplastic multilayer web material, overlaid and joined to the first sidewall to provide an interior volume, the first and second sidewalls joined along a first sealed side edge, an opposite second sealed side edge, and a closed bottom folded edge, the first and second sidewalls un-joined along their respective top edges to define an opening opposite the bottom edge for accessing the interior volume;

a closure mechanism, the closure mechanism comprising a hem, one or more draw tape notches, and a draw tape within the hem, the hem being in at least one of the sidewalls and having a top length and extending along the open top end disposed opposite the bottom edge, the hem having a bottom length and a hem seal, the hem including the one or more draw tape notches and the draw tape;

a folded multilayer reinforcing strip of the flexible thermoplastic multilayer web material extending from the first sealed side edge to the second sealed side edge and from the bottom folded edge toward the opening a distance less than half of a height of the first sidewall such that a top of the folded multilayer reinforcing strip is positioned more than half the height of the first sidewall from the closure mechanism such that a majority of a bag body for holding contents is devoid of the multilayer reinforcing strip; and a first plurality of discontinuous cold bonds securing the folded multilayer reinforcing strip directly to the first sidewall and a second plurality of discontinuous cold bonds securing the folded multilayer reinforcing strip directly to the second sidewall, the first and second plurality of discontinuous cold bonds being positioned throughout multilayer reinforcing strip and the first and second plurality of discontinuous cold bonds being configured to de-bond and allow the multilayer reinforcing strip to act as a shock absorber as articles are added to the bag.

16. The draw tape bag of claim 15, wherein the multilayer web material has a BAB structure and the multilayer reinforcing strip has a B'A'B' structure.

17. The thermoplastic bag of claim 16, wherein B' is substantially the same material as B.

18. The thermoplastic bag of claim 16, wherein the first plurality of discontinuous cold bonds and the second plurality of discontinuous cold bonds securing the reinforcing strip to the first and second sidewalls are positioned throughout the reinforcing strip and are surrounded by areas in which the reinforcing strip is not bonded to the first sidewall and the second sidewall.

19. The draw tape bag of claim 15, wherein the reinforcing strip is substantially aligned with the bag bottom edge and the reinforcing strip is attached to the first and second bag sidewalls.

20. The thermoplastic bag of claim 15, wherein the reinforcing strip is raised above the bag bottom edge.

21. The draw tape bag of claim 15, wherein the first plurality of discontinuous cold bonds and the second plurality of discontinuous cold bonds consists of weak bonds that are configured to break and absorb energy.

* * * * *